US007609588B2

(12) United States Patent
Tokoro et al.

(10) Patent No.: US 7,609,588 B2
(45) Date of Patent: Oct. 27, 2009

(54) MULTIFUNCTIONAL CLOCK CAPABLE OF REALIZING PLURALITY OF MOVEMENT LAYOUTS

(75) Inventors: Takeshi Tokoro, Chiba (JP); Kei Hirano, Chiba (JP); Mamoru Watanabe, Chiba (JP)

(73) Assignee: Seiko Instruments Inc. (JP)

( * ) Notice: Subject to any disclaimer, the term of this patent is extended or adjusted under 35 U.S.C. 154(b) by 105 days.

(21) Appl. No.: 11/667,176

(22) PCT Filed: Dec. 15, 2004

(86) PCT No.: PCT/JP2004/018727

§ 371 (c)(1),
(2), (4) Date: May 29, 2007

(87) PCT Pub. No.: WO2006/064556

PCT Pub. Date: Jun. 22, 2006

(65) Prior Publication Data

US 2007/0291593 A1 Dec. 20, 2007

(51) Int. Cl.
*G04B 19/24* (2006.01)

(52) U.S. Cl. ..... 368/28; 368/80

(58) Field of Classification Search ..... 368/28, 368/34, 80, 220, 223

See application file for complete search history.

(56) References Cited

U.S. PATENT DOCUMENTS

| | | | | | |
|---|---|---|---|---|---|
| 4,623,261 | A | * | 11/1986 | Muto | 368/80 |
| 4,748,603 | A | * | 5/1988 | Ray et al. | 368/80 |
| 5,289,452 | A | * | 2/1994 | Sakamoto et al. | 368/73 |
| 5,956,294 | A | * | 9/1999 | Takizawa et al. | 368/37 |

FOREIGN PATENT DOCUMENTS

| | | |
|---|---|---|
| CH | 0682284 | 8/1993 |
| EP | 1102135 | 5/2001 |

* cited by examiner

*Primary Examiner*—Tru T Nguyen
*Assistant Examiner*—Jason Collins
(74) *Attorney, Agent, or Firm*—Adams & Wilks

(57) ABSTRACT

A multifunctional watch has a movement including first and second train wheel rotational centers each arranged at a position between a center of a main plate and an outline portion of the main plate. The first and second train wheel rotational centers are provided with respective first and second train wheel guide portions rotatably guiding respective first and second train wheel members about the respective first and second train wheel rotational centers. A first train wheel having the first train wheel member is arranged rotatably relative to the first train wheel rotational center for rotating one of the small hands only in a single direction of rotation to display the first calendar information. A second train wheel having the second train wheel member is arranged rotatably relative to the second train wheel rotational center for rotating another of the small hands only in a single direction of rotation to display the second calendar information.

13 Claims, 44 Drawing Sheets

FIG. 10

| | HAND POSITION AND HAND SPECIFICATION | | | | | | |
|---|---|---|---|---|---|---|---|
| | 2 O' CLOCK (DATE HAND) | 3 O' CLOCK (DATE HAND) | 6 O' CLOCK (SMALL SECOND HAND) | 9 O' CLOCK (DAY HAND) | 10 O' CLOCK (DAY HAND) | 12 O' CLOCK (24 HOUR HAND) | 9 O' CLOCK (RETROGRADE DAY HAND) |
| FIRST KIND | – | O | O | O | – | O | – |
| SECOND KIND | – | O | O | O | – | – | – |
| THIRD KIND | – | – | O | – | – | O | – |
| FOURTH KIND | – | O | – | O | – | – | – |
| FIFTH KIND | – | – | O | – | – | – | – |
| SIXTH KIND | O | – | O | – | O | – | – |
| SEVENTH KIND | – | O | O | – | – | O | O |
| EIGHTH KIND | – | O | O | – | – | – | O |

MULTIFUNCTIONAL CLOCK CAPABLE OF REALIZING PLURALITY OF MOVEMENT LAYOUTS

CROSS-REFERENCE TO RELATED APPLICATIONS

This application is a U.S. national stage application of International Application No. PCT/JP2004/018727, filed Dec. 15, 2004, and published in a non-English language.

TECHNICAL FIELD

The present invention relates to a multifunctional watch provided with one or plural small hands, and particularly, the present invention relates to an analog multifunctional watch provided with the small hand for carrying out various displays, which is constituted so as to be capable of realizing a plurality of movement layouts without changing sizes and shapes of components for the movement but only by changing positions where the components are incorporated.

BACKGROUND ART (1) Explanation of Terms

Generally, a machinery including a drive part of a watch is referred to as "movement". The state that a dial and a watch hand are attached to the movement and the movement is inputted in a watch case to be made into a completed good is referred to as a "complete". Among the both sides of a main plate forming a circuit board of a watch, a side where a glass of the watch case is disposed, namely, the side where the dial is disposed is referred to as "a back side" or "a glass side" or "a dial side". Among the both sides of the main plate, the side where a case back of the watch case is disposed, namely, the opposite side of the dial is referred to as "a front side" or "a case back side" of the movement. A train wheel to be incorporated in "the front side" of the movement is referred to as "a front train wheel". The train wheel to be incorporated in "the back side" of the movement is referred to as "a back train wheel". Generally, "twelve o'clock side" represents the side that a scale corresponding to twelve o'clock is arranged in an analog-system watch. "A twelve o'clock direction" represents a direction from the center of the main plate or a rotational center of a pointer of the watch or the like (hereinafter, referred to as "a main plate center") toward "the twelve o'clock side" in the analog-system watch. In addition, "the two o'clock side" represents the side where the scale corresponding to two o'clock of the dial in the analog-system watch is arranged. "The two o'clock direction" represents a direction from the main plate center toward "the two o'clock side" in the analog-system watch.

In addition, "a three o'clock side" represents the side where the scale corresponding to three o'clock of the dial is arranged in the analog-system watch. "A three o'clock direction" represents a direction from the main plate center toward "the tree o'clock side." in the analog-system watch. In addition, "a six o'clock side" represents the side where the scale corresponding to six o'clock of the dial is arranged in the analog-system watch. "A six o'clock direction" represents a direction from the main plate center toward "the six o'clock side" in the analog-system watch. In addition, "a nine o'clock side" represents the side where the scale corresponding to nine o'clock of the dial is arranged in the analog-system watch. "A nine o'clock direction" represents a direction from the main plate center toward "the nine o'clock side" in the analog-system watch. In addition, "a ten o'clock side" represents the side where the scale corresponding to ten o'clock of the dial is arranged in the analog-system watch. "A ten o'clock direction" represents a direction from the main plate center toward "the ten o'clock side" win the analog-system watch. Further, the side where other scale of the dial is arranged may be shown, for example, "a four o'clock side" or "a four o'clock side".

Further, according to the present specification, a line from the main plate center toward "the three o'clock side" may be simply referred to as "the three o'clock direction". In the same way, a line from the main plate center toward "the twelve o'clock side" may be simply referred to as "the twelve o'clock direction", a line from the main plate center toward "the four o'clock side" may be simply referred to as "the four o'clock direction", a line from the main plate center toward "the six o'clock side" may be simply referred to as "the six O'clock direction", and a line from the main plate center toward "the nine o'clock side" may be simply referred to as "the nine o'clock direction". In addition, further, according to the present specification, the range between "the three o'clock direction" and "the four o'clock direction" may be referred to as "a three to four o'clock range", the range between "the twelve o'clock direction" and "the three o'clock direction" may be referred to as "a twelve to three o'clock range", the range between "the three o'clock direction" and "the six o'clock direction" may be referred to as "a three to six o'clock range", the range between "the six o'clock direction" and "the nine o'clock direction" may be referred to as "a six to nine o'clock range", and the range between "the nine o'clock direction" and "the twelve o'clock direction" may be referred to as "a nine to twelve o'clock range".

(2) A Conventional Multifunctional Watch with a Small Hand:

(2.1) A First Type of a Multifunctional Watch:

In a conventional first type of a multifunctional watch provided with the small hand, a date star and a small day wheel are aligned on a position approximately symmetrical about the watch. The small day wheel which is a type of the small hand is disposed in the date star. In addition, the small hand which is a type of the small hand is disposed in the small day wheel (for example, refer to Patent Document 1).

(2.2) Second Type of Multifunctional Clock:

In a conventional second type of a multifunctional watch provided with a small hand, the date star and the small day wheel are aligned on the position approximately symmetrical about the watch, and the date star and the small day wheel have the both of a date feeding nail and a day feeding nail, respectively (for example, refer to Patent Document 2).

(2.3) Third Type of Multifunctional Clock:

In a conventional third type of a multifunctional watch, the main plate is provided with a rotor and a train wheel rotational center used for manufacturing "a center chronograph watch" and a rotor and a train wheel rotational center used for manufacturing "a side chronograph watch", and a bearing member is provided with a rotor and a train wheel rotational center used for manufacturing "the center chronograph watch" and a rotor and a train wheel rotational center used for manufacturing "the side chronograph watch". The rotor and the train wheel rotational center used for manufacturing "the side chronograph watch" provided with a chronograph hand which is a type of small hand are incorporated so as to be capable of being rotated around the train wheel around the train wheel rotational center of the main plate and the train wheel rotational center of the bearing member (for example, refer to Patent Document 3).

(2.4) Fourth Type of Multifunctional Clock:

In a conventional fourth type of a multifunctional watch, a small hand being rotated 360 degrees is added to "the twelve o'clock side", a small hand to be moved shaped in a fan is disposed to "the three o'clock side" and "the nine o'clock side", respectively, and a disk for displaying an age of moon or the like is disposed to "the six o'clock side". The small hand to be moved shaped is disposed to the display wheel having a hairspring provided (for example, refer to Patent Document 4).

Patent Document 1: JP-UM-A-63-187089 (FIG. 1)

Patent Document 2: JP-UM-A-63-187090 (FIG. 1)

Patent Document 3: JP-A-2004-20421 (Pages 9 to 20, FIGS. 1 to 8)

Patent Document 4: Swiss Patent No. CH666591G A3 (FIG. 1)

SUMMARY OF THE INVENTION

Problems that the Invention is to Solve

However, in the conventional multifunctional watch provided with a small hand, in the movement, a plurality of associated components had to be changed in the case of changing the position of the rotational center of a gear to which a small hand (a small display hand) such as a date star, a small day wheel, and a chronograph wheel. Accordingly, when forming a plurality of movement layouts having a small hand, many process machineries and moldings or the like had to be prepared for separately designing each movement and processing components of each movement. Therefore, upon manufacture of the conventional multifunctional watch having the small hand, there is a problem that much time is required in order to switch the component processing operation and the number of steps for manufacture of the component is increased.

An object of the present invention is to realize an analog multifunctional watch provided with a small hand, which is constituted so as to be capable of realizing a plurality of movement layouts without changing sizes and shapes of components for the movement only by changing positions where the components are incorporated.

In addition, another object of the present invention is to realize an analog multifunctional watch provided with a small hand, which does not require much time for switching the component processing operation and which requires a few number of steps for the manufacture of the component.

Means for Solving the Problems

The present invention provides a multifunctional watch comprising: a main plate to form a substrate of a movement; a hand setting stem for correcting display; a switching mechanism for switching the position of the hand setting stem; a dial for displaying time information; and a small hand for displaying the time information or calendar information. In this multifunctional watch, the movement comprises a first train wheel rotational center for a train wheel which is used when manufacturing a first type of a multifunctional watch having the alignment of a first type of a small hand by using the movement and a second train wheel rotational center for a train wheel which is used when manufacturing a second type of a multifunctional watch having the alignment of a second type of a small hand by using the movement. In this multifunctional watch, the first train wheel rotational center is aligned on a position between a main plate center of the main plate and a main plate outline portion of the main plate; and the second train wheel rotational center is aligned on a position between a main plate center of the main plate and a main plate outline portion of the main plate. On the first train wheel rotational center, a train wheel guide portion for rotatably guiding a train wheel member rotated centering around that position is disposed; on the second train wheel rotational center, a train wheel guide portion for rotatably guiding a train wheel member rotated centering around that position is disposed. The train wheel for displaying the time information or the calendar information is aligned so as to be capable of being rotated for one of the first train wheel rotational center and the second train wheel rotational center. This multifunctional watch is constituted so that the time information or the calendar information is displayed by a small hand rotated centering around the position between the main plate center and the outline portion of the main plate. Due to this constitution, it is possible to obtain a multifunctional watch which can realize a plurality of movement layouts.

According to the multifunctional watch of the present invention, the first train wheel rotational center can be aligned in a three o'clock direction of the movement, and the second train wheel rotational center can be aligned in a two o'clock direction of the movement. Alternatively, it is possible to arrange the first rotational center of the train wheel in the nine o'clock direction of the movement and the second rotational center of the train wheel in the ten o'clock direction of the movement. In addition, according to the multifunctional watch of the present invention, the movement can be provided with a third train wheel rotational center for a train wheel which is used when manufacturing a multifunctional watch having the alignment of a further small hand. According to this constitution, the third train wheel rotational center is aligned on a position between the main plate center of the main plate and the main plate outline portion of the main plate; on the third train wheel rotational center, a train wheel guide portion for rotatably guiding a train wheel member rotated centering around that position is disposed. Then, a train wheel for displaying the time information or the calendar information is rotatably aligned for the third train wheel rotational center; and the multifunctional watch is constituted so that the time information or the calendar information is displayed by the further small hand. Due to this constitution, it is possible to obtain the multifunctional watch which can display the time information or the calendar information by means of a further small hand.

In addition, according to the multifunctional watch of the present invention, the third train wheel rotational center can be aligned in a six o'clock direction of the movement. Further, according to the multifunctional watch of the present invention, the third train wheel rotational center can be aligned in a twelve o'clock direction of the movement. Due to this constitution, it is possible to obtain the multifunctional watch which can realize various movement layouts. In addition, according to the multifunctional watch of the present invention, the first train wheel rotational center can be aligned in a three o'clock direction of the movement, a date star for displaying a date can be aligned so as to be capable of being rotated centering around the first train wheel rotational center; and a date corrector setting operating wheel for correcting the display of the date star can be aligned so as to be capable of being rotated centering around the rotational center of the date star. Due to this constitution, it is possible to realize the multifunctional watch provided with the constitution which can reliably set the date star.

In addition, according to the multifunctional watch of the present invention, the movement can be constituted so as to comprise a first train wheel guide portion for incorporating a date corrector setting operating wheel for correcting the display of the date star when the date star for displaying a date is aligned on the first train wheel rotational center and a second train wheel guide portion for incorporating a date corrector setting operating wheel for correcting the display of the date star when the date star for displaying a date is aligned on the second train wheel rotational center. Due to this constitution, it is possible to realize the multifunctional watch which is constituted so as to be capable of reliably correcting the date stars arranged on plural positions. In addition, according to the multifunctional watch of the present invention, the movement can be constituted to comprise a first setting spring portion for applying pressure on a date corrector setting operating wheel for correcting the display of the date star when the date star for displaying a date is aligned on the first train wheel rotational center and a second setting spring portion for applying pressure on a date corrector setting operating wheel for correcting the display of the date star when the date star for displaying a date is aligned on the second train wheel rotational center. Due to this constitution, it is possible to realize the multifunctional watch which is constituted so as to be capable of reliably suppressing the setting stars arranged on plural positions.

In addition, according to the multifunctional watch of the present invention, the movement can be constituted to comprise a first date jumper for setting rotation of the date star when the date star for displaying a date is aligned on the first train wheel rotational center and a second date jumper for setting rotation of the date star when the date star for displaying a date is aligned on the second train wheel rotational center. Due to this constitution, it is possible to realize the multifunctional watch provided with the constitution which can reliably set the date stars arranged on plural positions.

Further, according to the multifunctional watch of the present invention, the movement can be constituted to comprise a first day jumper for setting the rotation of a small day wheel when the small day wheel for displaying a day is aligned on the first train wheel rotational center and a second day jumper for setting the rotation of the small day wheel when the small day wheel for displaying a day is aligned on the second train wheel rotational center. Due to this constitution, it is possible to realize the multifunctional watch provided with the constitution which can reliably set the small day wheels arranged on plural positions.

In addition, according to the multifunctional watch of the present invention, the movement can be constituted to comprise a day indicator driving wheel which is rotated on the basis of the rotation of an hour wheel; and the day indicator driving wheel is constituted so as to be capable of rotating the small day wheel when the small day wheel for displaying a day is aligned on the first train wheel rotational center and so as to be capable of rotating the small day wheel when the small day wheel for displaying a day is aligned on the second train wheel rotational center. Due to this constitution, it is possible to realize the multifunctional watch for displaying "hour" by the small hand mounted on an hour wheel.

Further, according to the multifunctional watch of the present invention, the day indicator driving wheel can be further constituted so as to be capable of rotating a hour wheel for displaying an hour. Due to this constitution, it is possible to realize the multifunctional watch for displaying "hour" by means of a small hand which is attached to the hour wheel.

Advantage of the Invention

In the multifunctional watch having a small hand, the present invention can form a plurality of movement layouts without changing sizes and shapes of components for the movement only by changing positions where the components are incorporated in the case of changing the position of the rotational center of a gear to which the small hand is attached. In addition, the multifunctional watch of the present invention does not require much time for switching the component processing operation. As a result, it is possible to reduce the number of steps for manufacture of the component.

BRIEF DESCRIPTION OF THE DRAWINGS

FIG. 10 is a view showing a list of a hand position and a hand specification of a small hand according to the first embodiment of the multifunctional watch of the present invention.

DETAILED DESCRIPTION OF THE PREFERRED EMBODIMENTS

The embodiments according to the present invention will be described with reference to the drawings below.

(1) First Embodiment

At first, the first embodiment of the multifunctional watch according to the present invention will be described.

(1.1) The Entire Constitution of the Movement

With reference to FIGS. 1 to 6, according to the first embodiment of the multifunctional watch according to the present invention, the movement is composed of an analog-system electronic watch. More in detail, the first embodiment of the multifunctional watch according to the present invention is composed of an analog-system watch (an electric watch, an electronic watch, and a mechanical watch) having a small hand on at least one place among "a three o'clock direction", "a six o'clock direction", "a nine o'clock direction", and "a twelve o'clock direction". In other words, according to the first embodiment of the multifunctional watch of the present invention, the time information related to "hour" of 12-hours is displayed by a hour hand where its rotational center is a center of a main plate, the time information related to "minute" is displayed by a minute hand where its rotational center is the center of the main plate, the time information related to "hour" of 24-hours is displayed by a 24 hour hand where its rotational center is arranged in "the twelve o'clock direction", the calendar information related to "date" is displayed by a date hand where its rotational center is arranged in "the three o'clock direction", the time information related to "second" is displayed by a small second hand arranged where its rotational center is arranged in "the six o'clock direction", and the calendar information related to "day" is displayed by a day hand where its rotational center is arranged in "the nine o'clock direction".

According to the first embodiment of the multifunctional watch of the present invention, a movement 201 is provided with a main plate 202. A power source unit, a circuit unit, a step motor, a front train wheel, and a switching mechanism or the like are aligned on a case back side (a front side) of the main plate 202. A back train wheel, a calendar train wheel, and a date corrector setting mechanism or the like are aligned on a back side of the main plate 202. A dial 204 is aligned on a glass side of the main plate 202. A hand setting stem 210 is rotatably aligned on the three o'clock side of the main plate 202.

(1.2) Structures of Power Source Unit and Circuit Unit

Figure 3:
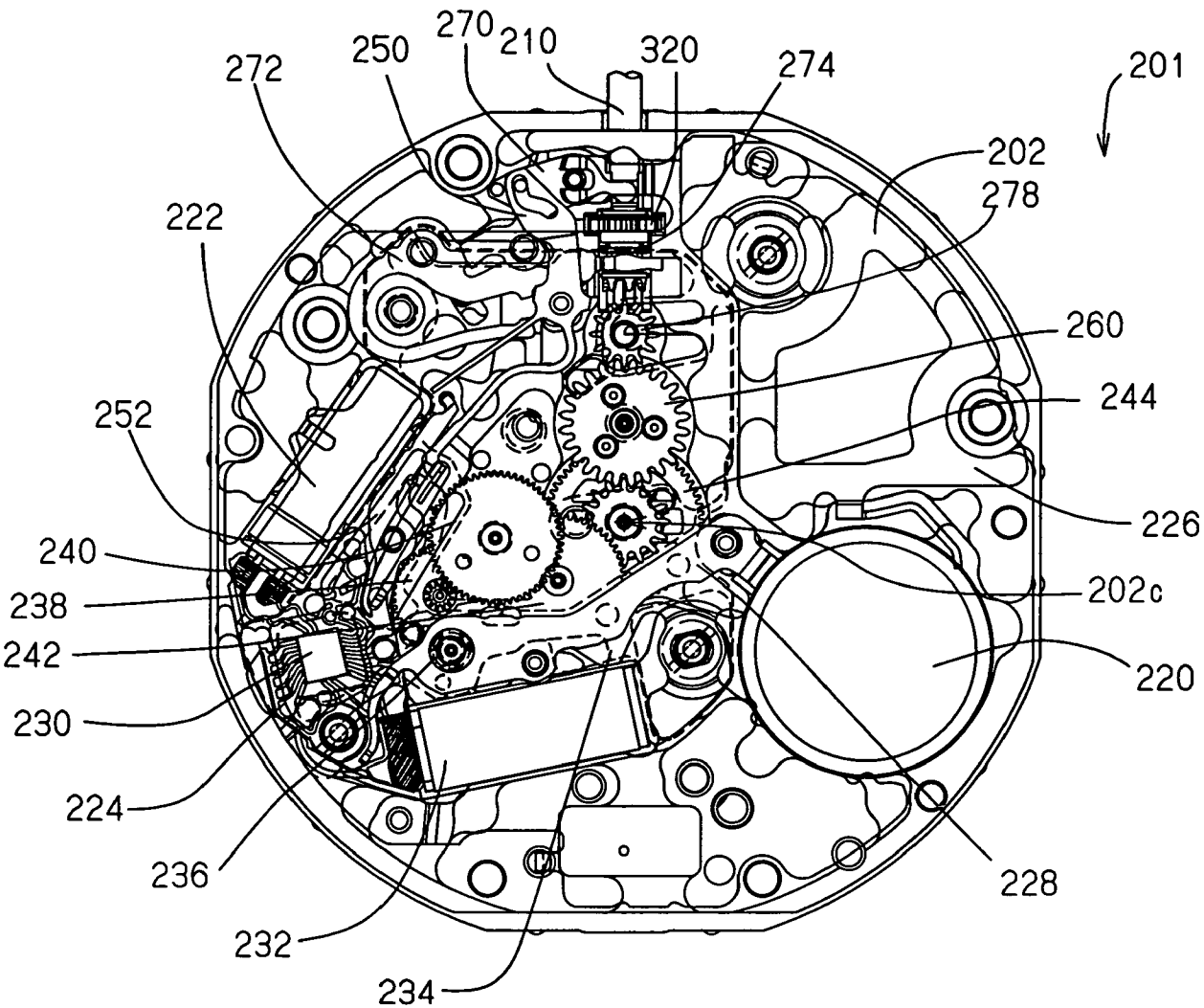
FIG. 3 is a plan view showing a schematic constitution seen from a front side of a movement according to the first embodiment of the multifunctional watch of the present invention.

With reference to FIG. 3, a battery 220 structured by a source of power of the multifunctional watch is aligned on the case back side of the main plate 202. A crystal unit 222 constituting a source of oscillation of a watch is aligned on the case back side of the main plate 202. For example, a crystal oscillator oscillating at 32,768 Hz is contained in a crystal unit 222. A lead portion of the crystal unit 222 is fixed to a circuit board 224. A battery plus terminal 226 is aligned so as to conduct an anode of the battery 220 and a plus pattern of the circuit board 224. A battery minus terminal 228 is aligned so as to conduct an anode of the battery 220 and a minus pattern of the circuit board 224. The multifunctional watch according to the present invention also can be composed of a watch having a source of a reference signal (a source of oscillation) other than the crystal unit.

An oscillator for outputting a reference signal on the basis of the oscillation of the crystal oscillator, a divider for dividing an output signal of the oscillator, and a driver for outputting a motor drive signal to drive the step motor on the basis of the output signal of the divider are incorporated in an integrated circuit (IC) 230. The integrated circuit (IC) 230 is formed by a C-MOS or a PLA, for example. In the case of forming the integrated circuit (IC) 230 by the C-MOS, the oscillator, the divider, and the driver are incorporated in the integrated circuit 230. In the case of forming the integrated circuit (IC) 230 by the PLA, the oscillator, the divider, and the driver are constituted so as to be operated by a program stored in the PLA. The integrated circuit 230 is fixed to the circuit board 224. The circuit board 224, the crystal unit 222, and the integrated circuit 230 form a circuit block.

(1.3) Constitution of Step Motor

Figure 4:
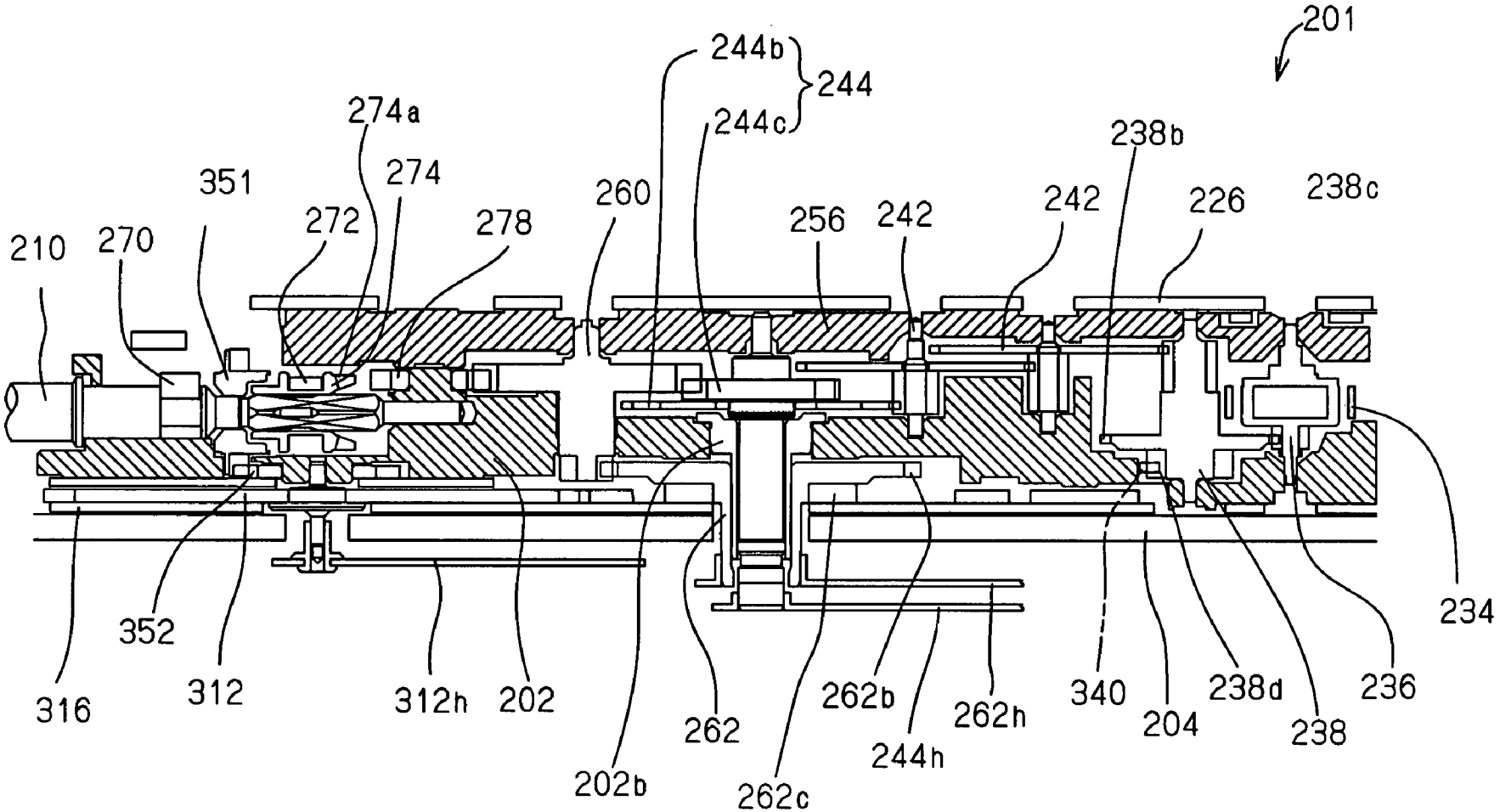
FIG. 4 is a partial cross sectional view showing a part of a hand setting stem and a front train wheel according to the first embodiment of the multifunctional watch of the present invention.

With reference to FIG. 3 and FIG. 4, a coil block 232 including a coil wire wound on a magnet core, a stator 234 aligned so as to contact the opposite end portions of the magnet core of the coil block 232, and a rotor 236 including a rotor magnet aligned on a rotor hole of the stator 234 are aligned on the case back side of the main plate 202. The coil block 232, the stator 234, and the rotor 236 constitute the step motor.

(1.4) Constitution of Front Train Wheel

A fifth wheel and pinion 238 to be rotated on the basis of the rotation of the rotor 236 is aligned on the case back side of the main plate 202. The fifth wheel and pinion 238 includes a fifth gear 238*b*, a fifth upper pinion 238*c*, and a fifth lower pinion 238*d*. A rotor pinion is constituted so as to be engaged with the fifth gear 238*b*. A fourth wheel and pinion 240 to be rotated on the basis of the rotation of the fifth wheel and pinion 238 is aligned on the case back side of the main plate 202. The fifth pinion is constituted so as to be engaged with a fourth gear. A third wheel and pinion 242 to be rotated on the basis of the rotation of the fourth wheel and pinion 240 is aligned on the case back side of the main plate 202. A fourth pinion is constituted so as to be engaged with the third gear. A second wheel and pinion 244 to be rotated on the basis of the rotation of the third wheel and pinion 242 is aligned on the case back side of the main plate 202. The second wheel and pinion 244 includes a second gear 244*b* and a second pinion 244*c*. A third pinion is constituted so as to be engaged with the second gear 244*b*. A slip mechanism is disposed between the second gear 244*b* and the second pinion 244*c*. By providing the slip mechanism, when adjusting a hand, the minute hand and the hour hand can be rotated by rotating the hand setting stem 210 with the rotation of the front train wheel stopped. A minute hand 244*h* is attached to the second wheel and pinion 244.

When adjusting the hand by pulling out the hand setting stem 210 to a second step, in order to set the fourth wheel and pinion 240, a setting lever 250 is aligned on the side of the case back of the main plate 202. When adjusting the hand by pulling out the hand setting stem 210 to the second step, in order to reset the operation of the integrated circuit 230, a reset lever 252 is aligned on the side of the case back of the main plate 202. A train wheel bridge 256 supports the upper shaft portion of the rotor 236, the upper shaft portion of the fifth wheel and pinion 238, the upper shaft portion of the fourth wheel and pinion 240, the upper shaft portion of the third wheel and pinion 242, and the upper shaft portion of the second wheel and pinion 244 so as to be capable of being rotated, respectively. The main plate 202 supports the lower shaft portion of the rotor 236, the lower shaft portion of the fifth wheel and pinion 238, the lower shaft portion of the fourth wheel and pinion 240, and the lower shaft portion of the third wheel and pinion 242 so as to be capable of being rotated, respectively. A center pipe 202*b* is aligned on a main plate center 202*c* of the main plate 202. A bead portion of the second wheel and pinion 244 is supported so as to be rotatable in an inner diametric portion of a center hole of the center pipe 202*b*. The rotational center of the second wheel and pinion 244 is aligned on the main plate center 202*c*.

The second wheel and pinion 244 is formed so as to be rotated 360 degrees for an hour. A minute wheel 260 to be rotated on the basis of the rotation of the second wheel and pinion 244 is aligned on the side of the case back of the main plate 202. The second pinion 244*c* is constituted so as to be engaged with the date back gear. An hour wheel 262 is constituted so as to be rotated on the basis of the rotation of the minute wheel 260. The hour wheel 262 is aligned on the side of the dial of the main plate 202. The hour wheel 262 includes an hour gear 262*b* and a date pinion 262*c*. The center hole of the hour wheel 262 is aligned so as to be rotatable around the outer circumferential portion of the hour wheel of the center pipe 202*b*. The minute pinion is formed so as to be engaged with the hour gear 262*b* of the hour wheel 262. The hour wheel 262 is formed so as to be rotated 360 degrees for twelve hours. An hour hand 262*h* is attached to the hour wheel 262. The rotational center of the hour wheel 262 is aligned on the main plate center 202*c*. The hour information related to "hour" can be displayed by the hour hand 262*h* in a system such that one cycle takes twelve hours (referred to as "12-hours") and the time information related to "minute" can be displayed by the minute hand 244*h*. As a modified example, by using a publicly-known intermediate three hand train wheel mechanism, a second wheel and pinion for a intermediate three hand (not illustrated) having the rotational center on the main plate center 202*c* can be disposed. In the case of the modified example using the intermediate three hand train wheel mechanism, the second wheel and pinion for the intermediate three hand is formed so as to be rotated 360 degrees for a minute. Depending on a second hand (not illustrated) to be attached to the second wheel and pinion for the intermediate three hand, the time information related to "second" can be displayed.

(1.5) Constitution of Switching Mechanism

Next, the constitution of a switching mechanism will be described. In the multifunctional watch according to the present invention, the switching mechanism is aligned on the side of the case back of the main plate 202. The switching mechanism is aligned on "the three to six o'clock range". As the modified example, the switching mechanism can be also aligned on the side of the dial of the main plate 202. The switching mechanism, a time setting mechanism, and a calendar setting mechanism are disposed so as to set a time of the watch and set the display of the calendar by rotating the hand setting stem 210 with the hand setting stem 210 pulled out. With reference to FIG. 3 and FIGS. 4 to 6, the switching mechanism is constituted so as to include a setting lever 270 and a yoke 272. The setting lever 270 and the yoke 272 are supported so as to be operative for the main plate 202. According to this constitution, the yoke 272 is constituted so as to include a yoke spring portion at one tail portion. It is possible to decide the position in the rotational direction of the setting lever depending on contact between the setting lever 270 and the yoke 272.

The time setting mechanism includes the hand setting stem 210 and a clutch wheel 274. The hand setting stem 210 includes a front end shaft portion, an angular shaft portion, a first date corrector setting operating wheel guide portion, a setting lever bridge, a setting lever outer wall portion, and an outside shaft portion or the like. The front end shaft portion of the hand setting stem 210 is supported so as to be rotatable for a hand setting stem front end guide hole of the main plate 202. The outside portion of the setting lever outer wall of the hand setting stem 210 is supported so as to be rotatable for the hand setting stem front end guide hole of the main plate 202. Alternatively, the switching mechanism may be constituted so as to include the setting lever, the yoke, and a yoke holder (not illustrated). According to this constitution, a switching spring portion is disposed on the yoke holder, a switching pin portion is disposed on the setting lever, and a chevron portion is disposed on the front end of the switching spring portion, and then, by bringing the chevron portion having an elastic force into the switching portion, the position of the rotational direction of the setting lever can be decided.

A ratchet portion of the clutch wheel 274 is incorporated in the angular shaft portion of the hand setting stem 210. A hand setting stem contact portion of the setting lever 270 is located between the setting lever inner wall portion and the setting lever outer wall portion of the hand setting stem 210. The position of the hand setting stem 210 in a direction along the center axial line of the hand setting stem 210 is decided by the setting lever 270 and the yoke 272. The position of the clutch wheel 274 along the direction along the center axial line of the hand setting stem 210 is decided by the yoke 272. The clutch wheel 274 is provided with a ko-tooth 274*a* which is located near the center portion of the movement 201. The center hole portion of a first date corrector setting operating wheel 351 is incorporated so as to be rotatable for the first date corrector setting operating wheel guide portion of the hand setting stem. The first date corrector setting operating wheel 351 is constituted so as to be capable of being engaged with a second date corrector setting operating wheel 352. A setting wheel 278 is aligned on the case back side of the main plate 202. The setting wheel 278 is supported rotatably for a setting wheel pin of the main plate 202. The setting wheel 278 is constituted so that the minute wheel 260 is rotated by rotating the setting wheel 278.

Even if the hand setting stem 210 is rotated with the hand setting stem 210 located on a 0th step, the first date corrector setting operating wheel 320 is constituted so as to be unable to be rotated and the setting wheel 278 is constituted so as to be unable to be rotated. The center hole portion of the first date corrector setting operating wheel 351 is constituted so as to be fitted to the angular shaft portion of the hand setting stem 210 with the hand setting stem 210 pulled out to the first step. The center hole portion of the first date corrector setting operating wheel 351 is constituted so as to be capable of being rotated by rotating the hand setting stem 210 with the hand setting stem 210 pulled out to the first step. The ko-tooth 274*a* of the clutch wheel 274 is constituted so as to be capable of being engaged with the setting wheel 278 with the hand setting stem 210 pulled out to the second step. The setting wheel 278 is constituted so as to be capable of being rotated via the rotation of the clutch wheel 274 by rotating the hand setting stem 210 with the hand setting stem 210 pulled out to the second step. The second pinion of the second wheel and pinion 244 and the hour wheel 262 are constituted so as to be rotated via the rotation of the minute wheel 260 by rotating the setting wheel 278. When adjusting the hand with the hand setting stem 210 pulled out to the second step, the second pinion of the second wheel and pinion 244 is constituted so as to be capable of being slipped for the second gear of the second wheel and pinion 244.

(1.6) Constitution of Date Display Mechanism

Next, the constitution of a date display mechanism will be described. With reference to FIG. 1, FIG. 2, and FIGS. 4 to 6, the day display mechanism is constituted so as to be operated on the basis of the rotation of the hour wheel 262. The day display mechanism includes a date indicator driving wheel 310 and a date star 312 (first train wheel member). The date indicator driving wheel 310 is constituted so as to be rotated due to the rotation of the hour wheel 262. The date indicator driving wheel 310 is supported so as to be capable of being rotated for a date indicator driving wheel pin which is disposed on the main plate 202. The rotational center of the date indicator driving wheel 310 is preferably aligned in the range between "the five o'clock direction" and "the six o'clock direction" (namely, "the five to six o'clock range").

The date indicator driving wheel 310 includes a date tooth 310*b* and a date finger 310*f*. The date pinion 262*c* of the hour wheel 262 is constituted so as to be engaged with the date tooth 310*b* of the date indicator driving wheel 310. The date star 312 is constituted so as to be rotated once a day (1/31) by means of the date finger 310*f* which is disposed in the date indicator driving wheel 310. The date star 312 is constituted so as to be rotated 360 degrees for 31 days. A gear portion of the date star 312 is provided with thirty-one tooth. The position in the rotational direction of the date star 312 is set by a date jumper 316*b* which is disposed in the setting wheel plate 316. It is preferable that a setting portion which is disposed on the front end of a spring portion of the date jumper 316*b* is aligned in the range between "the two o'clock direction" and "the three o'clock direction" (namely, "the two to three range").

The rotational center of the date star 312 is aligned in "the three o'clock direction". As a result, the rotational center of the date star 312 is aligned on a center axial line of the hand setting stem 210. The lower shaft portion of the date star 312 is rotatably supported for the main plate 202. A part of the date corrector setting operating wheel cover 314 which is located on the lower part of the date star 312 is narrowed down to a circle toward the back surface of the main plate 202. It is preferable that a hole provided on the center of the circle narrowed-down portion of the date corrector setting operating wheel cover 314 is fitted in the date corrector setting operating wheel cover guide shaft portion which is disposed around the date star guide hole. A date hand 312*h* is attached to the upper shaft portion of the date star 312. The gear portion of the date star 312 is aligned between the date corrector setting operating wheel cover 314 located near the dial side of the main plate 202 and a setting wheel plate 316. A character, a numeral, and an abbreviation or the like for indicating a date is disposed on the dial 204. The date display mechanism is constituted so that the information related to "date" which is one of the calendar information can be displayed by the date hand 312*h*, the character, the numeral, and the abbreviation or the like.

(1.7) Constitution of Day Display Mechanism

Next, the constitution of a day display mechanism will be described. With reference to FIG. 1, FIG. 2, FIG. 4, and FIG. 5, the day display mechanism is constituted so as to be operated on the basis of the rotation of the hour wheel 262. The day display mechanism includes a day indicator driving wheel 320 and a small day wheel 322 (second train wheel member). Due to the rotation of the hour wheel 262, the day display mechanism is constituted so that the day indicator driving wheel 320 is rotated. The day indicator driving wheel 320 is rotatably supported for the day indicator driving wheel pin which is disposed on the main plate 202. It is preferable that the rotational center of the day indicator driving wheel 320 is aligned in the area between "the ten o'clock direction" and "the eleven o'clock direction" (namely, "the ten to eleven o'clock range").

The day indicator driving wheel 320 includes a day tooth 320*b* and a day finger 320*f*. The date pinion 262*c* of the hour wheel 262 is constituted so as to be engaged with the day tooth 320*b* of the day indicator driving wheel 320. The small day wheel 322 is constituted so as to be rotated once for a day (1/7) by means of the day finger 320*f* which is disposed in the day indicator driving wheel 320. A gear portion of the small day wheel 322 is provided with seven teeth. The small day wheel 322 is constituted so as to be rotated 360 degrees for seven days. The position in the rotational direction of the small day wheel 322 is set by a day jumper 316*c* which is disposed in the setting wheel plate 316. It is preferable that the setting portion disposed on the front end of the spring portion of the day jumper 316*c* is aligned in the range between "the eight o'clock direction" and "the nine o'clock direction" (namely, "the eight to nine o'clock range").

The rotational center of the small day wheel 322 is aligned in "the nine o'clock direction". As a result, the rotational center of the small day wheel 322 is aligned on an extended line of the center axial line of the hand setting stem 210. The lower shaft portion of the small day wheel 322 is rotatably supported for the main plate 202. A day finger 322*h* is attached to the upper shaft portion of the small day wheel 322. The gear portion of the small day wheel 322 is aligned between the main plate 202 and the setting wheel plate 316. The day character, the numeral, and abbreviation or the like for displaying the day are provided on the dial 204. The day display mechanism is constituted so as to be capable of displaying the information related to "day" which is one of the calendar information by the day finger 322*h*, the character, the numeral, and the abbreviation or the like.

(1.8) Constitution of 24 Hour Display Mechanism

Figure 1:
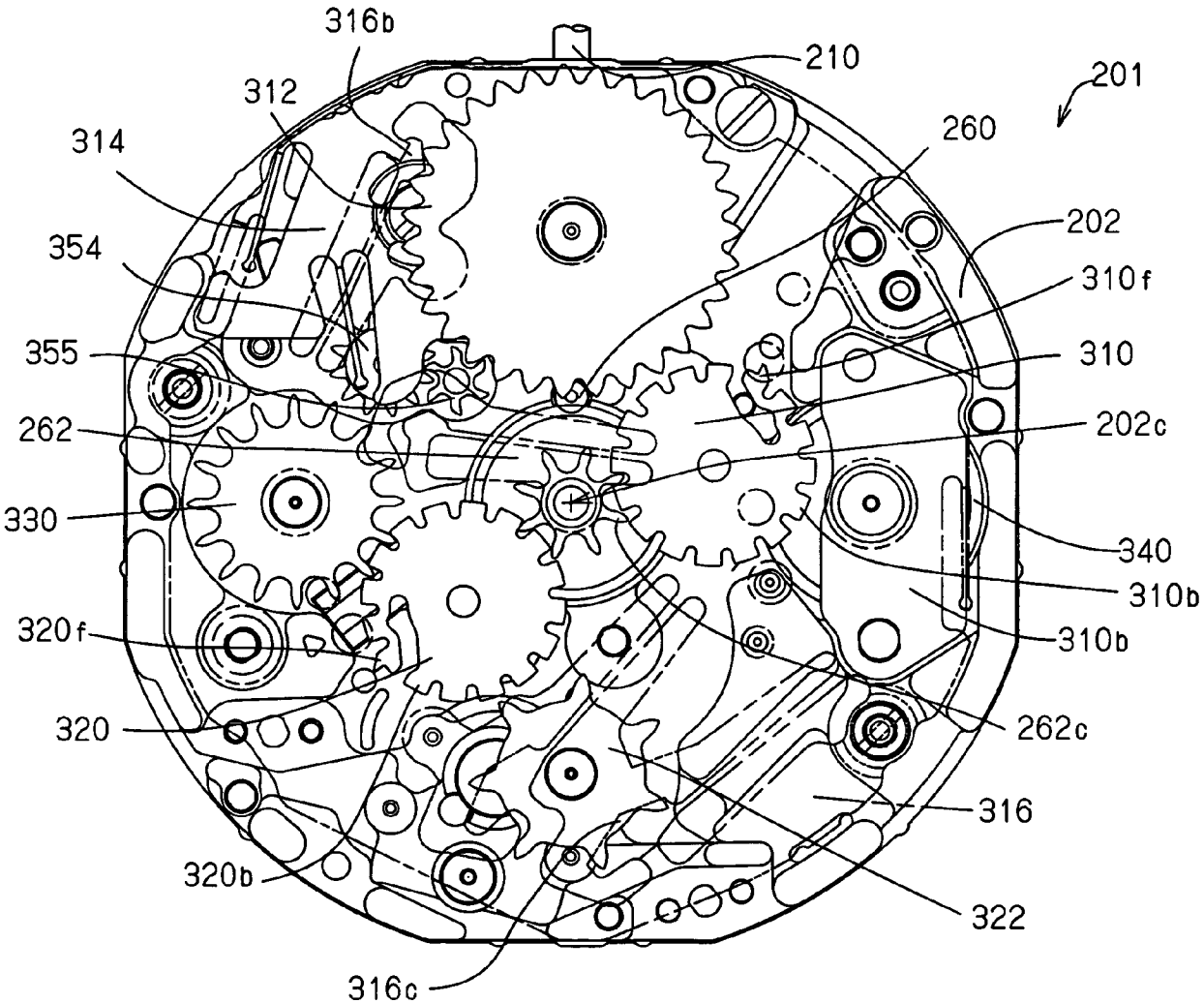
FIG. 1 is a plan view showing a schematic constitution seen from a back side of a movement according to a first embodiment of a multifunctional watch of the present invention.
Figure 2:
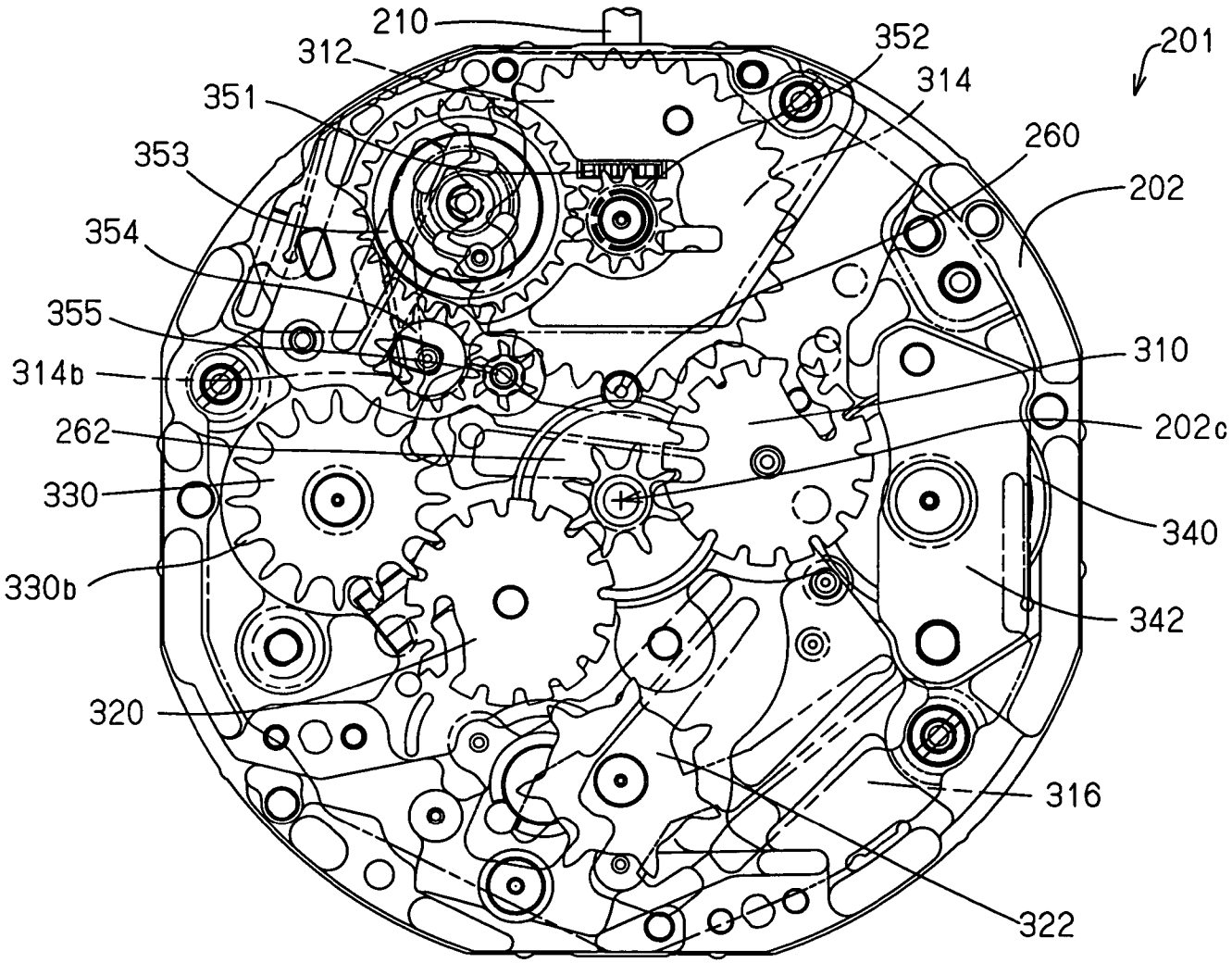
FIG. 2 is a plan view showing a date corrector setting mechanism on the back side of the movement according to the first embodiment of the multifunctional watch of the present invention.

Next, the constitution of a 24 hour display mechanism will be described. With reference to FIG. 1, the 24 hour display mechanism is constituted so as to be operated on the basis of the rotation of the day indicator driving wheel 320. The 24 hour display mechanism includes an hour wheel 330. The hour wheel 330 is constituted so as to be rotated due to the rotation of the hour wheel 262 via the rotation of the day indicator driving wheel 320. The lower shaft portion disposed in the hour wheel 330 is rotatably supported for the hour wheel guide hole disposed in the main plate 202. It is preferable that the rotational center of the hour wheel 330 is aligned in "the twelve o'clock direction". The day tooth 320*b* which is disposed in the day indicator driving wheel 320 is constituted so as to be engaged with a tooth portion 330*b* of the hour wheel 330. The hour wheel 330 is constituted so as to be rotated 360 degrees for 24 hours.

The tooth portion of the hour wheel 330 is aligned between the main plate 202 and the setting wheel plate 316. A 24 hour hand (not illustrated; to be described later) is attached to the upper shaft portion of the hour wheel 330. The character, the numeral, and the abbreviation or the like for displaying "hour" in a system such that one cycle takes 24 hours (referred to as "24-hours") are disposed on the dial 204. The 24 hour display mechanism is constituted so that the information related to "hour" which is the time information can be displayed by the 24 hour hand and the numeral or the like.

(1.9) Constitution of Second Display Mechanism

Next, the constitution of a second display mechanism will be described. With reference to FIG. 1 and FIG. 4, the second display mechanism is constituted so as to be operated on the basis of the rotation of the fifth wheel and pinion 238. The second display mechanism includes a second wheel 340. The gear portion of the second wheel 340 is constituted so as to be engaged with the fifth lower pinion 238*d*. The second wheel 340 is constituted so as to be rotated due to the rotation of the rotor 236 via the rotation of the fifth wheel and pinion 238. The lower shaft portion of the second wheel 340 is rotatably supported for the main plate 202. The upper shaft portion of the second wheel 340 is rotatably supported for a second wheel bridge 342. It is preferable that the second wheel bridge 342 is aligned so as not overlap the date indicator driving wheel 310. The rotational center of the second wheel 340 is preferably aligned in "the six o'clock direction". The second wheel 340 is constituted so as to be rotated 360 degrees for one minute.

The gear portion of the second wheel 340 is aligned between the main plate 202 and the second wheel bridge 342. The small secondhand (not illustrated; to be described later) is attached to the front end portion of the upper shaft portion of the second wheel 340. The character, the numeral, and the abbreviation or the like for displaying "second" are provide on the dial 204. The dial 204 is constituted so that the information related to "second" which is the time information can be displayed by the small second hand and the numeral or the like. As described above, the first embodiment according to the present invention is provided with the date star 312 having a rotational center aligned in "the three o'clock direction", the small day wheel 322 having a rotational center aligned in "the nine o'clock direction", the second wheel 340 having a rotational center aligned in "the six o'clock direction", and the hour wheel 330 having a rotational center aligned in "the twelve o'clock direction".

(1.10) Constitution of Date Corrector Setting Mechanism

Next, the constitution of a date corrector setting mechanism will be described. With reference to FIG. 1, FIG. 2, and FIGS. 4 to 6, on the back side of the movement 201, the date corrector setting mechanism for correcting the display of the date due to the date star 312 is disposed. The date corrector setting mechanism is formed by the first date corrector setting operating wheel 351, the second date corrector setting operating wheel 352, a third date corrector setting operating wheel 353, a fourth date corrector setting operating wheel 354, and a date corrector setting wheel 355. With the hand setting stem 210 located on the first step, the first date corrector setting operating wheel 351 is rotatably supported for the first date corrector setting operating wheel guide portion of the hand setting stem 210. In other words, the first date corrector setting operating wheel 351 and the hand setting stem 210 are aligned so as to be coaxial each other. The second date corrector setting operating wheel 352 is rotatably supported for the main plate 202. The gear portion of the second date corrector setting operating wheel 352 is aligned between the main plate 202 and the date corrector setting operating wheel cover 314. The rotational center of the second date corrector setting operating wheel 352 is aligned in "the three o'clock direction". As a result, the rotational center of the second date corrector setting operating wheel 352 is aligned on the center axial line of the hand setting stem 210. It is preferable that the rotational center of the second date corrector setting operating wheel 352 is aligned on the same position as the rotational center of the date star 312.

The third date corrector setting operating wheel 353 is rotatably supported for the main plate 202. The gear portion of the third date corrector setting operating wheel 353 is aligned between the main plate 202 and the date corrector setting operating wheel cover 314. It is preferable that the rotational center of the third date corrector setting operating wheel 353 is aligned in "the two o'clock direction" or in the range between "the two o'clock direction" and "the three o'clock direction" (namely, "the two to three o'clock range"). The lower shaft of the fourth date corrector setting operating wheel 354 is moveably and rotatably supported for a fourth date corrector, setting operating wheel guide long hole which is formed on the main plate 202. The gear portion of the fourth date corrector setting operating wheel 354 is aligned between the main plate 202 and the date corrector setting operating wheel cover 314. It is preferable that the fourth date corrector setting operating wheel guide long hole for guiding the lower shaft of the fourth date corrector setting operating wheel 354 is aligned in the range between "the one o'clock direction" and "the two o'clock direction" (namely, "the one to two o'clock range"). A setting spring portion 314*b* for applying a pressure on the fourth date corrector setting operating wheel 354 toward the main plate 202 is disposed in the date corrector setting operating wheel cover 314. The center hole of the second date corrector setting operating wheel 352 is rotatably supported for the second date corrector setting operating wheel guide shaft portion disposed on the main plate 202. On the inside of the second date corrector setting operating wheel guide shaft portion, a date star guide hole for the date star 312 is formed. It is possible to constitute the center axial line of the date star guide hole and the center axial line of the second date corrector setting operating wheel guide shaft portion so as to coincide with each other. The third date corrector setting operating wheel 353 is rotatably supported for the third date corrector setting operating wheel guide shaft portion which is disposed on the main plate 202.

The date corrector setting wheel 355 is rotatably supported for the date corrector setting wheel pin which is disposed on the main plate 202. The gear portion of the date corrector setting wheel 355 is aligned between the main plate 202 and the setting wheel plate 316. The gear portion of the date corrector setting wheel 355 is constituted so as to be engaged with the gear portion of the date star 312. The gear portion of the date star 312 is aligned between the date corrector setting operating wheel cover 314 and the setting wheel plate 316. It is preferable that the rotational center of the date corrector setting wheel 355 is aligned in the range between "the one o'clock direction" and "the second o'clock direction" (namely, "the one to two o'clock range"). The gear portion of the fourth date corrector setting operating wheel 354 is constituted so as to be capable of being engaged with the gear portion of the date corrector setting wheel 355 when the fourth date corrector setting operating wheel 354 is moved in a direction approaching the date corrector setting wheel 355 via the rotations of the first date corrector setting operating wheel 351, the second date corrector setting operating wheel 352, and the third date corrector setting operating wheel 353 by rotating the hand setting stem 210 in one direction. The gear portion of the fourth date corrector setting operating wheel 354 is constituted so as not to be engaged with the gear portion of the date corrector setting wheel 355 when the fourth date corrector setting operating wheel 354 is moved in a direction being separated from the date corrector setting wheel 355 via the rotations of the first date corrector setting operating wheel 351, the second date corrector setting operating wheel 352, and the third date corrector setting operating wheel 353 by rotating the hand setting stem 210 in other direction.

(1.11) Constitution of Main Plate

Figure 7:
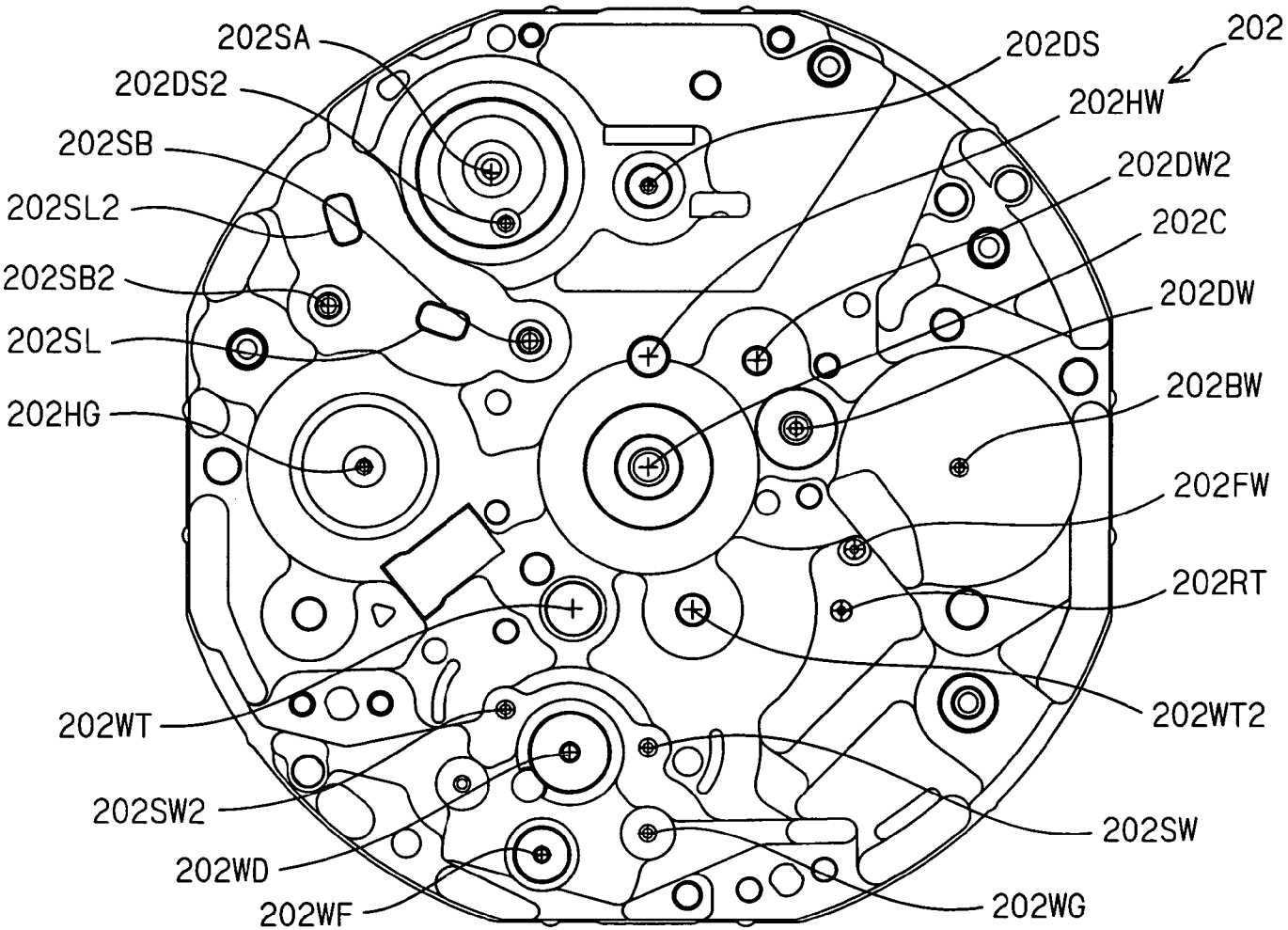
FIG. 7 is a plan view showing a form seen from the back side of a main plate according to the first embodiment of the multifunctional watch of the present invention.

Next, the constitution of the main plate 202 will be described. With reference to FIG. 7, according to the embodiment of the present invention, the outline portion of the main plate 202 is formed in nearly a circle centering around the main plate center 202*c*. Further, the outline portion of the main plate 202 may be other shape such as a quadrangle, a polygonal shape, and an oval or the like. The main plate 202 may be formed by an engineering plastic such as a polycarbonate and polysulfone or it may be made of a metal such as a brass. The rotational center of the second wheel and pinion 244 and the rotational center of the hour wheel 262 are aligned on the main plate center 202*c*. The center axial line of the center pipe 202*b* is aligned on the main plate center 202*c*.

The main plate 202 is provided with rotational centers of rotational members including a rotational center 202 RT of the rotor 236, a rotational center 202 FW of the fifth wheel and pinion 238, a rotational center of the fourth wheel and pinion 240 (not illustrated), a rotational center of the third wheel and pinion 242 (not illustrated), a rotational center 202 HW of the minute wheel 260, a rotational center of the setting wheel 278 (not illustrated), a rotational center 202 DW of the date indicator driving wheel 310, a rotational center 202 DS of the date star 312, a rotational center 202 WT of the day indicator driving wheel 320, a rotational center 202 SW of the small day wheel 322, a rotational center 202 HG of the hour wheel 330, a rotational center 202 BW of the second wheel 340, a rotational center 202 SA of the third date corrector setting operating wheel 353, and a rotational center 202 SB of the date corrector setting wheel 355 or the like. It is preferable that the rotational center of the second date corrector setting operating wheel 352 is aligned on the same position as the rotational center 202 DS of the date star 312. Further, the main plate 202 is provided with a fourth date corrector setting operating wheel guide long hole 202 SL for guiding the lower shaft of the fourth date corrector setting operating wheel 354 so as to be capable of being moved.

On each of the above-described rotational centers, a guide shaft portion for guiding a center hole of the rotational member is formed in order to support the rotational member to be rotated centering around the rotational center so as to be capable of being rotated. Alternatively, a guide hole for guiding the shaft portion of the rotational member is formed. The guide shaft portion and the guide hole constitute the guide portion for guiding the rotational member so as to be capable of being rotated. As to be described later, the main plate 202 is further provided with the rotational center for supporting each rotational member rotatably to be used for other embodiments of the present invention.

As described above, the movement 201 is provided with a first train wheel rotational center for a train wheel to be used when manufacturing a first type of a multifunctional watch having the arrangement of a first type of a small hand. The first train wheel rotational center is aligned on the position between the main plate center 202*c* of the main plate 202 and the main plate outline portion of the main plate 202. On the first train wheel rotational center, a guide hole or a guide bearing is disposed for rotatably guiding the train wheel member to be rotated centering around that position. Further, as to be described later, the movement 201 is provided with a second train wheel rotational center for a train wheel to be used when manufacturing a second type of a multifunctional watch having the arrangement of a second type of a small hand by using the movement 201. The second train wheel rotational center is aligned on the position between the main plate center 202*c* of the main plate 202 and the main plate outline portion of the main plate 202. On the second train wheel rotational center, a train wheel guide portion (a guide hole, a guide bearing, a guide shaft, and a guide pin or the like) is disposed for rotatably guiding the train wheel member to be rotated centering around that position.

(1.12) Constitution of Date Corrector Setting Transmitting Wheel Cover

Figure 8:
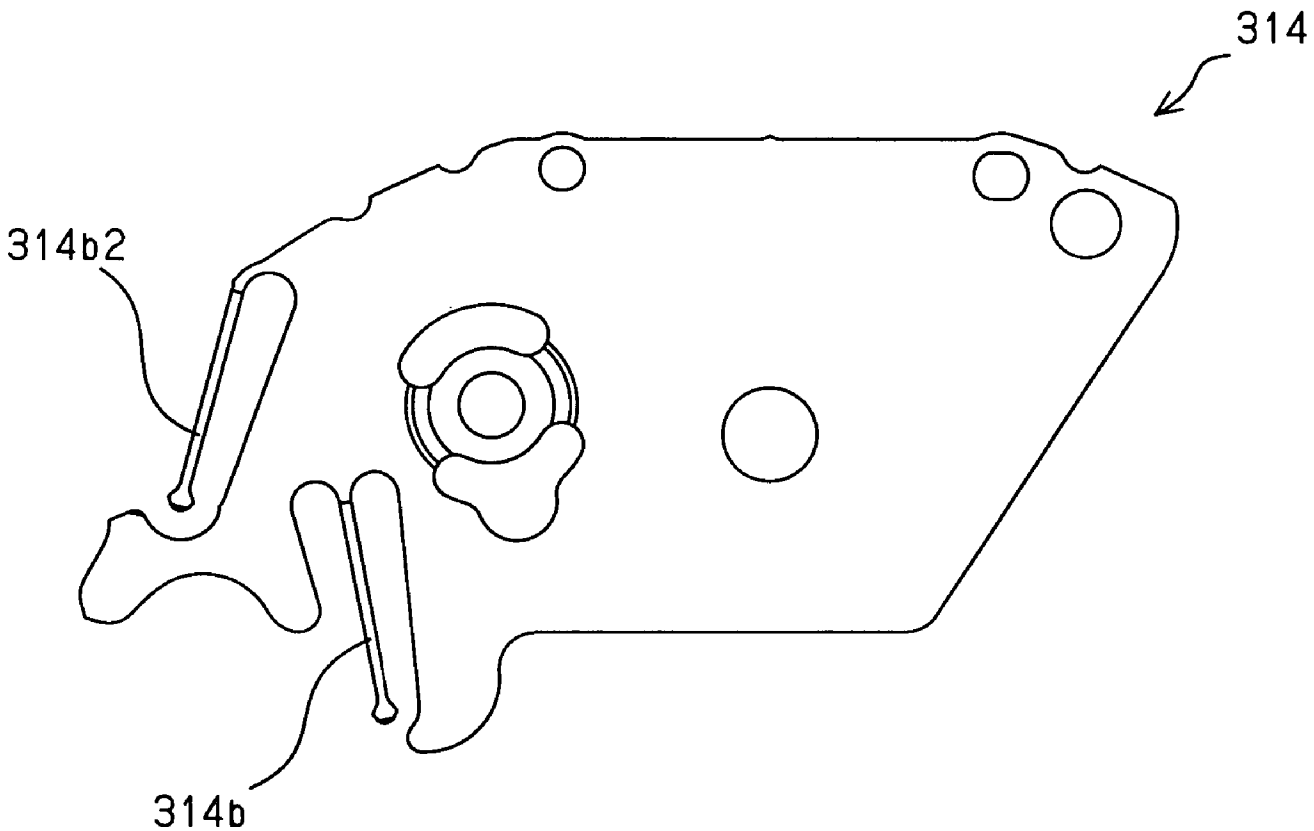
FIG. 8 is a plan view showing a form seen from the upper side of a date corrector setting operating wheel cover according to the first embodiment of the multifunctional watch of the present invention.

Next, the constitution of the date corrector setting operating wheel cover 314 will be described. With reference to FIG. 8, the date corrector setting operating wheel cover 314 is aligned in "the twelve to three o'clock range" and "the three to six o'clock range". The date corrector setting operating wheel cover 314 is a platy member which is formed by an elastic material such as a stainless steel and a phosphor bronze. The setting spring portion 314*b* for applying pressure on the fourth date corrector setting operating wheel 354 toward the main plate 202 is disposed in the date corrector setting operating wheel cover 314. The setting spring portion 314*b* is preferably aligned in the range between "the twelve o'clock direction" and "the three o'clock direction" (namely, "the twelve to three o'clock range"). It is preferable that the front end portion bringing the setting spring portion 314*b* into contact with the fourth date corrector setting operating wheel 354 is aligned in the range between "the twelve o'clock direction" and "the one o'clock direction" (namely, "the twelve to one o'clock range"). Further, it is preferable that a part of the date corrector setting operating wheel cover 314 located on the lower part of the date star 312 is narrowed down to a circle toward the back surface of the main plate 202. It is preferable that a hole provided on the center of this circle narrowed-down portion of the date corrector setting operating wheel cover 314 is formed so as to be fitted in the date corrector setting operating wheel cover guide shaft portion which is disposed around the date star guide hole. The date corrector setting operating wheel cover 314 is further provided with a further setting spring portion 314*b*2 to be used for other embodiment of the present invention.

(1.13) Constitution of Setting Wheel Plate

Figure 9:
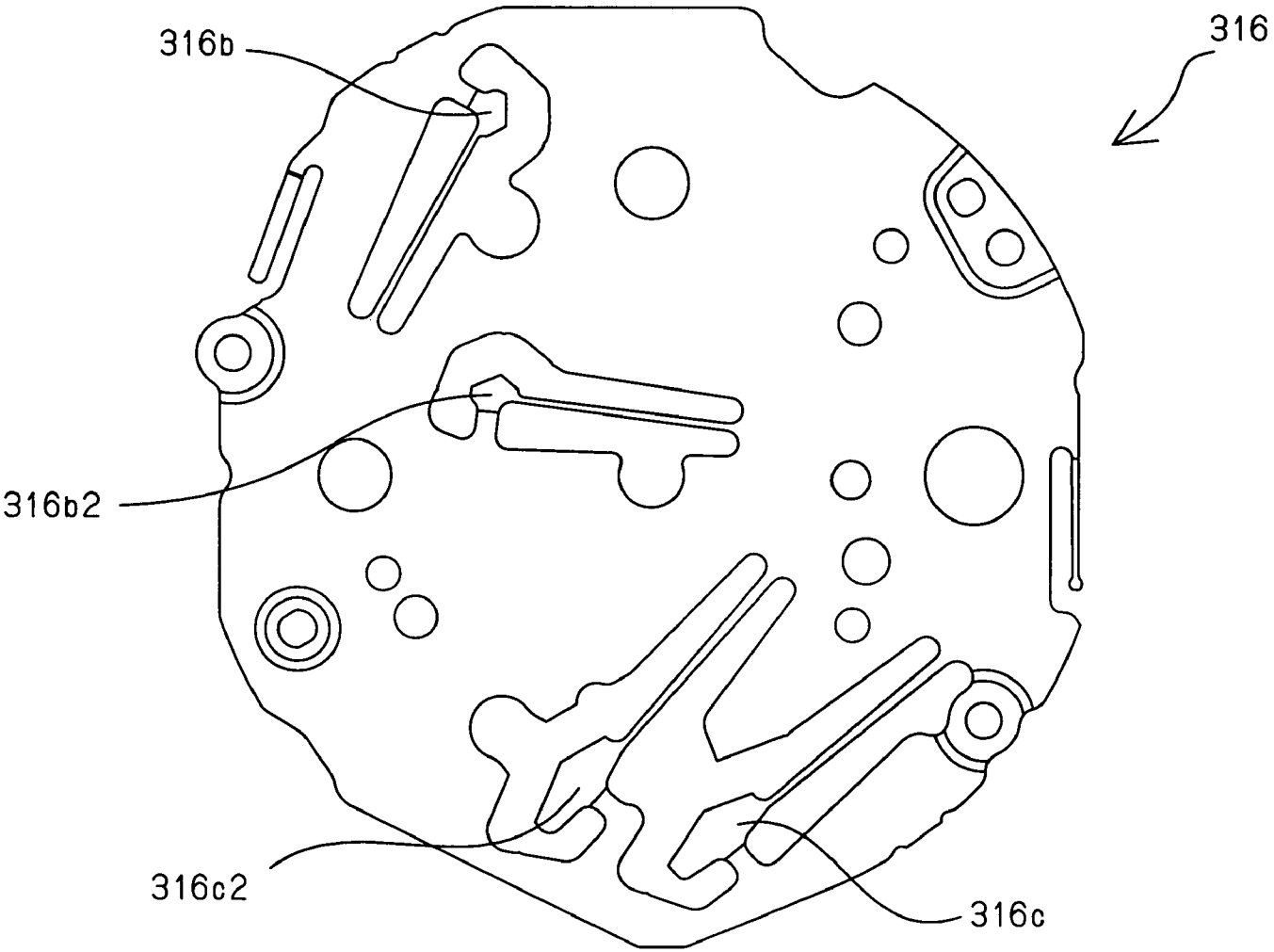
FIG. 9 is a plan view showing a form seen from the upper side of a setting wheel plate according to the first embodiment of the multifunctional watch of the present invention.

Next, the constitution of the setting wheel plate 316 will be described. With reference to FIG. 9, the setting wheel plate 316 is a platy member which is formed by an elastic material such as a stainless steel and a phosphor bronze. The date jumper 316*b* for setting the position of the rotational direction of the date star 312 is disposed in the setting wheel plate 316. It is preferable that the spring portion of the date jumper 316*b* is aligned in the range between "the twelve o'clock direction" and "the three o'clock direction" (namely, "the twelve to three o'clock range"). It is preferable that the setting portion disposed on the front end of the spring portion of the date jumper 316*b* is aligned in the range between "the two o'clock direction" and "the three o'clock direction" (namely, "the two to three o'clock range"). The day jumper 316*c* for setting the position in the rotational direction of the small day wheel 322 is disposed in the setting wheel plate 316. It is preferable that the spring portion of the day jumper 316*c* is aligned in the range between "the six o'clock direction" and "the nine o'clock direction" (namely, "the six to nine o'clock range"). It is preferable that the setting portion disposed on the front end of the spring portion of the day jumper 316*c* is aligned in the range between "the eight o'clock direction" and "the nine o'clock direction" (namely, "the eight to nine o'clock range"). The setting wheel plate 316 is provided with a further date jumper, 316*b*2 and a further day jumper 316*c*2 to be used for other embodiment of the present invention.

(1.14) Operations of Step Motor, Tran Wheel, Unlocking Mechanism or the Like

Figure 5:
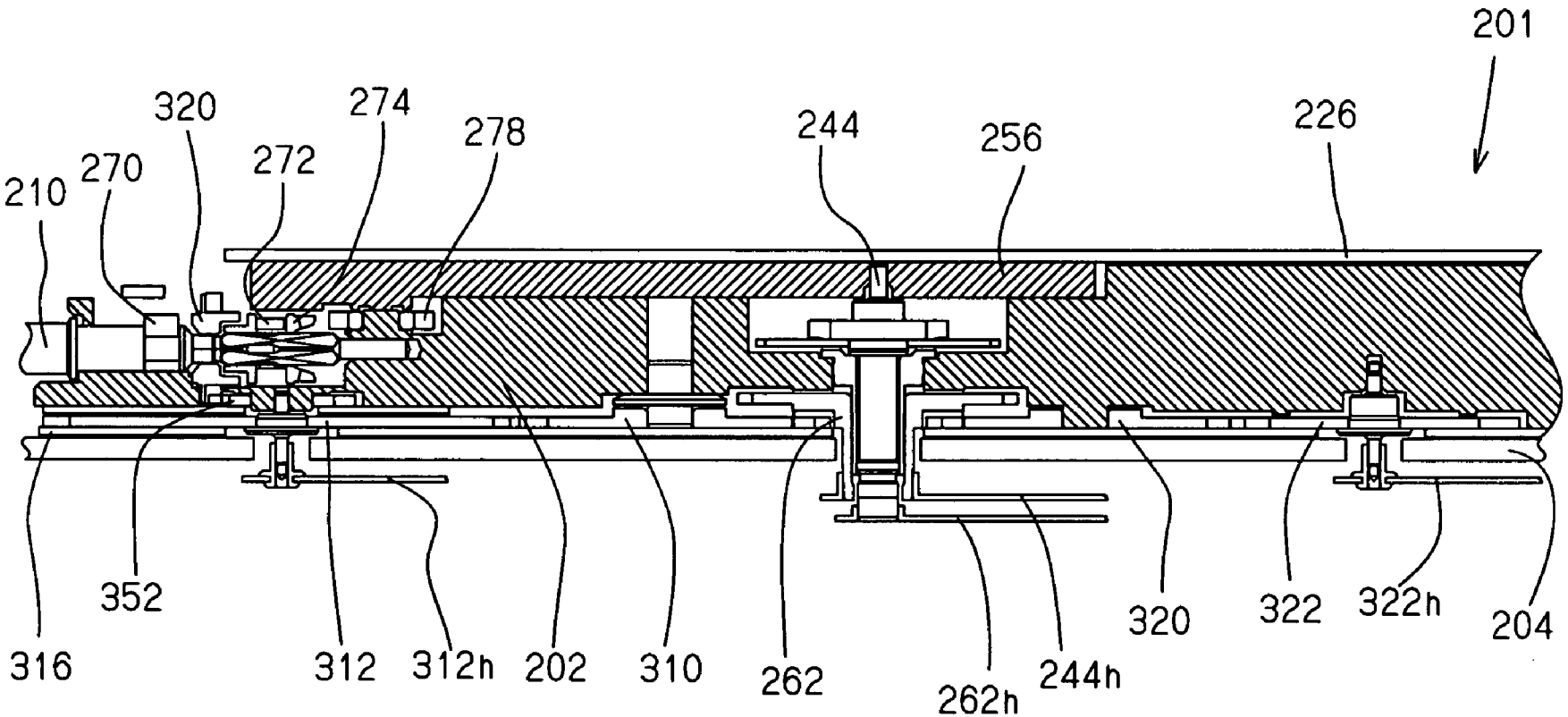
FIG. 5 is a partial cross sectional view showing a part of the hand setting stem and a back train wheel according to the first embodiment of the multifunctional watch of the present invention.

The operation of the first embodiment of the multifunctional watch according to the present invention will be described below. With reference to FIG. 1, FIG. 4, and FIG. 5, in the movement 201, for example, the crystal oscillator contained in the crystal unit 222 is oscillated at 32,768 Hz. On the basis of the oscillation of this crystal oscillator, the oscillator incorporated in the integrated circuit 230 outputs a reference signal, and the divider divides the output signal of the oscillator. The driver outputs a motor drive signal for driving the step motor on the basis of the output signal of the divider. When the coil block 232 inputs the motor drive signal therein, the stator 234 is magnetized to rotate the rotor 236. For example, the rotor 236 is rotated 180 degrees per second. On the basis of the rotation of the rotor 236, the second wheel 340 is rotated 360 degrees for one minute via the rotation of the fifth wheel and pinion 238. The third wheel and pinion 242 is rotated on the basis of the rotation of the fourth wheel and pinion 240.

With reference to FIG. 1 to FIG. 6, the second wheel and pinion 244 is rotated 360 degrees for an hour on the basis of the rotation of the third wheel and pinion 242. The hour wheel 262 is rotated on the basis of the rotation of the minute wheel 260. The hour wheel 262 is rotated 360 degrees for twelve hours. Due to the rotation of the hour wheel 262, the date indicator driving wheel 310 is rotated. Due to the date finger 310*f* disposed on the date indicator driving wheel 310, the date star 312 is rotated once for a day (1/31). The date star 312 is constituted so as to be rotated 360 degrees for 31 days. Due to the rotation of the hour wheel 262, the day indicator driving wheel 320 is rotated. Due to the day finger 320*f* which is disposed in the day indicator driving wheel 320, the small day wheel 322 is rotated once for a day (1/7). Accordingly, the small day wheel 322 is rotated 360 degrees for seven days. In addition, due to the rotation of the day indicator driving wheel

320, the hour wheel 330 is rotated. The hour wheel 330 is rotated 360 degrees for 24 hours.

(1.15) Operation of Date Correcting Mechanism

The operation of a date correcting mechanism will be described below.

With reference to FIG. 1, FIG. 2, and FIG. 4 to FIG. 6, when the hand setting stem 210 is rotated in one direction with the hand setting stem 210 pulled out from the 0th step to the first step, the fourth date corrector setting operating wheel 354 is moved in a direction approaching the date corrector setting wheel 355 via the rotations of the first date corrector setting operating wheel 351, the second date corrector setting operating wheel 352, and the third date corrector setting operating wheel 353, and then, the gear portion of the fourth date corrector setting operating wheel 354 can be engaged with the gear portion of the date corrector setting wheel 355. As a result, with the hand setting stem 210 pulled out to the first step, by rotating the hand setting stem 210 in one direction and rotating the date star 312, the date can be corrected.

By rotating the hand setting stem 210 in other direction with the hand setting stem 210 pulled out to the first step, the fourth date corrector setting operating wheel 354 is moved in a direction being separated from the date corrector setting wheel 355 via the rotations of the first date corrector setting operating wheel 351, the second date corrector setting operating wheel 352, and the third date corrector setting operating wheel 353. In this state, the gear portion of the fourth date corrector setting operating wheel 354 is not engaged with the gear portion of the date corrector setting wheel 355. As a result, even if the hand setting stem 210 is rotated in other direction with the hand setting stem 210 pulled out to the first step, the date star 312 cannot be rotated and date correction cannot be carried out.

(1.16) Operation of Hand Adjustment

The operation of a hand adjustment will be described below. With reference to FIG. 4, with the hand setting stem 210 pulled out to the second step, the ko-tooth 274*a* of the clutch wheel 274 is engaged with the setting wheel 278. If the hand setting stem 210 is pulled out to the second step, the spring portion of the setting lever 250 is rotated to be brought into contact with the reset lever 252. Thereby, the spring portion of the setting lever 250 is conducted to a reset pattern of the circuit board 224 via the reset lever 252 to reset the operation of the integrated circuit 230 and at the same time, the setting lever 250 sets the fourth wheel and pinion 240. By rotating the hand setting stem 210 with the hand setting stem 210 pulled out to the second step, the setting wheel 278 is rotated via the rotation of the clutch wheel 274. Due to the rotation of the setting wheel 278, the second pinion of the second wheel and pinion 244 and the hour wheel 262 are rotated via the rotation of the minute wheel 260. When the hand adjustment is carried out with the hand setting stem 210 pulled out to the second step, the second pinion of the second wheel and pinion 244 can be slipped for the second gear of the second wheel and pinion 244. By rotating the second pinion due to the rotation of the hand setting stem 210, the minute hand 244*h* is rotated and due to the rotation of the hour wheel 262, the hour hand 262*h* is rotated, so that time display (display of "hour" and "minute") can be corrected.

(1.17) Description of Position of Hand and Specification of Hand

Figure 11:
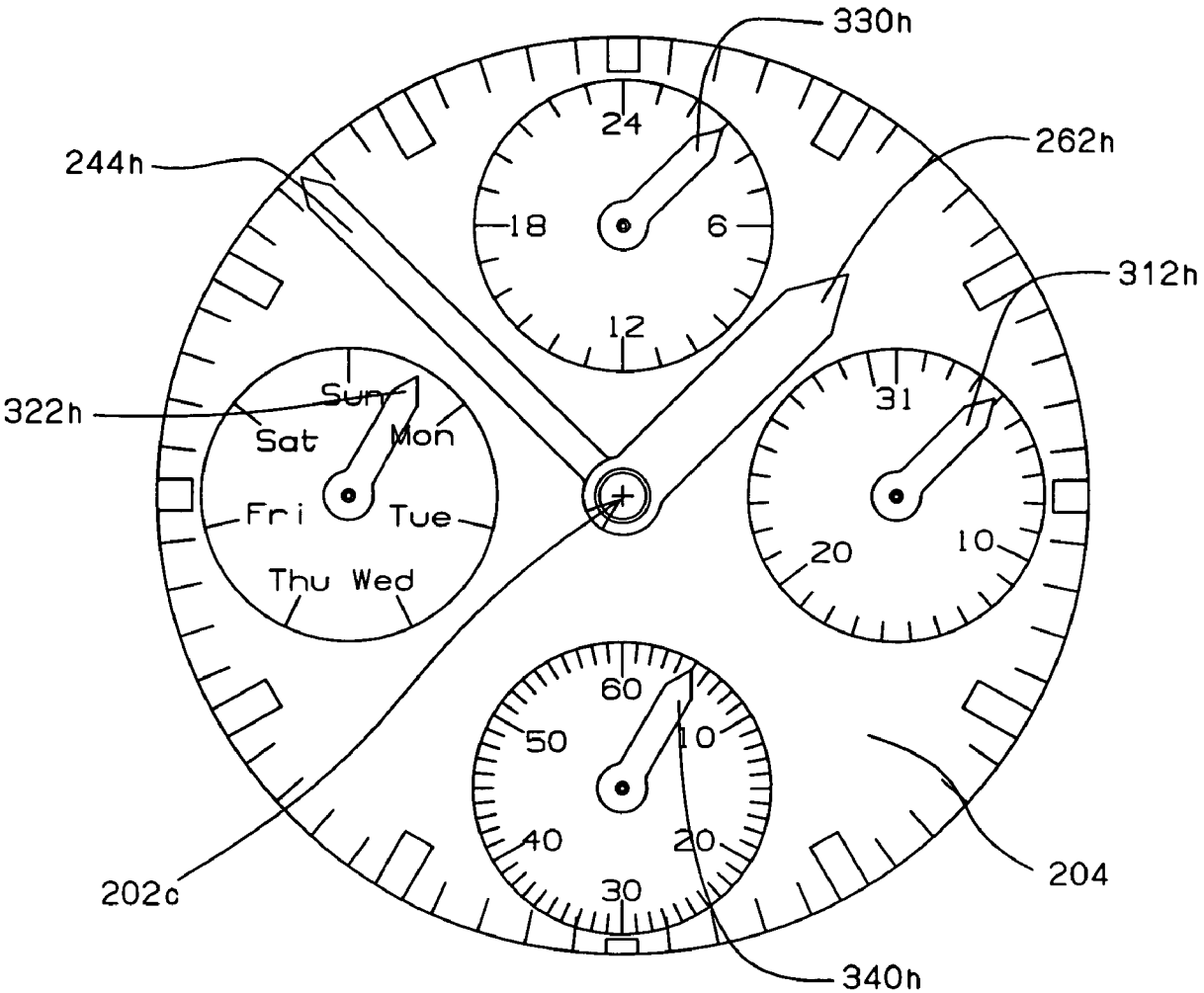
FIG. 11 is a plan view showing a dial of a complete provided with four small hands and a part of a hand according to the first embodiment of the multifunctional watch of the present invention.

With reference to FIG. 10, according to the embodiment of the present invention, as an example, it is possible to realize eight kinds of positions of a hand and specifications of a hand (first to eighth kinds). Further, the present invention is not limited to eight kinds of the positions of the hand and the specifications of the hand shown in FIG. 10. With reference to FIG. 10 and FIG. 11, according to the first kind of the embodiment of the present invention, it is possible to display the time information related to "hour" of 12-hours by the hour hand 262*h* attached to the hour wheel 262, of which rotational center is the main plate center 202*c*, display the time information related to "minute" by the minute hand 244*h* attached to the second wheel and pinion 244, of which rotational center is the main plate center 202*c*, display the time information related to "second" by a small second hand 340*h* attached to the second wheel 340, of which rotational center is aligned in "the six o'clock direction", display the time information related to "hour" of 24-hours by a 24 hour hand 330*h* attached to the hour wheel 330, of which rotational center is aligned in "the twelve o'clock direction", display the calendar information related to "date" by the date hand 312*h* attached to the date star 312, of which rotational center is aligned in "the three o'clock direction", and display the calendar information related to "day" by the day finger 322*h* attached to the small day wheel 322, of which rotational center is aligned in "the nine o'clock direction". It is preferable that a distance from the main plate center 202*c* to the rotational center of the date hand 312*h*, a distance from the main plate center 202*c* to the rotational center of the small secondhand 340*h*, a distance from the main plate center 202*c* to the day finger 322*h*, and a distance from the main plate center 202*c* to the 24 hour hand 330*h* are constituted so as to be equal each other. However, the above-described inter-center distances may be also constituted so as not to be equal each other.

The character, the numeral, and the abbreviation or the like for displaying each time information and each calendar information are provided on the dial 204. For example, in order to display the time information related to "hour" of 24-hours, the numerals such as "6", "12", "18", and "24" are provided on a position corresponding to the 24 hour hand 330*h* of the dial 204 along a circumference. For example, in order to display the time information related to "date", the numerals such as "10", "20", and "31" are provided on a position corresponding to the date hand 312*h* of the dial 204 along the circumference. For example, in order to display the time information related to "second", the numerals such as "10", "20", "30", "40", "50", and "60" are provided on a position corresponding to the small second hand 340*h* of the dial 204 along the circumference. For example, in order to display the time information related to "day", English letters such as "Sun", "Mon", "Tue", "Wed", "Thu", "Fri", and "Sat" are provided on the position corresponding to the day finger 322*h* of the dial 204 along the circumference. Alternatively, in order to display the calendar information related to "day", the numeral, Japanese letters, foreign language letters, Roman numerals, and marks or the like may be used.

Figure 12:
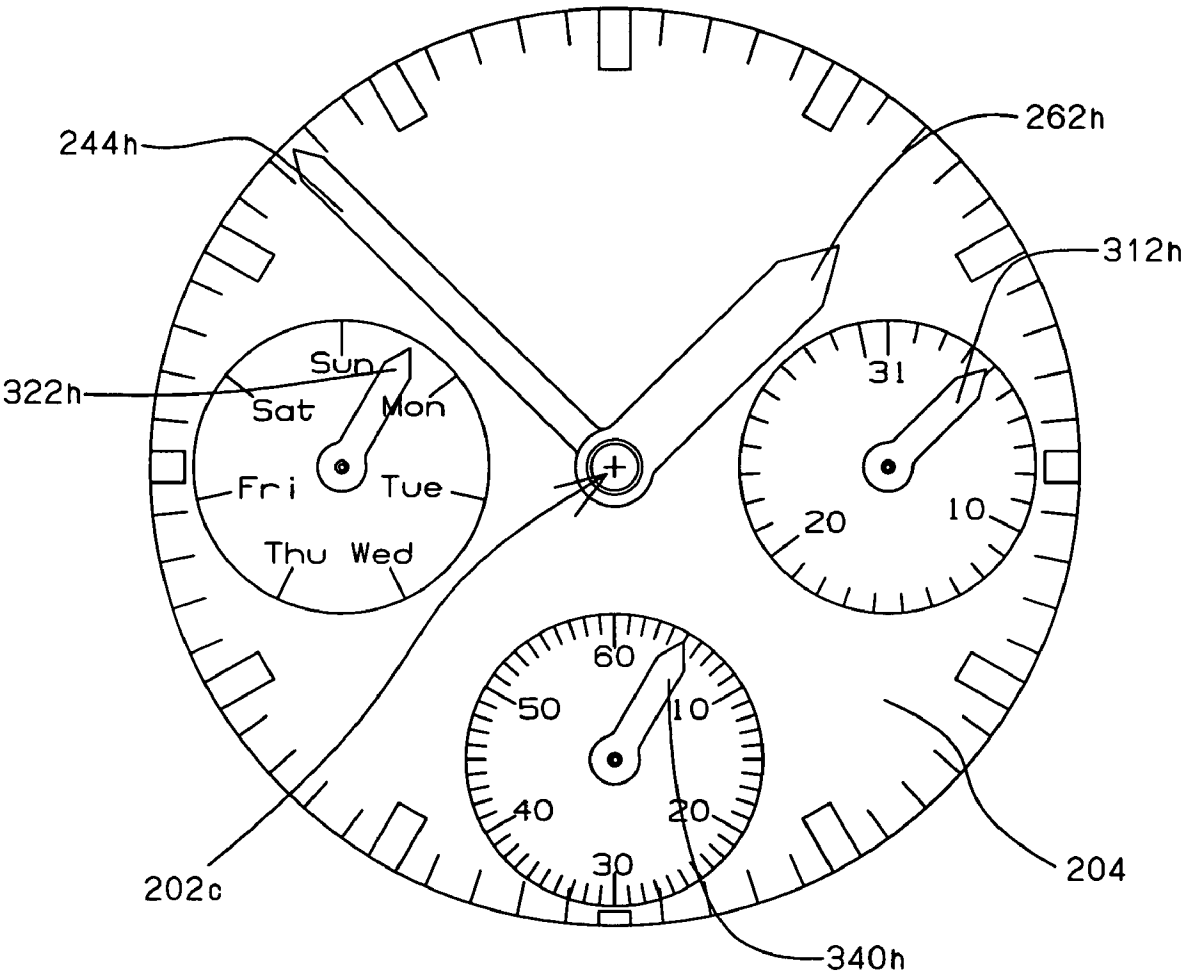
FIG. 12 is a plan view showing a part of a dial of a complete provided with three small bands and a hand according to the first embodiment of the multifunctional watch of the present invention.

With reference to FIG. 10 and FIG. 12, according to the second kind of the present invention, omitting the hour wheel, 330 and the 24 hour hand 330*h*, it is possible to display the time information related to "hour" of 12-hours by means of the hour hand 262*h*, display the time information related to "minute" by means of the minute hand 244*h*, display the time information related to "second" by means of the small second hand 340*h* attached to the second wheel 340, of which rotational center is aligned in "the six o'clock direction", display the calendar information related to "date" by means of the date hand 312*h* attached to the date star 312, of which rotational center is aligned in "the three o'clock direction", and display the calendar information related to "day" by means of the day finger 322*h* attached to the small day wheel 322, of which rotational center is aligned in "the nine o'clock direction".

Figure 13:
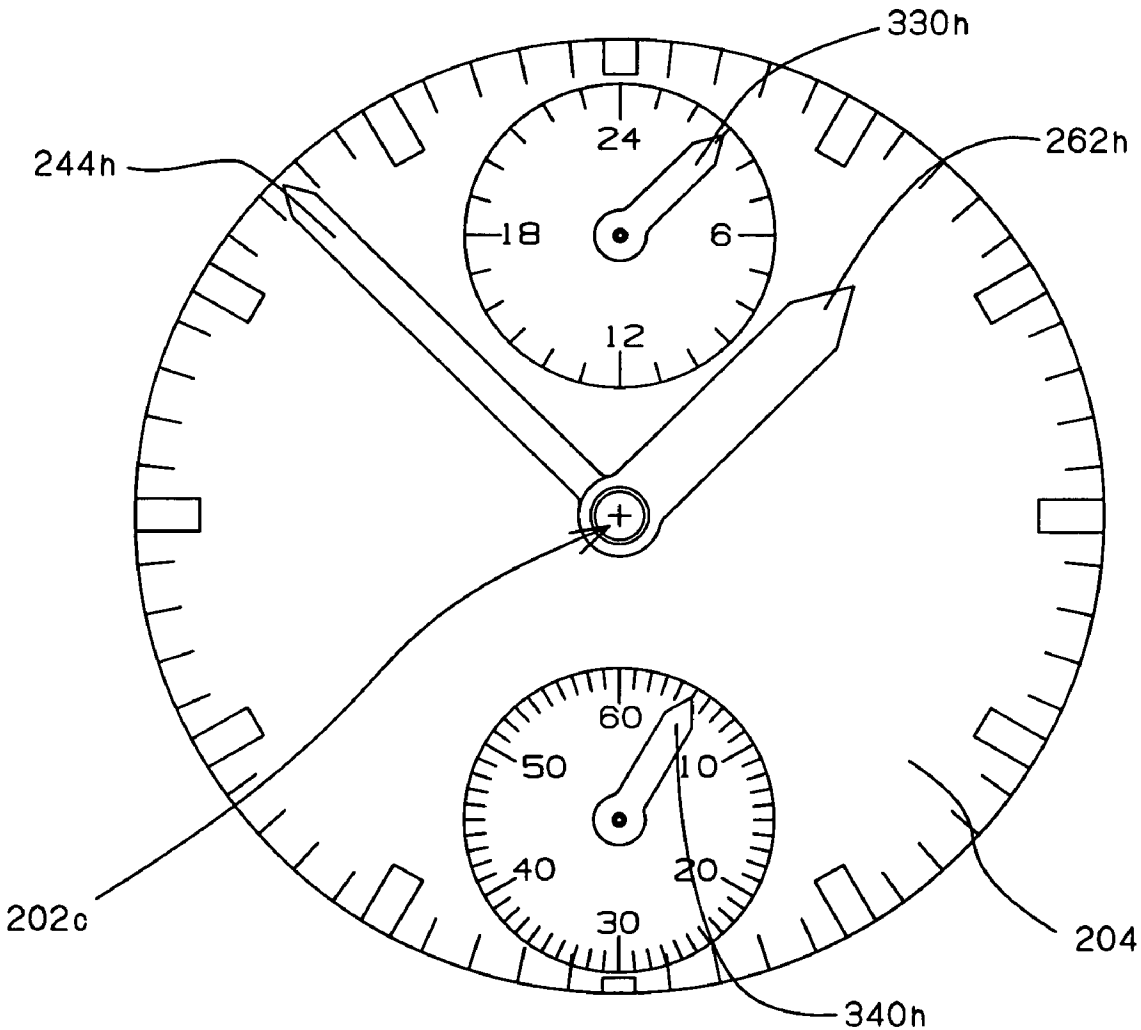
FIG. 13 is a plan view showing a part of a dial of a complete provided with small hands in a twelve o'clock direction and a six o'clock direction and a hand according to the first embodiment of the multifunctional watch of the present invention.

With reference to FIG. 10 and FIG. 13, according to the third kind of the present invention, omitting the date star 312, the date hand 312*h*, the small day wheel 322, and the day finger 322*h*, it is possible to display the time information related to "hour" of 12-hours by means of the hour hand 262*h*, display the time information related to "minute" by means of the minute hand 244*h*, display the time information related to "second" by means of the small second hand 340*h* attached to the second wheel 340, of which rotational center is aligned in "the six o'clock direction", and display the time information related to "hour" of 24-hours by means of the 24 hour hand 330*h* attached to the hour wheel 330, of which rotational center is aligned in "the twelve o'clock direction".

Figure 14:
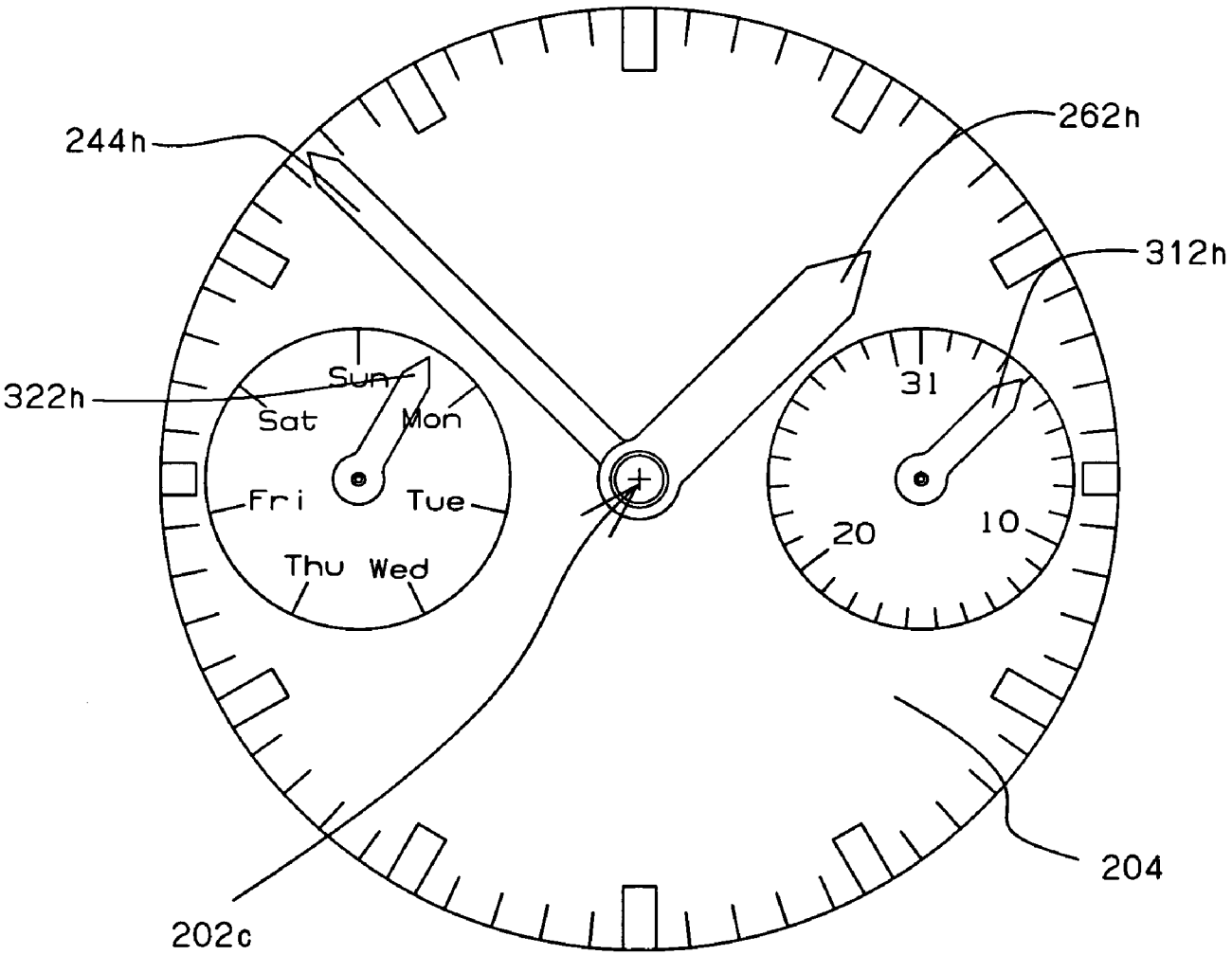
FIG. 14 is a plan view showing a part of a dial of a complete provided with small hands in a three o'clock direction and a nine o'clock direction and a hand according to the first embodiment of the multifunctional watch of the present invention.

With reference to FIG. 10 and FIG. 14, according to the fourth kind of the present invention, omitting the second wheel 340, the small second hand 340*h*, the hour wheel 330, and the 24 hour hand 330*h*, it is possible to display the time information related to "hour" of 12-hours by means of the hour hand 262*h*, display the time information related to "minute" by means of the minute hand 244*h*, display the calendar information related to "date" by means of the date hand 312*h* attached to the date star 312, of which rotational center is aligned in "the three o'clock direction", and display the calendar information related to "day" by means of the day finger 322*h* attached to the small day wheel 322, of which rotational center is aligned in "the nine o'clock direction".

Figure 15:
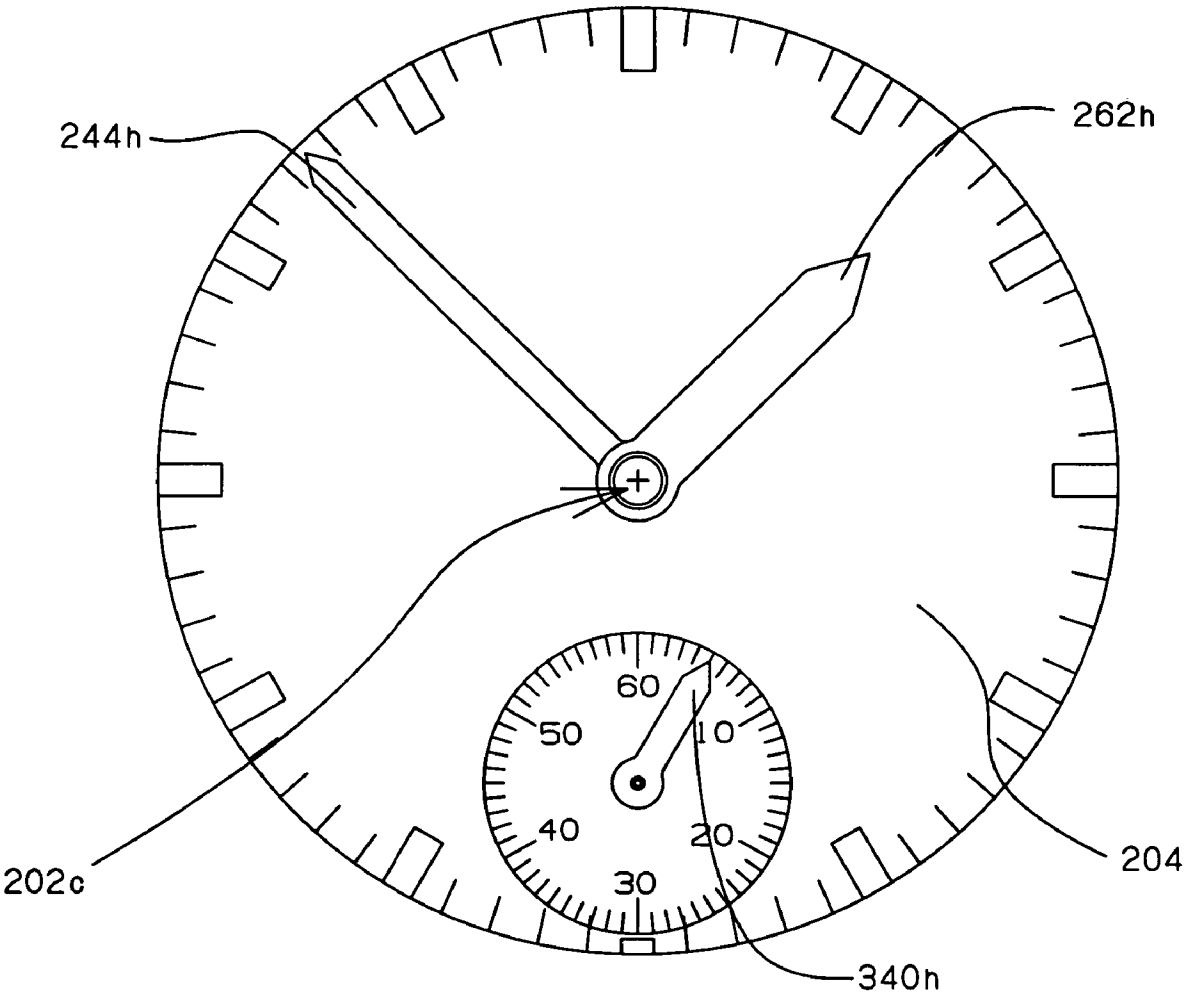
FIG. 15 is a plan view showing a part of a dial of a complete provided with one small hand and a hand according to the first embodiment of the multifunctional watch of the present invention.

With reference to FIG. 10 and FIG. 15, according to the fifth kind of the present invention, omitting the hour wheel 330, the 24 hour hand 330*h*, the date star 312, the date hand 312*h*, the small day wheel 322, and the day finger 322*h*, it is possible to display the time information related to "hour" of 12-hours by means of the hour hand 262*h*, display the time information related to "minute" by means of the minute hand 244*h*, and display the time information related to "second" by means of the small secondhand 340*h* attached to the second wheel 340, of which rotational center is aligned in "the six o'clock direction". Further, the sixth to eighth kinds of the embodiments of the present invention illustrated in FIG. 10 are to be described later.

(1.18) Constitution of Mechanical Clock

Figure 16:
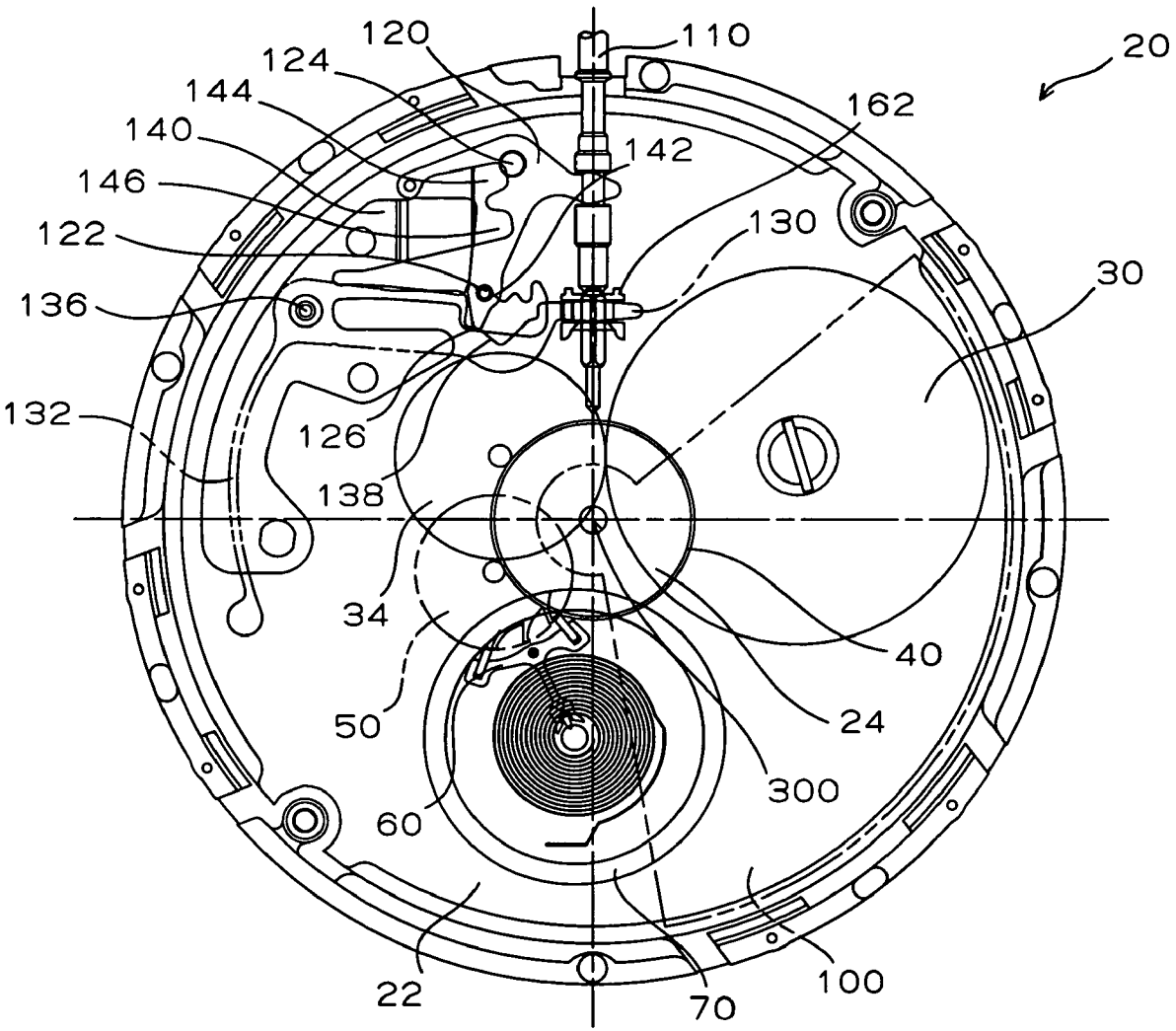
FIG. 16 is a plan view showing a schematic constitution seen from the front side of the movement where an automatic device and a bridge member or the like are omitted in order to clearly show the constitution according to a modified example of the first embodiment of the multifunctional watch of the present invention.
Figure 17:
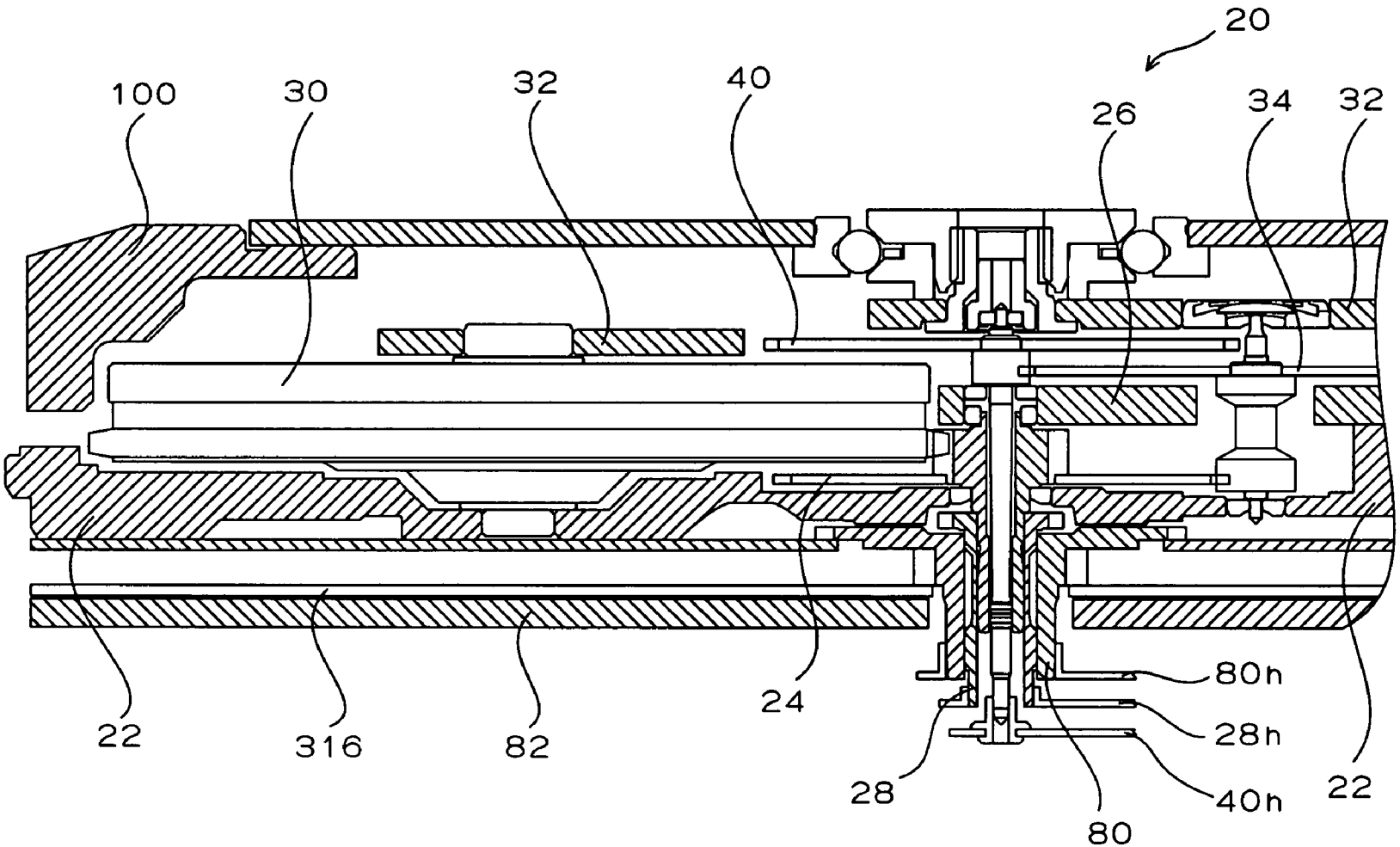
FIG. 17 is a cross sectional view showing a schematic constitution of a part of a barrel drum and a front train wheel according to the modified example of the first embodiment of the multifunctional watch of the present invention.
Figure 18:
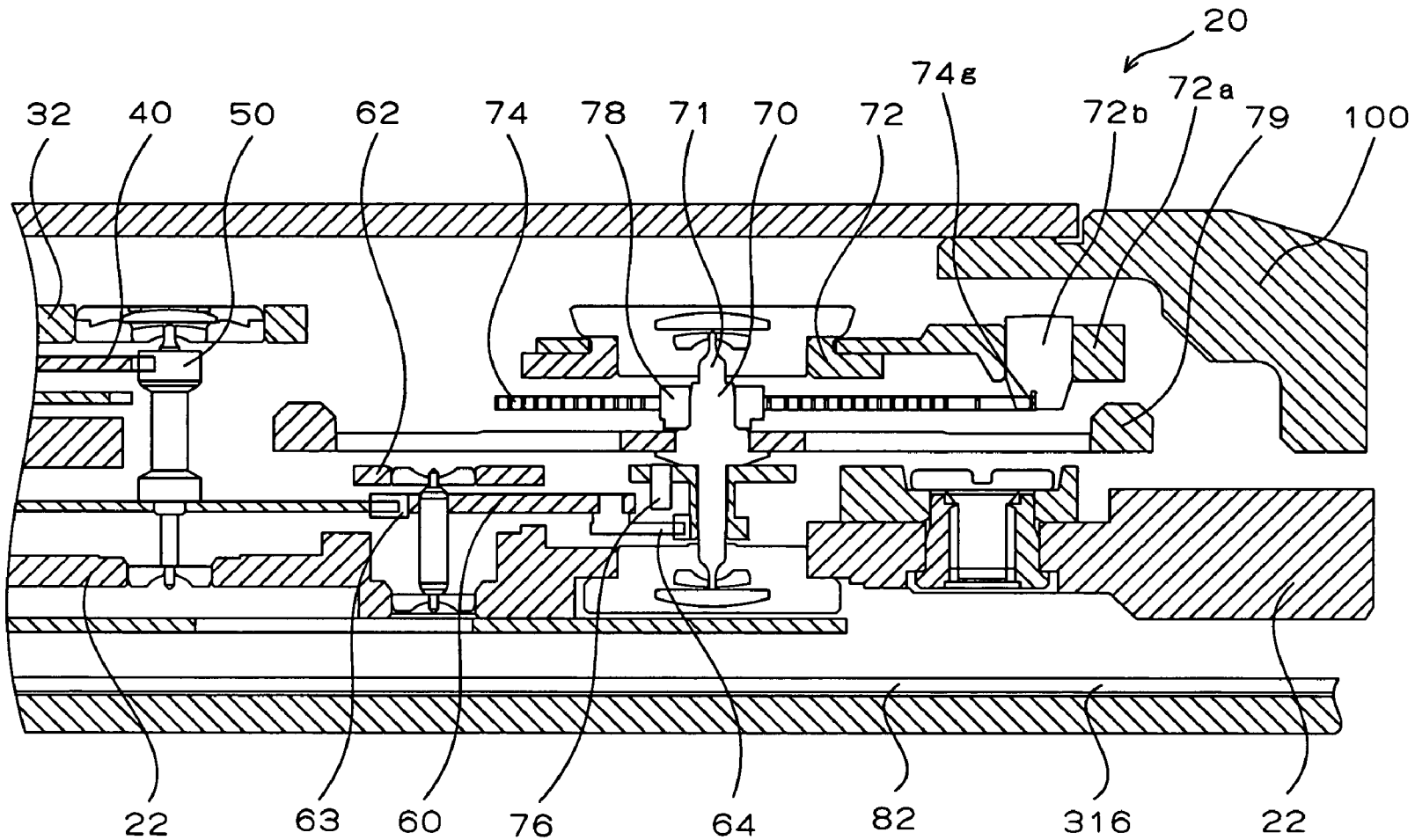
FIG. 18 is a cross sectional view showing a schematic constitution of a part of a balance with hairspring, a pallet fork, and a balance with hairspring according to the modified example of the first embodiment of the multifunctional watch of the present invention.
Figure 19:
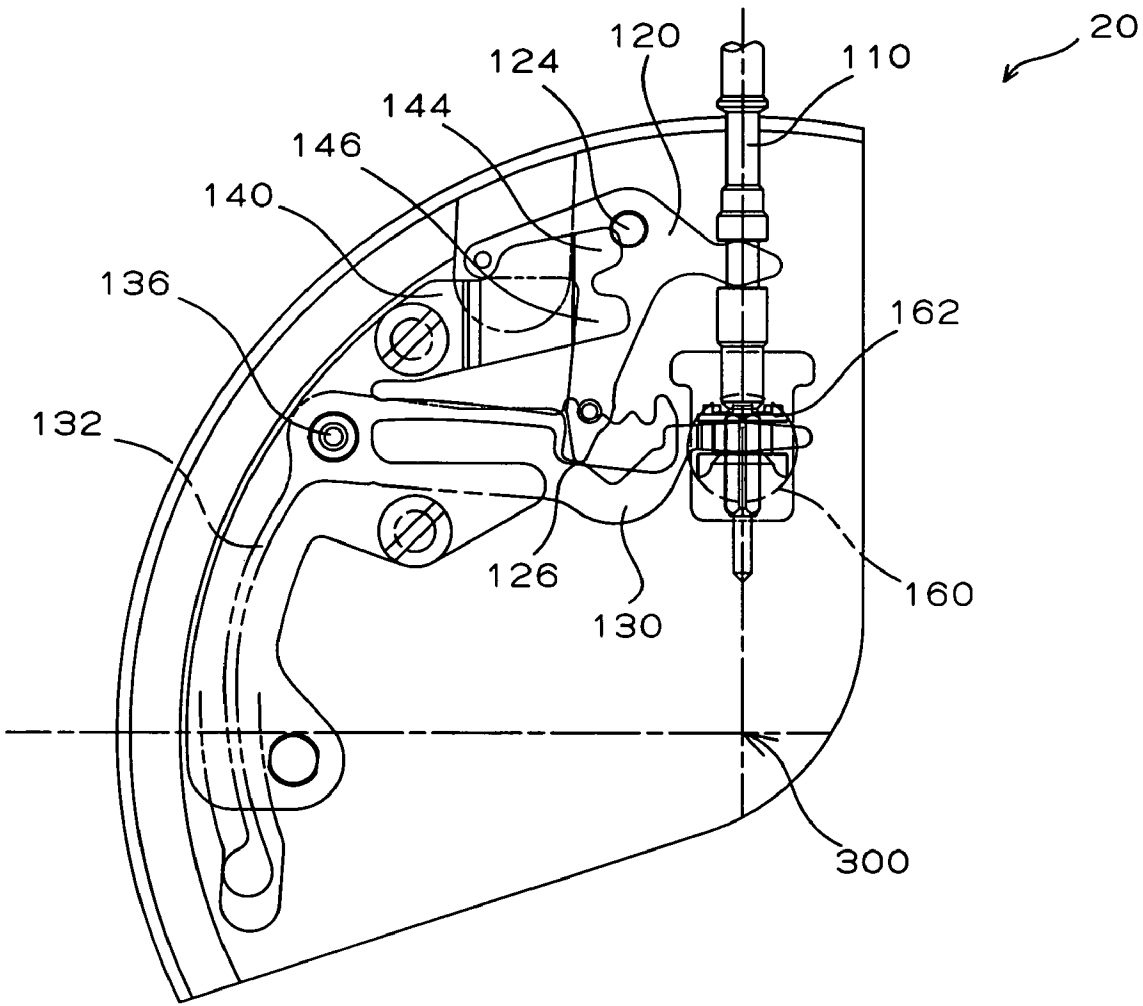
FIG. 19 is a plan view showing a schematic constitution of a part of a setting lever and a yoke according to the modified example of the first embodiment of the multifunctional watch of the present invention.

The movement of the analog electronic watch according to the embodiment of the multifunctional watch of the present invention is as described above, however, according to the present invention in any embodiment, the movement can be also formed by a mechanical watch. With reference to FIGS. 16 to 18 as a modified example, according to the embodiment of the mechanical watch of the multifunctional watch of the present invention, the movement 20 is provided with the main plate 22 to form the substrate of the movement 20. According to the embodiment of the present invention, a front train wheel such as a movement barrel, the second wheel and pinion, the third wheel and pinion, and the fourth wheel and pinion; an automatic device mechanism such as a oscillating weight and a pawl lever; and a switching mechanism such as a setting lever and a yoke are incorporated in the front side of the movement 20, respectively. According to the embodiment of the mechanical watch, the constitution of the back side of the movement can be made as same as the constitution on the back side of the movement of the analog electronic watch shown in FIG. 1 and FIG. 2.

The constitution of the train wheel will be described below. The main plate 22 of the second wheel and pinion 24 is rotatably incorporated in nearly a center of the main plate 22. The second wheel and pinion 24 is incorporated between the main plate 22 and a second bridge 26. A canon pinion 28 is incorporated in the side of the dial of the main plate 22 so as to be capable of being slipped on the outer circumferential portion adjacent to the front end near a hand attaching portion of the second wheel and pinion 24. The canon pinion 28 is rotated integrally with the second wheel and pinion 24. A movement barrel 30 is rotatably incorporated between the main plate 22 and the first bridge 32. A barrel gear of the movement barrel 30 is engaged with the second pinion of the second wheel and pinion 24. A third wheel and pinion 34 is rotatably incorporated between the main plate 22 and the first bridge 32. A second gear of the second wheel and pinion 24 is constituted so as to be engaged with a third pinion. The fourth wheel and pinion 40 is rotatably incorporated between the second bridge 26 and the first bridge 32. A third gear of a third wheel and pinion 34 is constituted so as to be engaged with a forth pinion 40. An escape wheel and pinion 50 is rotatably incorporated between the main plate 22 and the first bridge 32. A fourth gear of a fourth wheel and pinion 40 is constituted so as to be engaged with an escape pinion of the escape wheel and pinion 50. Here, the number of the train wheel is not limited only to the above-described train wheels and one or more operating wheels may be added.

Next, the constitution of an escapement and governor will be described. With reference to FIG. 16 to FIG. 18, a pallet fork 60 is incorporated between the main plate 22 and a pallet bridge 62 so as to swing. The pallet fork 60 has two pallets 63 and guard pins 64. An escape wheel of an escape wheel and pinion 50 is engaged with the pallet 63. A balance with hairspring 70 is incorporated rotatably between the main plate 22 and a balance bridge 72. With reference to FIG. 18, the balance with hairspring 70 includes a balance staff 71, a hairspring 74, an impulse weight 76, a collet 78, and a balance wheel 79. The guard pin 64 of the pallet fork 60 is constituted so as to be engaged with the impulse weight 76. The center portion of the balance wheel 79 is fixed to the balance staff 71. The inner end portion of the hairspring 74 is fixed to the collet 78 which is fixed to the balance staff 71. An outer circumferential portion 74*g* of the hairspring 74 is attached to a stud 72*b*. The stud 72*b* is attached to a stud support 72*a*. The stud support 72*a* is attached to the balance bridge 72.

Figure 20:
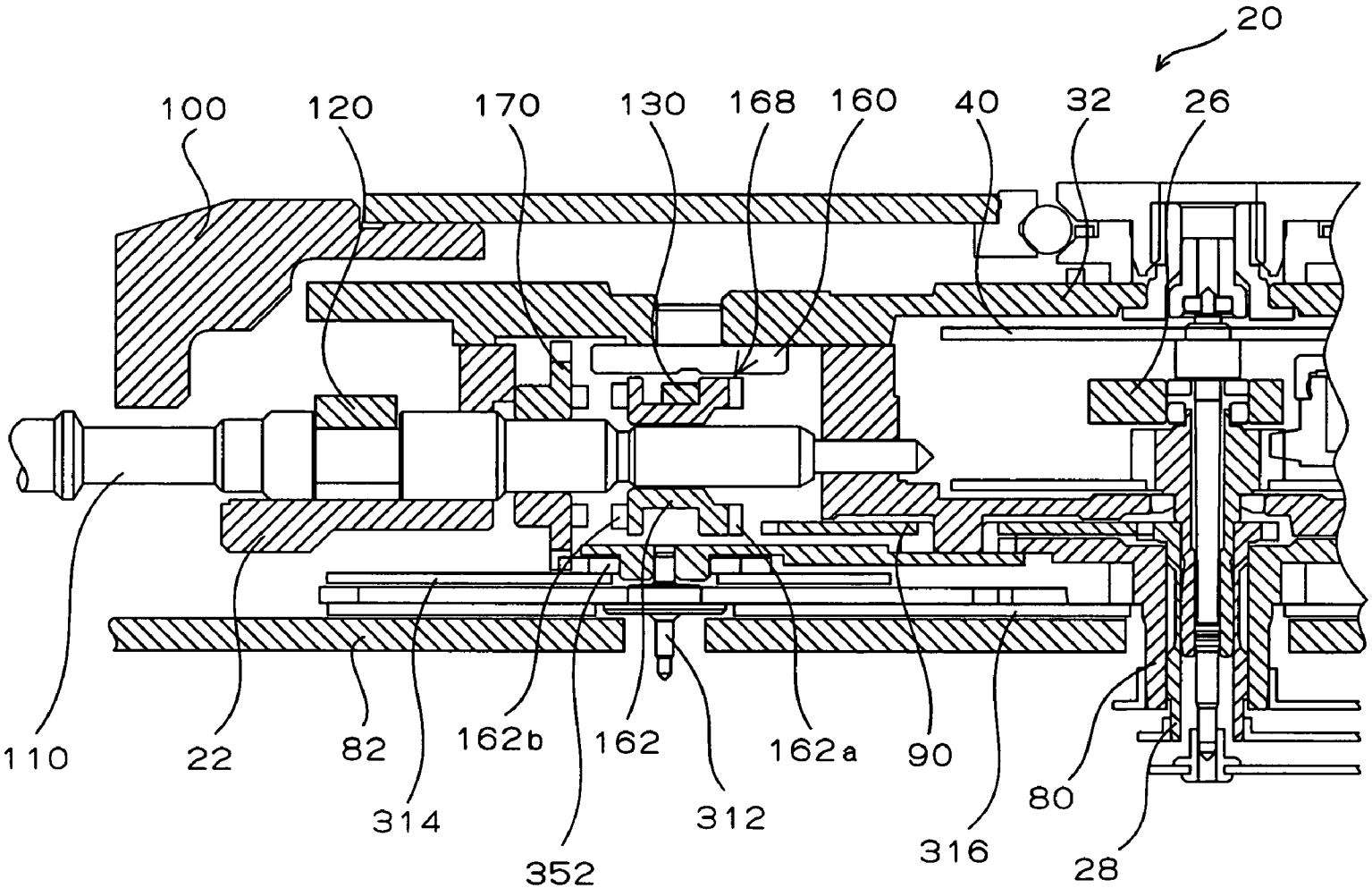
FIG. 20 is a cross sectional view showing a schematic constitution of a part of a hand setting stein according to the modified example of the first embodiment of the multifunctional watch of the present invention.
Figure 21:
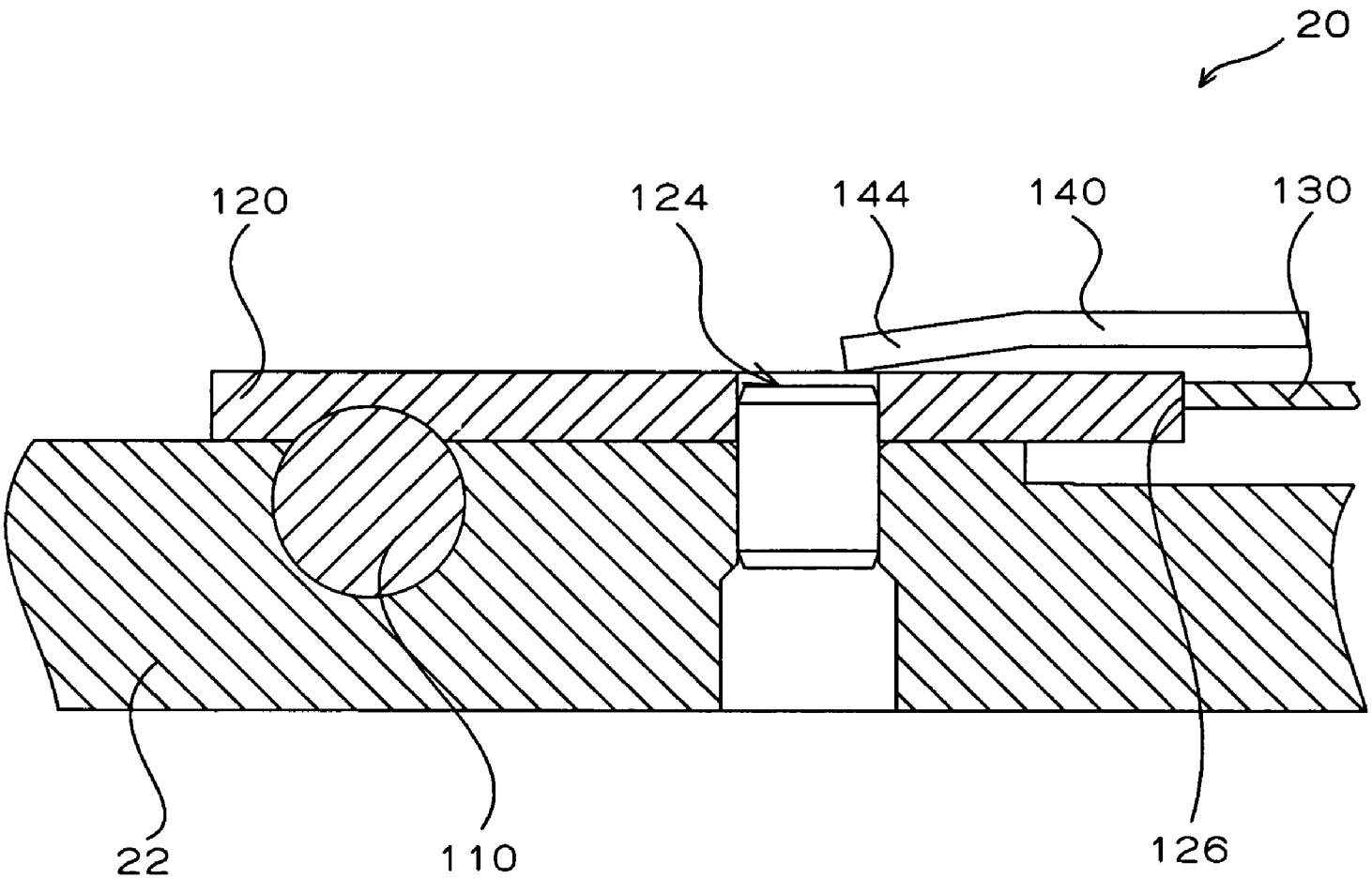
FIG. 21 is a cross sectional view showing a schematic constitution of a part of a setting lever and a yoke according to the modified example of the first embodiment of the multifunctional watch of the present invention.

Next, the constitution of a back train wheel will be described. With reference to FIG. 17 and FIG. 20, an hour wheel 80 is rotatably incorporated in the side where a dial 82 of the main plate 22 is located. A minute wheel 90 is rotatably incorporated in the side where a dial 82 of the main plate 22 is located. The minute gear of the minute wheel 90 is engaged with the canon pinion 28. A minute pinion of the minute wheel 90 is constituted so as to be engaged with the hour wheel 80. Further, by rotating the hour wheel 80, it is possible to constitute a date indicator driving wheel 310 (refer to FIG. 1) so as to be rotated. In addition, by rotating the hour wheel 80, it is possible to constitute a day indicator driving wheel 320 (refer to FIG. 1) so as to be rotated.

With reference to FIG. 16 to FIG. 18, a cone of revolution 100 is rotatably incorporated in the first bridge 32. The cone of revolution 100 is incorporated in the first bridge 32 via a ball bearing (not illustrated). A first operating wheel (not illustrated) is rotatably incorporated so as to be engaged with a pinion of the cone of revolution 100 (not illustrated). A pawl lever (not illustrated) is rotatably incorporated in a decentered cam portion (not illustrated) of the first operating wheel. A second operating wheel (not illustrated) is rotatably incorporated in the pawl lever so as to be engaged with the pawl portion (not illustrated). The second operating wheel (not illustrated) is constituted so as to be rotated on the basis of the rotation of the cone of revolution 100, and the second operating wheel is constituted so as to be rotated only in a certain direction on the basis of the rotation of the operation of the pawl lever. The second operating wheel is constituted so as to wind a spring on the basis of the rotation of the second operating wheel (not illustrated).

With reference to FIG. 16 and FIG. 19 to FIG. 21, a yoke holder 140 is made of a material which can be elastically deformed, and for example, it is preferable that the yoke holder 140 is made of a stainless steel. A yoke 130 is made of a material which can be elastically deformed, and for example, it is preferable that the yoke 130 is made of a stainless steel. A spring portion 132 of the yoke 130 may be any shape among a linear shape, a curved shape, and a U-shape or the like. A chevron portion 142 of the yoke holder 140 is engaged with a positioning pin 122 of a setting lever 120 so as to decide the position of the setting lever 120 and set the switched weight of a hand setting stem 110. According to the mechanical watch of the present invention, the chevron portion 142 of the yoke holder 140 is formed so that the hand setting stem 110 can be pulled out to the first step and the second step. Due to a spring force of the spring portion 132 of the yoke 130, a guide valley portion 138 of the yoke 130 is pressed on the side surface of the front end portion of the setting lever 120.

Next, the operation of the mechanical watch according to the present invention will be described. With reference to FIG. 16 to FIG. 18, a movement barrel 30 is rotated due to a force of a spring (not illustrated). Due to the rotation of the movement barrel 30, the second wheel and pinion 24 is rotated. Due to the rotation of the second wheel and pinion 24, the third wheel and pinion 34 is rotated. Due to the rotation of third wheel and pinion 34, the fourth wheel and pinion 40 is rotated. In addition, due to the rotation of the second wheel and pinion 24, the canon pinion 28 is rotated at the same time. Due to the rotation of the canon pinion 28, the minute wheel 90 is rotated. Due to the rotation of the minute wheel 90, the hour wheel 80 is rotated. The rotational rates of these respective train wheels are controlled by the balance with hairspring 70, the pallet fork 60, and the escape wheel and pinion 50. As a result, the fourth wheel and pinion 40 is rotated 360 degrees for one minute. The canon pinion 28 and the second wheel and pinion 24 are rotated 360 degrees for one hour. The hour wheel 80 is rotated 360 degrees for twelve hours.

A second hand 40*h* attached to the fourth wheel and pinion 40 displays "second". A minute hand 28*h* attached to the canon pinion 28 displays "minute". An hour hand 80*h* attached to the hour wheel 80 displays "hour". In other words, the fourth wheel and pinion 40, the canon pinion 28, the second wheel and pinion 24, and the hour wheel 80 form a display wheel for displaying the time information. The hour hand 80*h*, the minute hand 28*h*, the second hand 40*h*, and a scale of the dial 82 can read the time. Next, winding of the spring by means of the automatic device mechanism will be described. A user wares the mechanical watch on his or her arm and waves his or her arm. The pawl lever is operated like the operation of the decentered cam on the basis of the rotation of the cone of revolution 100, so that the spring can be wounded due to the rotation of the automatic winding operating mechanism having a ratchet tooth (not illustrated) or the like.

Next, the operation of the switching mechanism will be described. With reference to FIG. 16, and FIG. 19 to FIG. 21, when the user normally wares the mechanical watch on his or her arm, the hand setting stem 110 is located on the 0th step. Next, in the case of correcting the calendar, pulling out the hand setting stem 110, the first step is formed. In this case, the setting lever 120 is rotated. The yoke 130 is rotated due to the force of the spring of the yoke to engage an otsu-tooth 162*b* of a clutch wheel 162 with a first correction operating wheel 170. When the hand setting stem 110 is rotated in this state, the clutch wheel 162 is rotated, and due to the rotation of the first correction operating wheel 170, the fourth date corrector setting operating wheel 354 is moved in a direction approaching the date corrector setting wheel 355 via the rotations of the second date corrector setting operating wheel 352 and the third date corrector setting operating wheel 353. Then, the gear portion of the fourth date corrector setting operating wheel 354 can be engaged with the gear portion of the date corrector setting wheel 355. As a result, with the hand setting stem 210 pulled out to the first step, rotating the hand setting stem 110 in one direction and rotating the date star 312, the date correction can be made.

Next, when correcting the time, the second step is made by further pulling out the hand setting stem 110. In this time, the setting lever 120 is further rotated. The yoke 130 is rotated in the opposite direction of the above-described rotation due to a force of a spring of the yoke so as to engage a ko-tooth 162*a* of the clutch wheel 162 with the minute wheel 90. When the hand setting stem 110 is rotated in this state, the clutch wheel 162 is rotated, and by rotating the canon pinion 28 and the hour wheel 80 due to the rotation of the minute wheel 90, the time display can be corrected.

With reference to FIG. 1 to FIG. 6 and FIG. 16 to FIG. 20, the hour wheel 80 is rotated on the basis of the rotation of the minute wheel 90. The hour wheel 80 is rotated 360 degrees for 12 hours. Due to the rotation of the hour wheel 80, the date indicator driving wheel 310 is rotated. By means of the date finger 310*f* which is disposed in the date indicator driving wheel 310, the date star 312 is rotated (1/31) once for a day. The date star 312 is constituted so as to be rotated 360 degrees for 31 days. Due to the rotation of the hour wheel 262, the day indicator driving wheel 320 is rotated. By means of the day finger 320*f* which is disposed in the day indicator driving wheel 320, the small day wheel 322 is rotated (1/7) once for a day. The small day wheel 322 is rotated 360 degrees for seven days. In addition, due to the rotation of the day indicator driving wheel 320, the hour wheel 330 is rotated. The hour wheel 330 is rotated 360 degrees for 24 hours. According to the constitution for displaying "second" by means of the second hand 40*h* which is attached to the fourth wheel and pinion 40, it is possible to omit the second wheel 340 and the small second hand 340*h*. Alternatively, according to the constitution for displaying "second" by means of the small second hand 340*h*, it is possible to omit the second hand 40*h*.

(2) Second Embodiment

Next, the second embodiment of the multifunctional watch according to the present invention will be described. In the following explanation, a different point between the second embodiment of the multifunctional watch according to the present invention and the first embodiment of the multifunctional watch according to the present invention will be mainly described. Accordingly, the description with respect to the first embodiment of the multifunctional watch according to the present invention will be applied to the parts not described below.

(2.1) Entire Constitution of Movement

Figure 22:
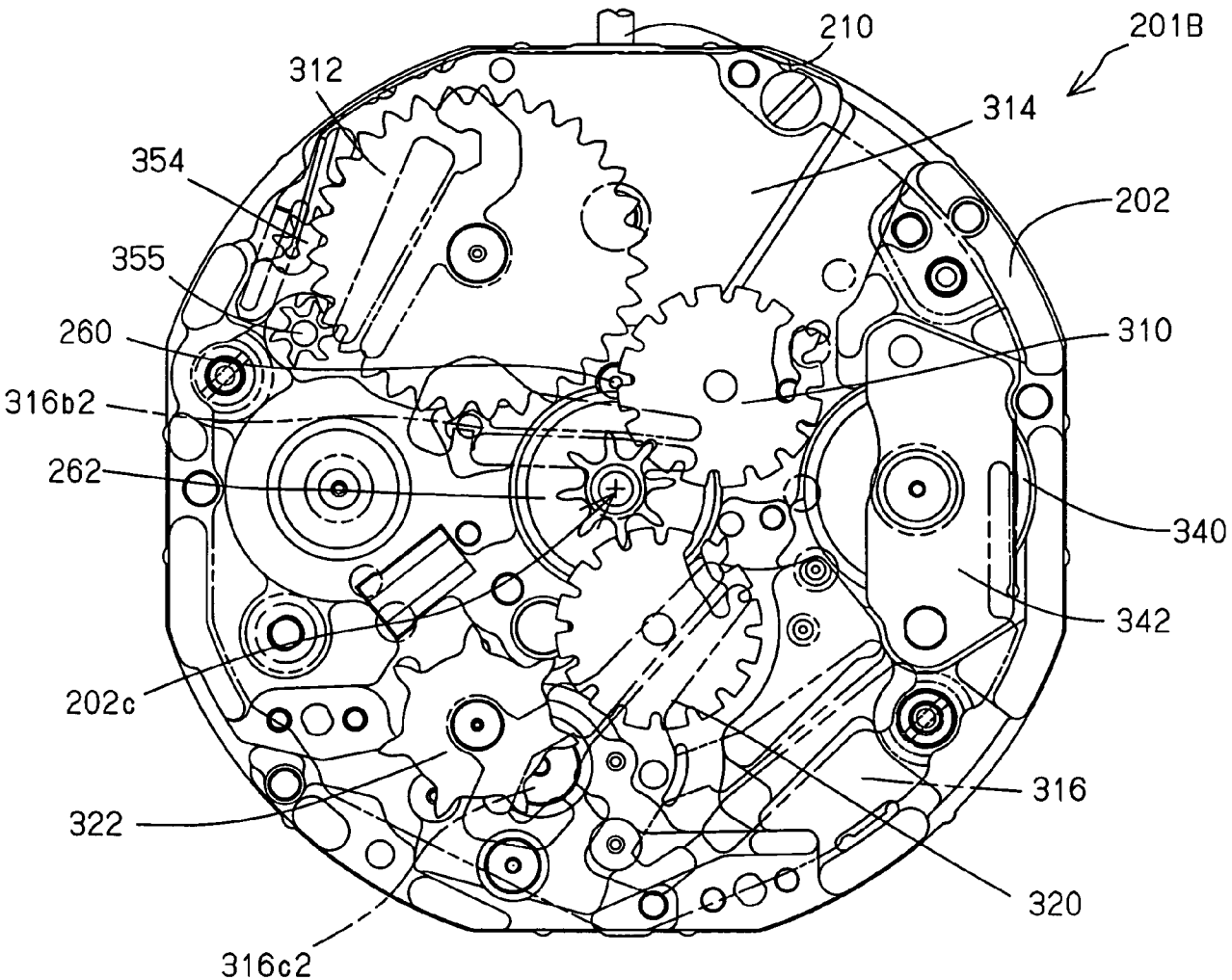
FIG. 22 is a plan view showing a schematic constitution seen from a back side of a movement according to a second embodiment of a multifunctional watch of the present invention.
Figure 23:
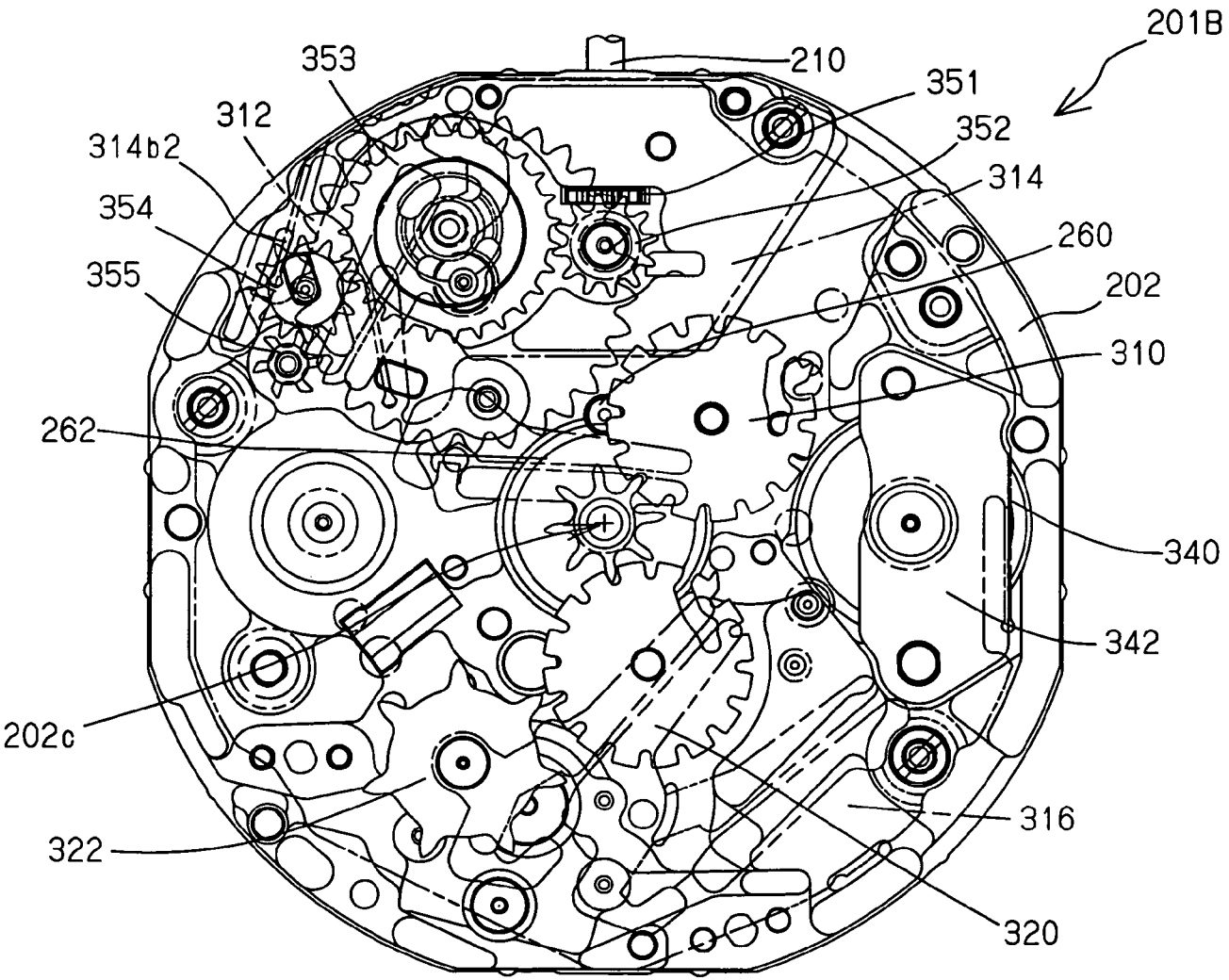
FIG. 23 is a plan view showing a date corrector setting mechanism on the back side of the movement according to the second embodiment of the multifunctional watch of the present invention.
Figure 24:
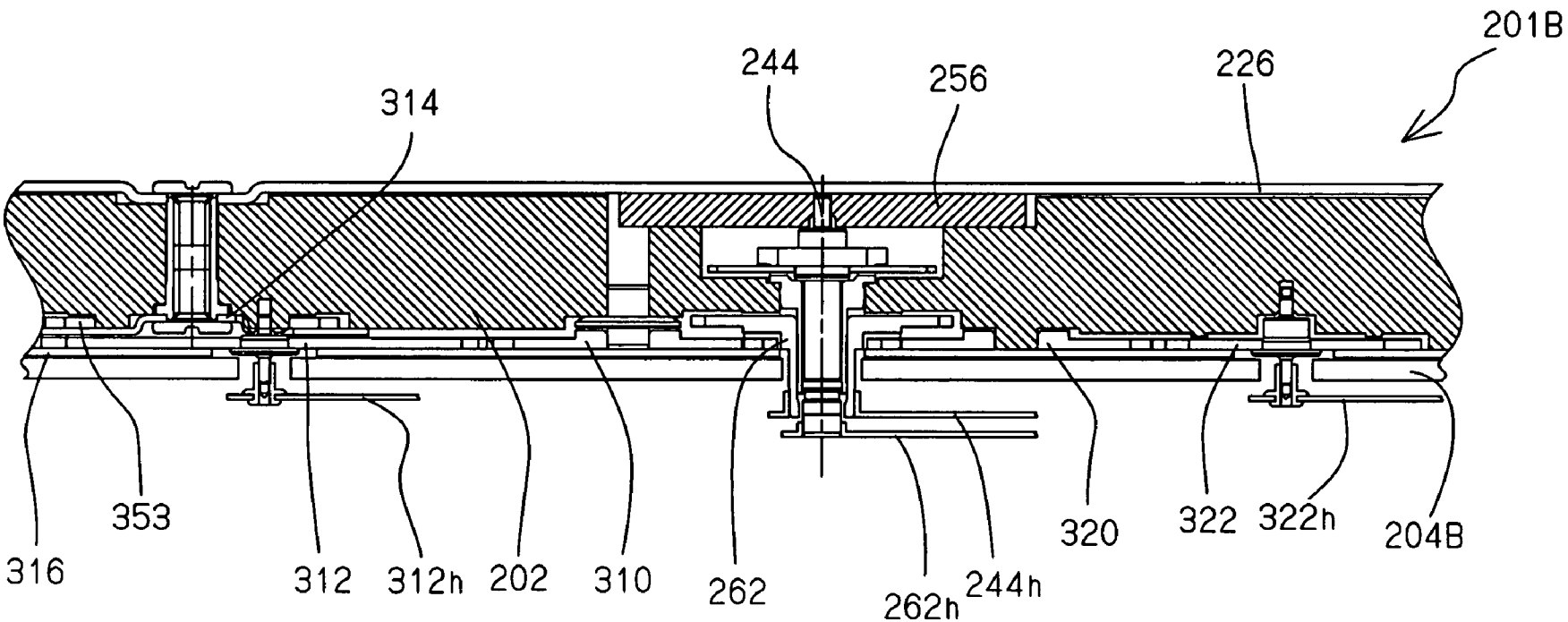
FIG. 24 is a partial cross sectional view showing a part of a back train wheel according to the second embodiment of the multifunctional watch of the present invention.

With reference to FIG. 22 to FIG. 24, the second embodiment of the multifunctional watch according to the present invention is formed by an analog electronic watch. More in detail, the second embodiment of the multifunctional watch according to the present invention is formed by an analog watch (an electric watch, an electronic watch, and a mechanical watch) having a small hand in at least one place among "a two o'clock direction", "a six o'clock direction", and "a ten o'clock direction". The second embodiment of the multifunctional watch according to the present invention can be constituted so that the hour hand, of which rotational center is the center of the main plate, displays the time information related to "hour" of 12-hours; the minute hand, of which rotational center is the center of the main plate, displays the time information related to "minute"; the small second hand, which is aligned in "the six o'clock direction", displays the time information related to "second"; the date hand, which is aligned in "a two o'clock direction", displays the time information related to "date"; and the day hand, which is aligned in "a ten o'clock direction", displays the time information related to "day".

As a modified example of the second embodiment according to the present invention, in the multifunctional watch of the present invention, the movement may be also formed by a mechanical watch. As a further modified example, the second embodiment of the multifunctional watch of the present invention may be also formed in such a manner that the movement is formed by the analog electronic watch or the mechanical watch and the time information related to "second" is displayed by means of the second hand, of which rotation center is the center of the main plate. According to this further modified example, the small second hand can be omitted.

In the second embodiment of the multifunctional watch according to the present invention, the movement 201B is provided with the main plate 202. A power source unit, a circuit unit, a step motor, a front train wheel, and a switching mechanism or the like are aligned on a case back side (a front side) of the main plate 202. A back train wheel, a calendar train wheel, and a date corrector setting mechanism or the like are aligned on a back side of the main plate 202. A dial 204B is aligned on a glass side of the main plate 202. A hand setting stem 210 is rotatably aligned on the three o'clock side of the main plate 202. The second embodiment of the multifunctional watch according to the present invention is different from the first embodiment of the multifunctional watch of the present invention in that the date display mechanism is aligned in "the two o'clock direction", the day display mechanism is aligned in "the ten o'clock direction", and the 24 hour display mechanism is not provided. All of the movement components used for the second embodiment of the multifunctional watch according to the present invention are the same as the movement components to be used for the first embodiment of the multifunctional watch according to the present invention. The dial 204B used for the second embodiment of the multifunctional watch according to the present invention is different from the dial 204 used for the first embodiment of the multifunctional watch according to the present invention.

(2.2) Constitution of Date Display Mechanism

Next, the constitution of a date display mechanism will be described. With reference to FIG. 22 to FIG. 24, the day display mechanism is constituted so as to be operated on the basis of the rotation of the hour wheel 262 in the movement 201B. The day display mechanism includes the date indicator driving wheel 310 and the date star 312. The date indicator driving wheel 310 is constituted so as to be rotated due to the rotation of the hour wheel 262. The date indicator driving wheel 310 is supported so as to be capable of being rotated for a second date indicator driving wheel pin which is disposed on the main plate 202. The rotational center of the date indicator driving wheel 310 is preferably aligned in the range between "the four o'clock direction" and "the five o'clock direction" (namely, "the four to five o'clock range").

Figure 6:
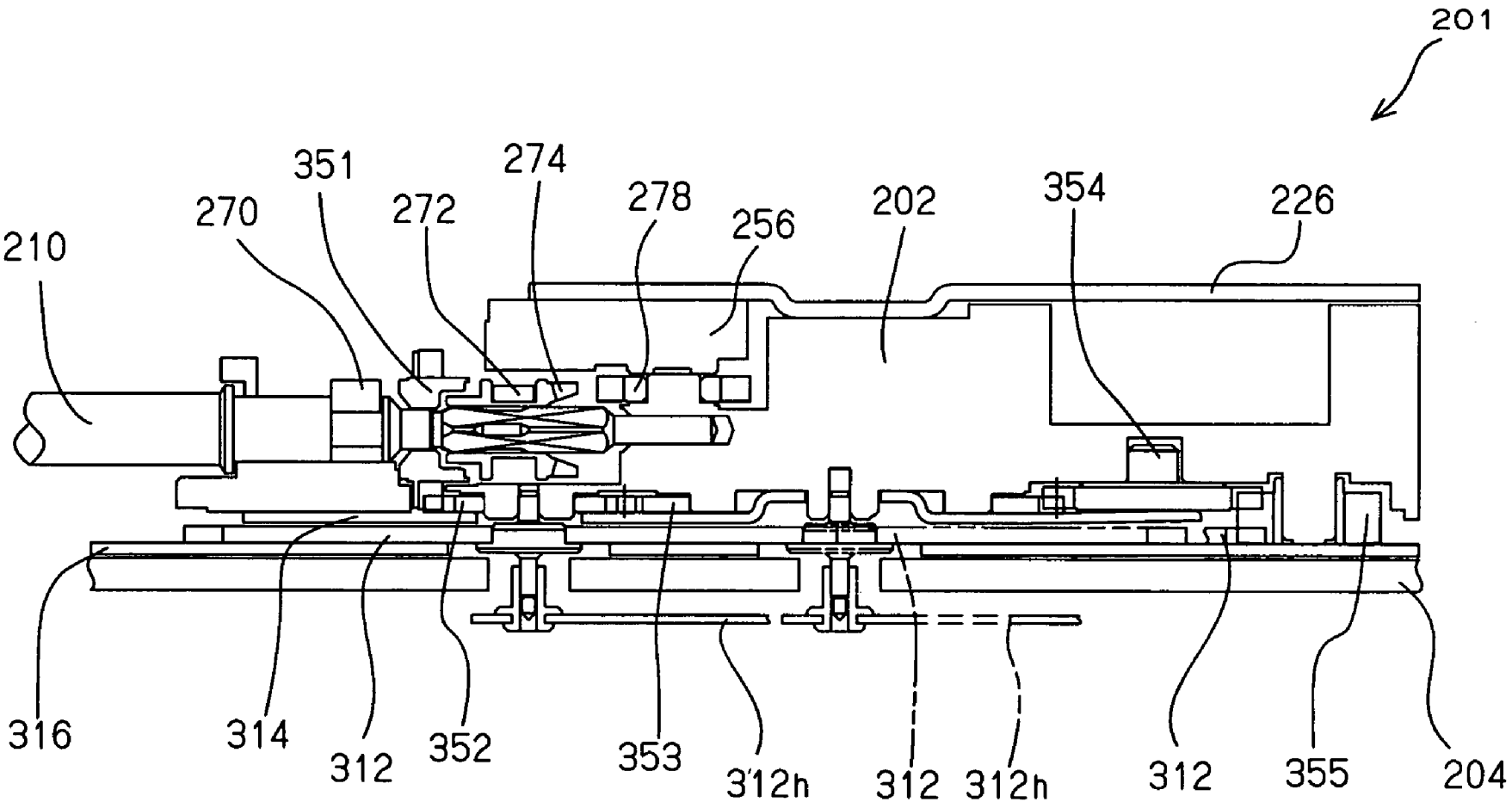
FIG. 6 is a partial cross sectional view showing a part of the hand setting stem and the date corrector setting mechanism according to the first embodiment of the multifunctional watch of the present invention.

With reference to FIG. 6, a part of the date corrector setting operating wheel cover 314 located on the lower part of the date star 312 is narrowed down to a circle toward the back surface of the main plate 202. It is preferable that a hole provided on the center of this circle narrowed-down portion of the date corrector setting operating wheel cover 314 is fitted in the date corrector setting operating wheel cover guide shaft portion which is disposed around the date star guide hole. The position in the rotational direction of the date star 312 is set by a second date jumper 316*b*2 which is disposed in the setting wheel plate 316. It is preferable that the setting portion disposed on the front end of the spring portion of the second date jumper 316*b*2 is aligned in the range between "the twelve o'clock direction" and "the one o'clock direction" (namely, "the twelve to one o'clock range"). The rotational center of the date star 312 is aligned in "the two o'clock direction". The lower shaft portion of the date star 312 is supported rotatably for the main plate 202. The date hand 312*h* is attached on the upper shaft portion of the date star 312 (in FIG. 6, it is represented by a dashed-two dotted line).

(2.3) Constitution of Day Display Mechanism

Next, the constitution of a day display mechanism will be described. With reference to FIG. 22 to FIG. 24, the day display mechanism is constituted so as to be operated on the basis of the rotation of the hour wheel 262 in the movement 201B. The day display mechanism includes the day indicator driving wheel 320 and the small day wheel 322. Due to the rotation of the hour wheel 262, the day display mechanism is constituted so that the day indicator driving wheel 320 is rotated. The day indicator driving wheel 320 is rotatably supported for a second day indicator driving wheel pin which is disposed on the main plate 202. It is preferable that the rotational center of the day indicator driving wheel 320 is aligned in the range between "the eight o'clock direction" and "the nine o'clock direction" (namely, "the eight to nine o'clock range").

The position in the rotational direction of the small day wheel 322 is set by a second day jumper 316*c*2 which is disposed in the setting wheel plate 316. It is preferable that the setting portion disposed on the front end of the spring portion of the second day jumper 316*c*2 is aligned in the range between "the nine o'clock direction" and "the ten o'clock direction" (namely, "the nine to ten o'clock range"). The rotational center of the small day wheel 322 is aligned in "the ten o'clock direction". The lower shaft portion of the small day wheel 322 is supported rotatably for the main plate 202. The day finger 322*h* is attached to the upper shaft portion of the small day wheel 322.

(2.4) Constitution of Date Corrector Setting Mechanism

Next, the constitution of a date corrector setting mechanism will be described. With reference to FIG. 22 to FIG. 24, on the back side of the movement 201B, the date corrector setting mechanism for correcting the display of the date due to the date star 312 is disposed. The date corrector setting mechanism is formed by a first date corrector setting operating wheel 351, a second date corrector setting operating wheel 352, a third date corrector setting operating wheel 353, a fourth date corrector setting operating wheel 354, and a date corrector setting wheel 355. The rotational center of the second date corrector setting operating wheel 352 is aligned in "the three o'clock direction". The rotational center of the second date corrector setting operating wheel 352 according to the second embodiment of the multifunctional watch of the present invention is aligned in the same way as the rotational center of the second date corrector setting operating wheel 352 according to the first embodiment of the multifunctional watch of the present invention.

The third date corrector setting operating wheel 353 is rotatably supported for the main plate 202. It is preferable that the rotational center of the third date corrector setting operating wheel 353 is aligned in "the two o'clock direction" or in the range between "the two o'clock direction" and "the three o'clock direction" (namely, "the two to three o'clock range"). The rotational center of the third date corrector setting operating wheel 353 according to the second embodiment of the multifunctional watch of the present invention is aligned in the same way as the rotational center of the third date corrector setting operating wheel 353 according to the first embodiment of the multifunctional watch of the present invention. The lower shaft of the fourth date corrector setting operating wheel 354 is moveably and rotatably supported for a second fourth date corrector setting operating wheel guide long hole which is formed on the main plate 202. It is preferable that a second fourth date corrector setting operating wheel guide long hole for guiding the lower shaft of the fourth date corrector setting operating wheel 354 is aligned in the range between "the one o'clock direction" and "the two o'clock direction" (namely, "the one to two o'clock range"). The second fourth date corrector setting operating wheel guide long hole according to the second embodiment of the multifunctional watch of the present invention is aligned on the position near the outline portion of the main plate 202 rather than the fourth date corrector setting operating wheel guide long hole according to the first embodiment of the multifunctional watch of the present invention. A second setting spring portion 314*b*2 for applying a pressure on the fourth date corrector setting operating wheel 354 toward the main plate 202 is disposed in the date corrector setting operating wheel cover 314. It is preferable that the rotational center of the date corrector setting wheel 355 is aligned in the range between "the twelve o'clock direction" and "the one o'clock direction" (namely, "the twelve to one o'clock range").

(2.5) Constitution of Main Plate

Next, with respect to the constitution of the main plate 202, the explanation will be added to the above explanation given to the first embodiment of the multifunctional watch of the present invention. With reference to FIG. 7, the main plate 202 is further provided with rotational centers of rotational members including a rotational center 202 DW2 of the date indicator driving wheel 310 according to the second embodiment, a rotational center 202 DS2 of the date star 312 according to the second embodiment, a rotational center 202 WT2 of the day indicator driving wheel 320 according to the second embodiment, a rotational center 202 SW2 of the small day wheel 322 according to the second embodiment, and a rotational center 202 SB2 of the date corrector setting wheel 355 according to the second embodiment.

Further, the main plate 202 is provided with a second fourth date corrector setting operating wheel guide long hole 202 SL2 for guiding the lower shaft of the fourth date corrector setting operating wheel 354 according to the second embodiment so as to be capable of being moved. On each of the above-described rotational centers, a guide shaft portion for guiding a center hole of the rotational member is formed in order to support the rotational member to be rotated centering around the rotational center so as to be capable of being rotated. Alternatively, a guide hole for guiding the shaft portion of the rotational member is formed. In other words, a train wheel guide portion can be formed by the guide hole, the guide bearing, the guide shaft, and the guide pin or the like for guiding the rotational member so as to be capable of being rotated.

As described above, the main plate 202 is provided with a center pipe 202*b* aligned on the main plate center 202*c*, a lower bearing of the rotor 236, a lower bearing of the fifth wheel and pinion 238, a lower bearing of the fourth wheel and pinion 240, a lower bearing of the third-wheel and pinion 242, a lower bearing of the minute wheel 260, a guide pin of the setting wheel 278, a guide pin of the date indicator driving wheel 310, a guide pin of the date star 312, a guide pin of the day indicator driving wheel 320, a lower bearing of the small day wheel 322, a lower bearing of the hour wheel 330, a lower bearing of the second wheel 340, a guide pin of the third date corrector setting operating wheel 353, and a guide pin of the date corrector setting wheel 355. For example, the above-described bearing can be formed by a hole jewel, a tenon frame, a through hole, and a blind hole or the like. For example, the guide pin can be formed integrally with the main plate 202 or the guide pin which is separately formed from the main plate 202 can be fixed to the main plate 202. Alternatively, in place of the above-described bearing, the guide member such as a pin can be also used. Alternatively, in place of the above-described guide pin, the guide member such as the hole jewel, the tenon frame, the through hole, and the blind hole or the like can be also used.

The movement 201 and the movement 201B are provided with a first train wheel rotational center for a train wheel to be used when manufacturing a first type of a multifunctional watch having the arrangement of a first type of a small hand and a second train wheel rotational center for a train wheel to be used when manufacturing a second type of a multifunctional watch having the arrangement of a second type of a small hand. On the first train wheel rotational center and the second train wheel rotational center, the train wheel guide portion (a guide hole, a guide bearing, a guide shaft, and a guide pin or the like) is disposed for rotatably guiding the train wheel member to be rotated centering around that position. The first train wheel rotational center and the second train wheel rotational center are aligned on the position between the main plate center 202*c* of the main plate 202 and the main plate outline portion of the main plate 202. As described above, according to the first embodiment and the second embodiment of the present invention, the main plate 202 can be used for the movement 201 and also for the movement 201B.

(2.6) Constitution of Date Corrector Setting Transmitting Wheel Cover

Next, with respect to the constitution of the date corrector setting operating wheel cover 314, the explanation will be added to the above explanation given to the first embodiment of the multifunctional watch of the present invention. With reference to FIG. 8, the second setting spring portion 314*b*2 according to the second embodiment for applying a pressure on the fourth date corrector setting operating wheel 354 toward the main plate 202 is disposed in the date corrector setting operating wheel cover 314. It is preferable that the second setting spring portion 314*b*2 is aligned on the range between "the one o'clock direction" and "the two o'clock direction" (namely, "one to two o'clock range"). It is preferable that the front end portion where the second setting spring portion 314*b*2 is brought into contact with the fourth date corrector setting operating wheel 354 is aligned on the range between "the one o'clock direction" and "the two o'clock direction" (namely, "one to two o'clock range"). Further, it is preferable that a part of the date corrector setting operating wheel cover 314 located on the lower part of the date star 312 is narrowed down to a circle toward the back surface of the main plate 202 and a hole provided on the center of this circle narrowed-down portion of the date corrector setting operating wheel cover 314 is formed so as to be fitted in the date corrector setting operating wheel cover guide shaft portion which is disposed around the date star guide hole. As described above, according to the first embodiment and the second embodiment, the date corrector setting operating wheel cover 314 can be used for the movement 201 and also for the movement 201B.

(2.7) Constitution of Setting Wheel Plate

Next, with respect to the constitution of the setting wheel plate 316, the explanation will be added to the above explanation given to the first embodiment of the multifunctional watch of the present invention. With reference to FIG. 9, the second date jumper 316*b*2 according to the second embodiment for setting the position of the rotational direction of the date star 312 is disposed in the setting wheel plate 316. It is preferable that the spring portion of the second date jumper 316*b* is aligned in the range between "the one o'clock direction" and "the five o'clock direction" (namely, "the one to five o'clock range"). It is preferable that the setting portion disposed on the front end of the spring portion of the second date jumper 316*b* is aligned in the range between "the twelve o'clock direction" and "the one o'clock direction" (namely, "the twelve to one o'clock range"). The second day jumper 316*c*2 according to the second embodiment for setting the position in the rotational direction of the small day wheel 322 is disposed in the setting wheel plate 316. It is preferable that the spring portion of the second day jumper 316*c*2 is aligned in the range between "the seven o'clock direction" and "the ten o'clock direction" (namely, "the seven to ten o'clock range"). It is preferable that the setting portion disposed on the front end of the spring portion of the second day jumper 316*c*2 is aligned in the range between "the nine o'clock direction" and "the ten o'clock direction" (namely, "the nine to ten o'clock range"). As described above, according to the first embodiment and the second embodiment of the present invention, the setting wheel plate 316 can be used for the movement 201 and also for the movement 201B.

(2.8) Description of Position of Hand and Specification of Hand

Figure 25:
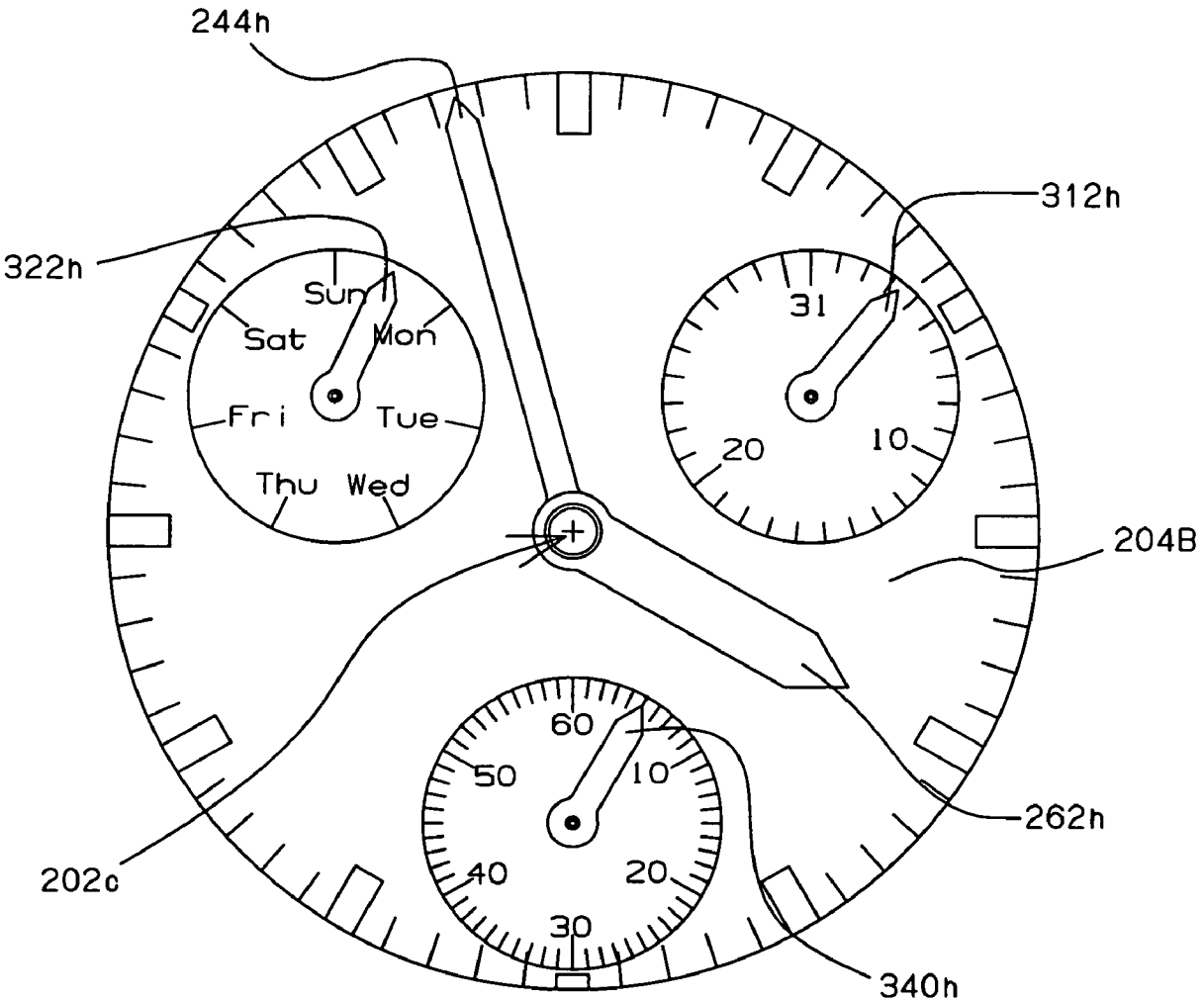
FIG. 25 is a plan view showing a part of a dial of a complete provided with three small hands and a hand according to the second embodiment of the multifunctional watch of the present invention.

With reference to FIG. 10 and FIG. 25, according to the fifth kind of the embodiment of the present invention, it is possible to display the time information related to "hour" of 12-hours by the hour hand 262*h* attached to the hour wheel 262, of which rotational center is the main plate center 202*c*, display the time information related to "minute" by the minute hand 244*h* attached to the second wheel and pinion 244, of which rotational center is the main plate center 202*c*, display the time information related to "second" by a small second hand 340*h* attached to the second wheel 340, of which rotational center is aligned in "the six o'clock direction", display the calendar information related to "date" by the date hand 312*h* attached to the date star 312, of which rotational center is aligned in "the two o'clock direction", and display the calendar information related to "day" by the day finger 322*h* attached to the small day wheel 322, of which rotational center is aligned in "the ten o'clock direction".

The character, the numeral, and the abbreviation or the like for displaying each time information and each calendar information are provided on the dial 204B. For example, in order to display the time information related to "date", the numerals such as "10", "20", and "31" are provided on a position corresponding to the date hand 312*h* of the dial 204 along the circumference. For example, in order to display the time information related to "second", the numerals such as "10", "20", "30", "40", "50", and "60" are provided on a position corresponding to the small second hand 340*h* of the dial 204 along the circumference. For example, in order to display the time information related to "day", English letters such as "Sun", "Mon", "Tue", "Wed", "Thu", "Fri", and "Sat" are provided on the position corresponding to the day finger 322*h* of the dial 204 along the circumference.

(3) Third Embodiment

Next, the third embodiment of the multifunctional watch according to the present invention will be described. In the following explanation, a different point between the third embodiment of the multifunctional watch according to the present invention and the first embodiment of the multifunctional watch according to the present invention will be mainly described. Accordingly, the above-description with respect to the first embodiment of the multifunctional watch according to the present invention will be applied to the parts not described below.

(3.1) Entire Constitution of Movement

Figure 26:
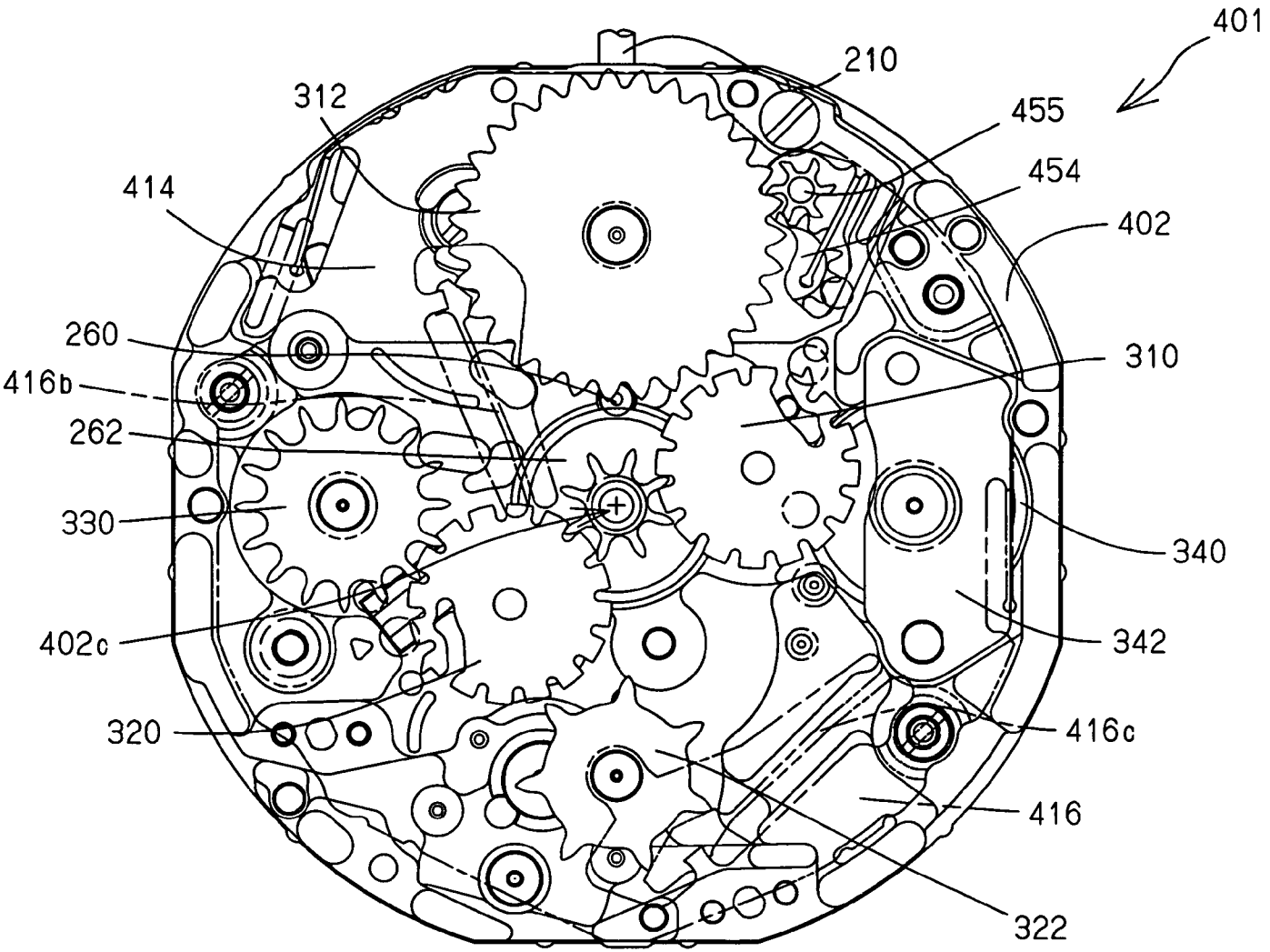
FIG. 26 is a plan view showing a schematic constitution seen from a back side of a movement according to a third embodiment of a multifunctional watch of the present invention.
Figure 27:
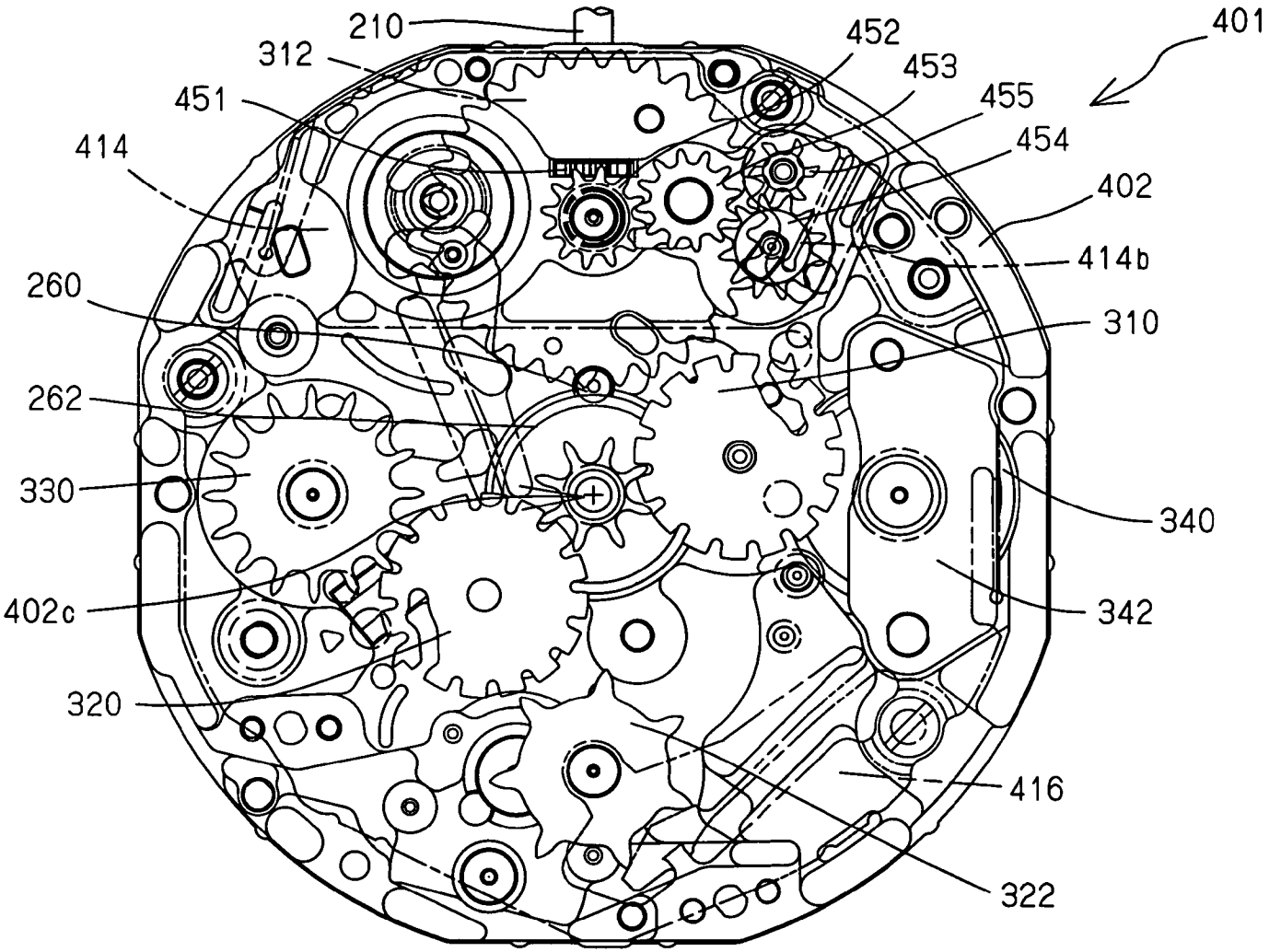
FIG. 27 is a plan view showing a date corrector setting mechanism on the back side of the movement according to the third embodiment of the multifunctional watch of the present invention.
Figure 28:
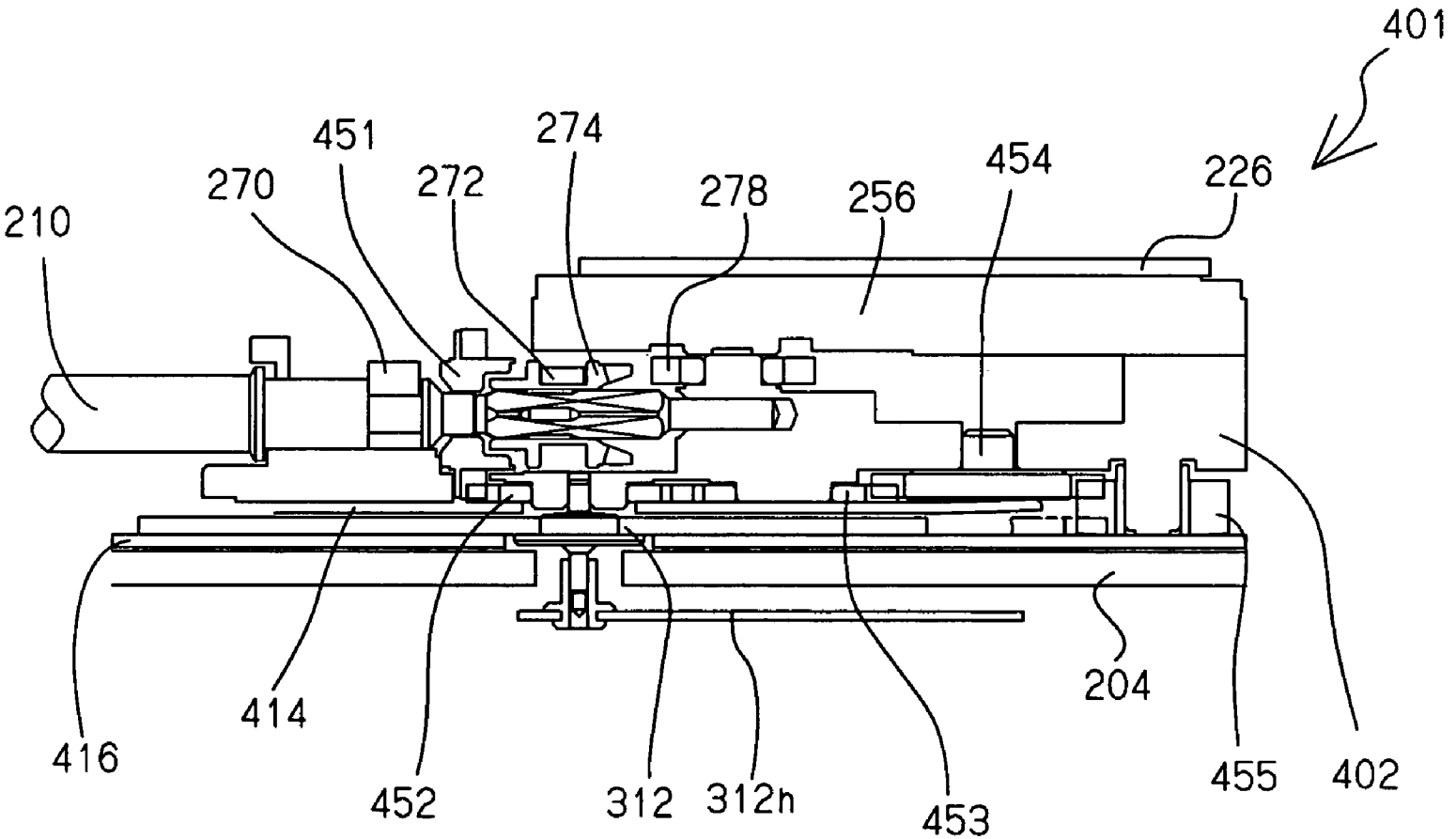
FIG. 28 is a partial cross sectional view showing a part of a hand setting stem and a back train wheel according to the third embodiment of the multifunctional watch of the present invention.

With reference to FIG. 26 to FIG. 28, in the third embodiment of the multifunctional watch according to the present invention the movement is formed by an analog electronic watch. More in detail, the third embodiment of the multifunctional watch according to the present invention is formed by an analog watch (an electric watch, an electronic watch, and a mechanical watch) having a small hand in at least one place among "a three o'clock direction", "a six o'clock direction", "a nine o'clock direction", and "a twelve o'clock direction". In other words, as same as the above-described first embodiment, the third embodiment of the multifunctional watch according to the present invention can be constituted so that the hour hand, of which rotational center is the center of the main plate, displays the time information related to "hour" of 12-hours; the minute hand, of which rotational center is the center of the main plate, displays the time information related to "minute" of 12-hours; a 24 o'clock hand, of which rotational center is aligned in "the twelve o'clock direction", displays the time information related to "hour" of 24-hours; the date hand, which is aligned in "a three o'clock direction", displays the calendar time information related to "date"; the small second hand, which is aligned in "the six o'clock direction", displays the time information related to "second"; and the day hand, which is aligned in "a nine o'clock direction", displays the calendar information related to "day".

As same as the modified example of the first embodiment of the multifunctional watch of the present invention, as a modified example of the third embodiment according to the present invention, in the third embodiment of the multifunctional watch of the present invention, the movement may be also formed by a mechanical watch. As a further modified example, the third embodiment of the multifunctional watch of the present invention may be also formed in such a manner that the movement is formed by the analog electronic watch or the mechanical watch and the time information related to "second" is displayed by means of the second hand, of which rotation center is the center of the main plate. According to this further modified example, the small second hand can be omitted.

In the third embodiment of the multifunctional watch according to the present invention, the movement 401 is provided with a main plate 402. A power source unit, a circuit unit, a step motor, a front train wheel, and a switching mechanism or the like are aligned on a case back side (a front side) of the main plate 402. A back train wheel, a calendar train wheel, and a date corrector setting mechanism or the like are aligned on a back side of the main plate 402. A dial 204 is aligned on a glass side of the main plate 402. A hand setting stem 210 is rotatably aligned on the three o'clock side of the main plate 402. The third embodiment of the multifunctional watch according to the present invention is different from the first embodiment of the multifunctional watch of the present invention in the constitutions of the main plate, the date corrector setting operating wheel cover, and the setting wheel plate, and the constitution and the alignment of the date correcting mechanism. Other movement components used for the third embodiment of the multifunctional watch according to the present invention can be constituted by the components having the same measurements and shapes as the movement components to be used for the first embodiment of the multifunctional watch according to the present invention. The dial 204 used for the third embodiment of the multifunctional watch according to the present invention can be formed by that having the same measurement and shape as the dial 204 used for the first embodiment of the multifunctional watch of the present invention.

(3.2) Constitution of Date Display Mechanism

Next, the constitution of a date display mechanism will be described. With reference to FIG. 26 to FIG. 28, the day display mechanism is constituted so as to be operated on the basis of the rotation of the hour wheel 262 in the movement 401. The day display mechanism includes the date indicator driving wheel 310 and the date star 312. The date indicator driving wheel 310 is constituted so as to be rotated due to the rotation of the hour wheel 262. The date indicator driving wheel 310 is supported so as to be capable of being rotated for a date indicator driving wheel pin which is disposed on the main plate 402. The rotational center of the date indicator driving wheel 310 is preferably aligned in the range between "the five o'clock direction" and "the six o'clock direction" (namely, "the five to six o'clock range").

The position in the rotational direction of the date star 312 is set by a date jumper 416*b* which is disposed in the setting wheel plate 416. It is preferable that the setting portion disposed on the front end of the spring portion of the date jumper 416*b* is aligned in the range between "the one o'clock direction" and "the two o'clock direction" (namely, "the one to two o'clock range"). The rotational center of the date star 312 is aligned in "the three o'clock direction". The lower shaft portion of the date star 312 is supported rotatably for the main plate 402. The date hand 312*h* is attached on the upper shaft portion of the date star 312.

(3.3) Constitution of Day Display Mechanism

Next, the constitution of a day display mechanism will be described. With reference to FIG. 26 to FIG. 28, the day display mechanism is constituted so as to be operated on the basis of the rotation of the hour wheel 262 in the movement 401. The day display mechanism includes the day indicator driving wheel 320 and the small day wheel 322. Due to the rotation of the hour wheel 262, the day display mechanism is constituted so that the day indicator driving wheel 320 is rotated. The day indicator driving wheel 320 is rotatably supported for a day indicator driving wheel pin which is disposed on the main plate 402. It is preferable that the rotational center of the day indicator driving wheel 320 is aligned in the range between "the ten o'clock direction" and "the eleven o'clock direction" (namely, "the ten to eleven o'clock range").

The position in the rotational direction of the small day wheel 322 is set by a day jumper 416*c* which is disposed in the setting wheel plate 416. It is preferable that the setting portion disposed on the front end of the spring portion of the day jumper 416*c* is aligned in the range between "the eight o'clock direction" and "the nine o'clock direction" (namely, "the eight to nine o'clock range"). The rotational center of the small day wheel 322 is aligned in "the nine o'clock direction". The lower shaft portion of the small day wheel 322 is supported rotatably for the main plate 402. The day finger 322*h* is attached to the upper shaft portion of the small day wheel 322.

(3.4) Constitution of Date Corrector Setting Mechanism

Next, the constitution of a date corrector setting mechanism will be described. With reference to FIG. 26 to FIG. 28, on the back side of the movement 401, the date corrector setting mechanism for correcting the display of the date due to the date star 312 is disposed. The date corrector setting mechanism is formed by a first date corrector setting operating wheel 451, a second date corrector setting operating wheel 452, a third date corrector setting operating wheel 453, a fourth date corrector setting operating wheel 454, and a date corrector setting wheel 455. The rotational center of the second date corrector setting operating wheel 452 is aligned in "the three o'clock direction".

It is possible to conform the measurement and the shape of the first date corrector setting operating wheel 451 according to the third embodiment of the multifunctional watch of the present invention to the measurement and the shape of the first date corrector setting operating wheel 351 according to first embodiment. It is possible to conform the measurement and the shape of the second date corrector setting operating wheel 452 according to the third embodiment of the multifunctional watch of the present invention to the measurement and the shape of the second date corrector setting operating wheel 352 according to the first embodiment. The rotational center of the second date corrector setting operating wheel 452 according to the third embodiment of the multifunctional watch of the present invention can be aligned on the same position as the rotational center of the second date corrector setting operating wheel 352 according to the first embodiment of the multifunctional watch of the present invention. It is possible to conform the measurement and the shape of the fourth date corrector setting operating wheel 454 according to the third embodiment of the multifunctional watch of the present invention to the measurement and the shape of the fourth date corrector setting operating wheel 354 according to the first embodiment. It is possible to conform the measurement and the shape of the date corrector setting wheel 455 according to the third embodiment of the multifunctional watch of the present invention to the measurement and the shape of the fourth date corrector setting wheel 355 according to the first embodiment.

The third date corrector setting operating wheel 453 is rotatably supported for the main plate 402. It is preferable that the rotational center of the third date corrector setting operating wheel 453 is aligned in the range between "the three o'clock direction" and "the four o'clock direction" (namely, "the three to four o'clock range"). The lower shaft of the fourth date corrector setting operating wheel 454 is moveably and rotatably supported for the fourth date corrector setting operating wheel guide long hole which is formed on the main plate 402. It is preferable that the fourth date corrector setting operating wheel guide long hole for guiding the lower shaft of the fourth date corrector setting operating wheel 454 is aligned in the range between "the four o'clock direction" and "the five o'clock direction" (namely, "the four to five o'clock range"). A setting spring portion 414*b* for applying a pressure on the fourth date corrector setting operating wheel 454 toward the main plate 402 is disposed in the date corrector setting operating wheel cover 414. It is preferable that the rotational center of the date corrector setting wheel 355 is aligned in "the four o'clock direction" or in the range between "the three o'clock direction" and "the four o'clock direction" (namely, "the three to four o'clock range").

(3.5) Constitution of Main Plate

Figure 29:
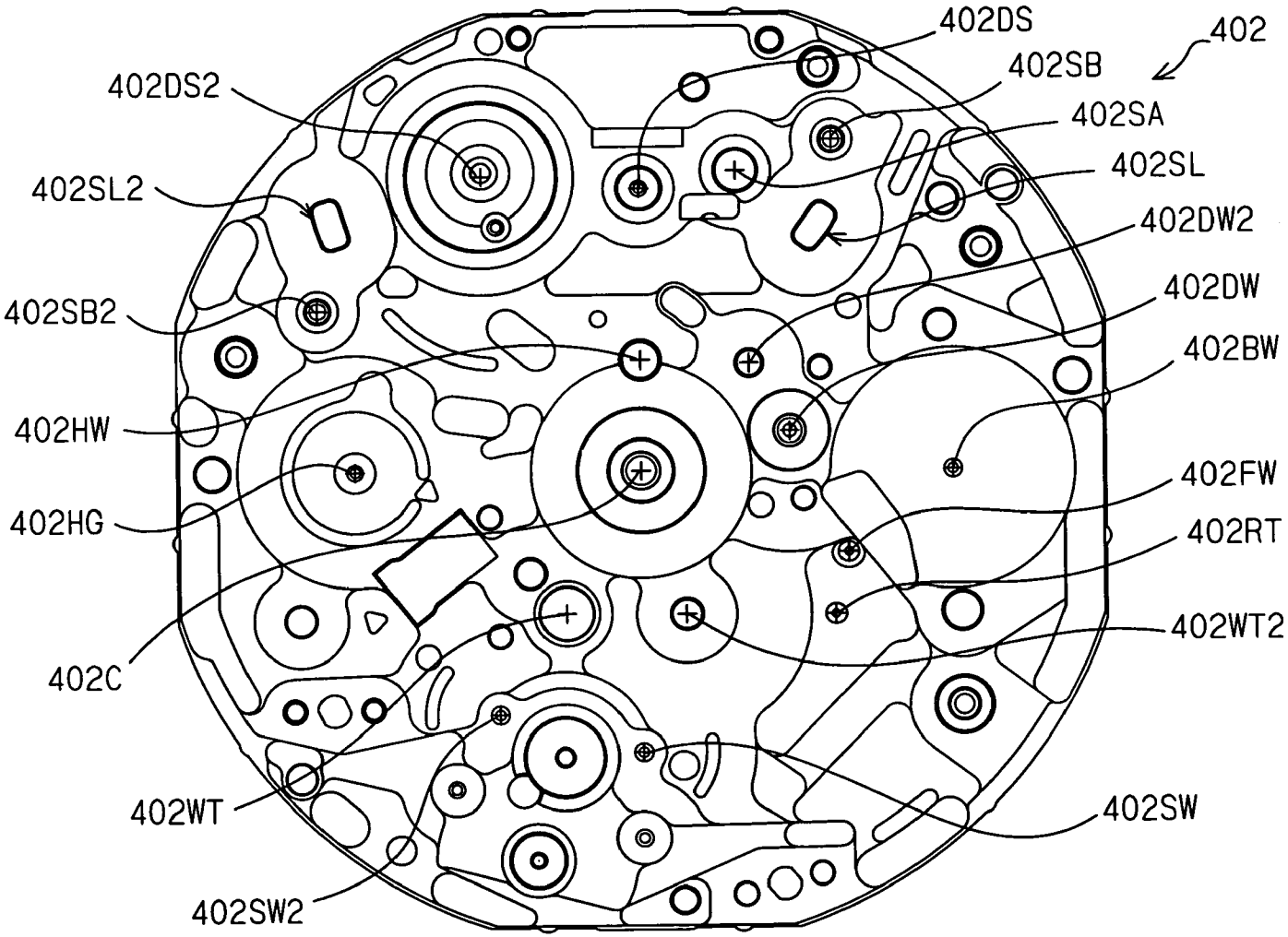
FIG. 29 is a plan view showing a form seen from the back side of a main plate according to the third embodiment of the multifunctional watch of the present invention.

Next, the constitution of the main plate 402 will be described. With reference to FIG. 29, the rotational center of the second wheel and pinion 244 and the rotational center of the hour wheel 262 are aligned on a main plate center 402*c*. The center axial line of the center pipe 202*b* is aligned on the main plate center 402*c*.

The main plate 402 is provided with rotational centers of rotational members including a rotational center 402 RT of the rotor 236, a rotational center 402 FW of the fifth wheel and pinion 238, a rotational center of the fourth wheel and pinion 240 (not illustrated), a rotational center of the third wheel and pinion 242 (not illustrated), a rotational center 402 HW of the minute wheel 260, a rotational center of the setting wheel 278 (not illustrated), a rotational center 402 DW of the date indicator driving wheel 310, a rotational center 402 DS of the date star 312, a rotational center 402 WT of the day indicator driving wheel 320, a rotational center 402 SW of the small day wheel 322, a rotational center 402 HG of the hour wheel 330, a rotational center 402 BW of the second wheel 340, a rotational center 402 SA of the third date corrector setting operating wheel 353, and a rotational center 402 SB of the date corrector setting wheel 355 or the like. It is preferable that the rotational center of the second date corrector setting operating wheel 352 is aligned on the same position as the rotational center 402 DS of the date star 312.

Further, the main plate 202 is provided with a fourth date corrector setting operating wheel guide long hole 402 SL for guiding the lower shaft of the fourth date corrector setting operating wheel 354 so as to be capable of being moved. On each of the above-described rotational centers, a guide shaft portion for guiding a center hole of the rotational member is formed in order to support the rotational member to be rotated centering around the rotational center so as to be capable of being rotated. Alternatively, a guide hole for guiding the shaft portion of the rotational member is formed. In other words, the train wheel guide portion for guiding the rotational member so as to be capable of being rotated can be formed by a guide hole, a guide bearing, a guide shaft, and a guide pin or the like. As to be described later, the main plate 402 is provided with a rotational center for supporting each rotational member to be used for other embodiment of the present invention so as to be capable of being rotated.

As described above, the movement 401 is provided with a first train wheel rotational center for a train wheel to be used when manufacturing a first type of a multifunctional watch having the arrangement of a first type of a small hand. The first train wheel rotational center is aligned on the position between the main plate center 402*c* of the main plate 402 and the main plate outline portion of the main plate 402. On the first train wheel rotational center, a guide hole or a guide bearing is disposed for rotatably guiding the train wheel member to be rotated centering around that position. Further, as to be described later, the movement 401 is provided with a second train wheel rotational center for a train wheel to be used when manufacturing a second type of a multifunctional watch having the arrangement of a second type of a small hand by using the movement 401. The second train wheel rotational center is aligned on the position between the main plate center 402*c* of the main plate 402 and the main plate outline portion of the main plate 402. On the second train wheel rotational center, a train wheel guide portion (a guide hole, a guide bearing, a guide shaft, and a guide pin or the like) is disposed for rotatably guiding the train wheel member to be rotated centering around that position.

(3.6) Constitution of Date Corrector Setting Transmitting Wheel Cover

Figure 30:
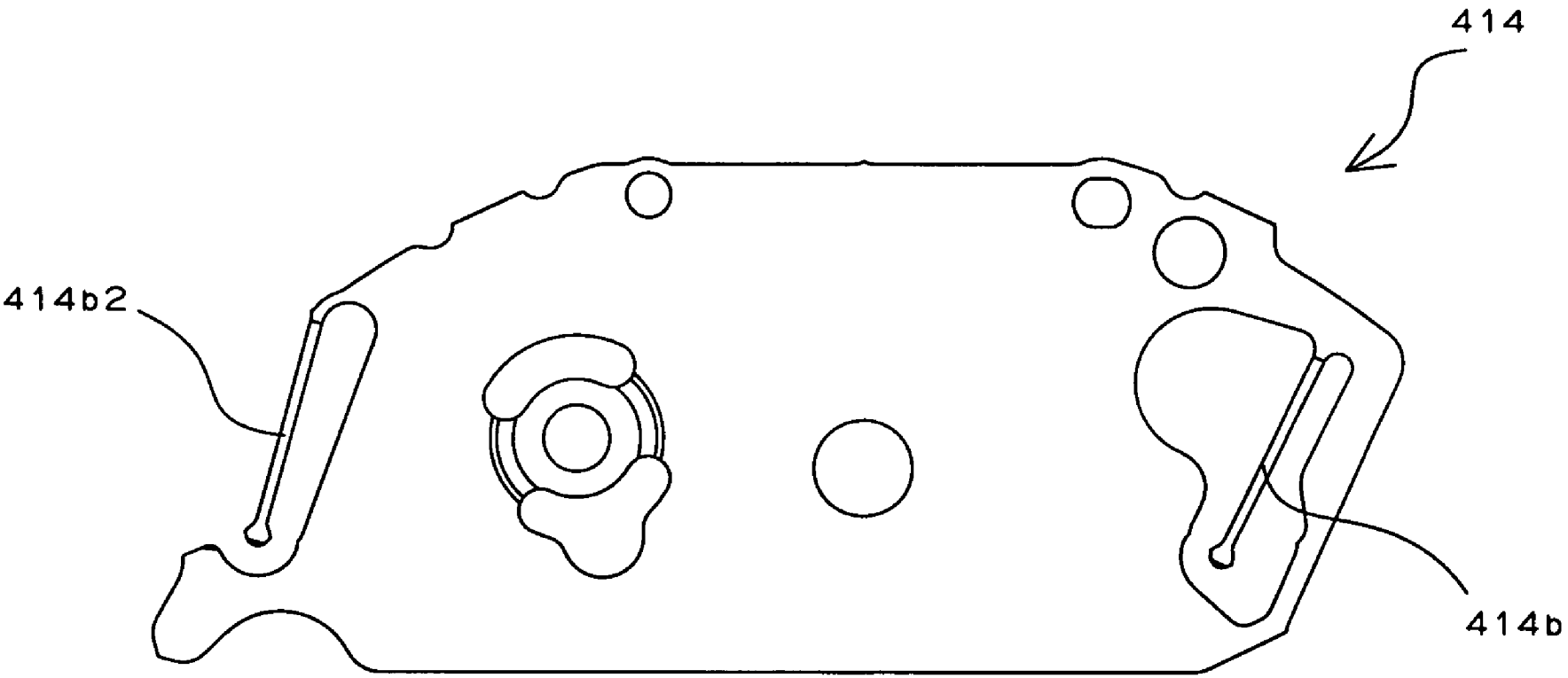
FIG. 30 is a plan view showing a form seen from the upper side of a date corrector setting operating wheel cover according to the third embodiment of the multifunctional watch of the present invention.

Next, the constitution of the date corrector setting operating wheel cover 414 will be described. With reference to FIG. 30, the date corrector setting operating wheel cover 314 is aligned in "the twelve to three o'clock range" and "the three to six o'clock range". The setting spring portion 414*b* for applying a pressure on the fourth date corrector setting operating wheel 454 toward the main plate 402 is disposed in the date corrector setting operating wheel cover 314. The setting spring portion 314*b* is preferably aligned in the range between "the four o'clock direction" and "the five o'clock direction" (namely, "the four to five o'clock range"). It is preferable that the front end portion bringing the setting spring portion 414*b* into contact with the fourth date corrector setting operating wheel 454 is aligned in the range between "the four o'clock direction" and "the five o'clock direction" (namely, "the four to five o'clock range"). The date corrector setting operating wheel cover 414 is further provided with a further setting spring portion 414*b*2 to be used for other embodiment of the present invention.

(3.7) Constitution of Setting Wheel Plate

Figure 31:
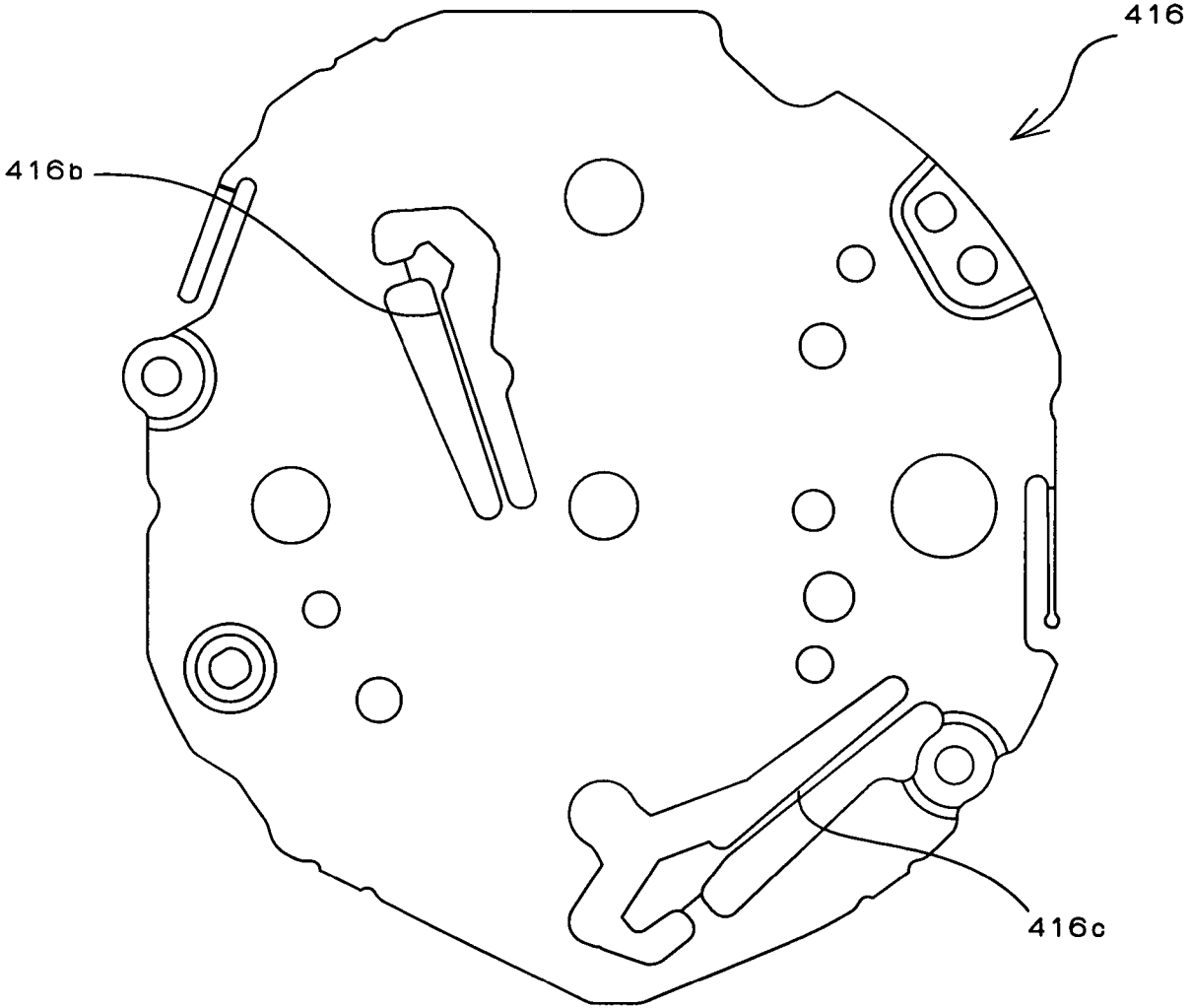
FIG. 31 is a plan view showing a form seen from the upper side of a setting wheel plate according to the third embodiment of the multifunctional watch of the present invention.

Next, the constitution of the setting wheel plate 416 will be described. With reference to FIG. 31, the date jumper 416*b* for setting the position of the rotational direction of the date star 312 is disposed in the setting wheel plate 416. It is preferable that the spring portion of the date jumper 416*b* is aligned in the range between "the twelve o'clock direction" and "the two o'clock direction" (namely, "the twelve to two o'clock range"). It is preferable that the setting portion disposed on the front end of the spring portion of the date jumper 416*b* is aligned in the range between "the one o'clock direction" and "the two o'clock direction" (namely, "the one to two o'clock range").

The day jumper 416*c* for setting the position in the rotational direction of the small day wheel 322 is disposed in the setting wheel plate 416. It is preferable that the spring portion of the day jumper 416*c* is aligned in the range between "the seven o'clock direction" and "the nine o'clock direction" (namely, "the seven to nine o'clock range"). It is preferable that the setting portion disposed on the front end of the spring portion of the day jumper 416*c* is aligned in the range between "the eight o'clock direction" and "the nine o'clock direction" (namely, "the eight to nine o'clock range"). Differently from the above-described first embodiment of the present invention, in order to simplify the manufacturing step, the setting wheel plate 316 is not provided with a further date jumper and a further day jumper to be used for other embodiment of the present invention.

(3.8) Description of Position of Hand and Specification of Hand

The position of the hand and the specification of the hand according to the third embodiment of the present invention are the same as the position of the hand and the specification of the hand according to the above-described first embodiment of the present invention. In other words, with reference to FIG. 10, the position of the hand and the specification of the hand according to the third embodiment of the present invention can constitute the first kind to the fifth kind of the embodiments according to the present invention. Accordingly, the detailed description related to the position of the hand and the specification of the hand according to the third embodiment of the present invention may be understood with reference to the description related to the position of the hand and the specification of the hand according to the first embodiment of the present invention. Therefore, the descriptions thereof are not repeated here and they are omitted here.

(4) Fourth Embodiment

Next, the forth embodiment of the multifunctional watch according to the present invention will be described. In the following explanation, a different point between the forth embodiment of the multifunctional watch according to the present invention and the third embodiment of the multifunctional watch according to the present invention will be mainly described. Accordingly, the above-description with respect to the third embodiment of the multifunctional watch according to the present invention will be applied to the parts not described below.

(4.1) Entire Constitution of Movement

Figure 32:
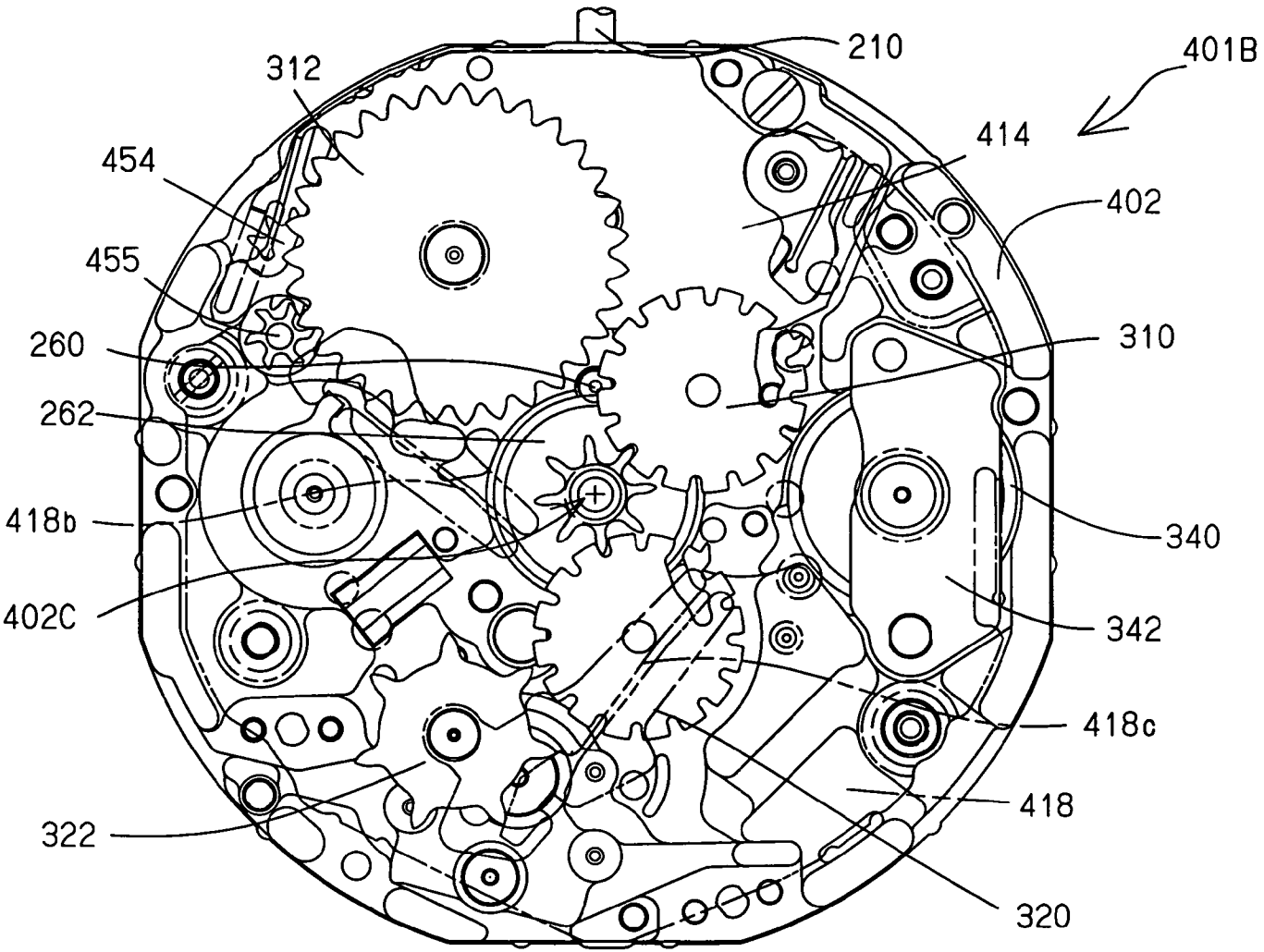
FIG. 32 is a plan view showing a schematic constitution seen from a back side of a movement according to a fourth embodiment of a multifunctional watch of the present invention.
Figure 33:
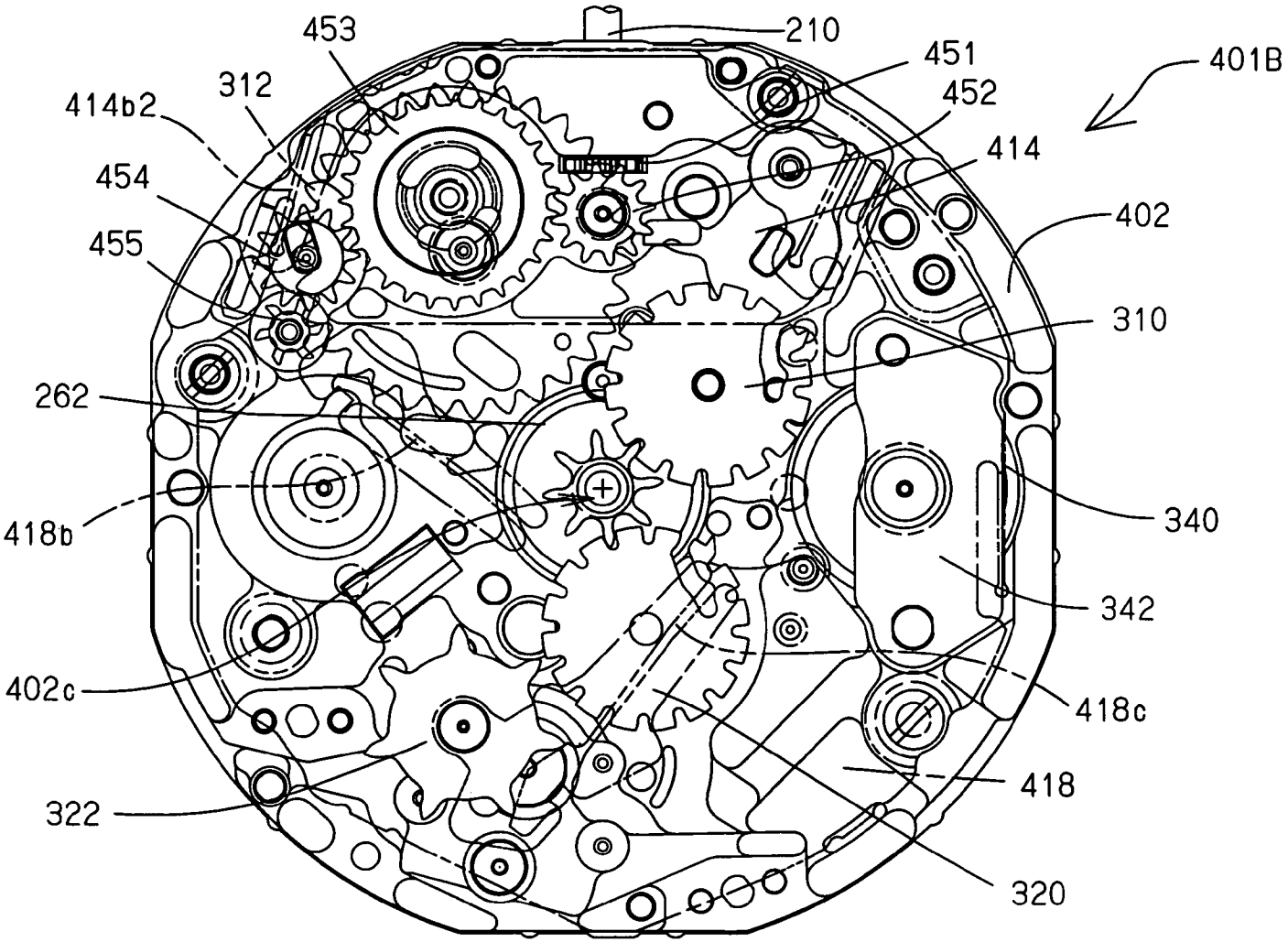
FIG. 33 is a plan view showing a date corrector setting mechanism on the back side of the movement according to the fourth embodiment of the multifunctional watch of the present invention.
Figure 34:
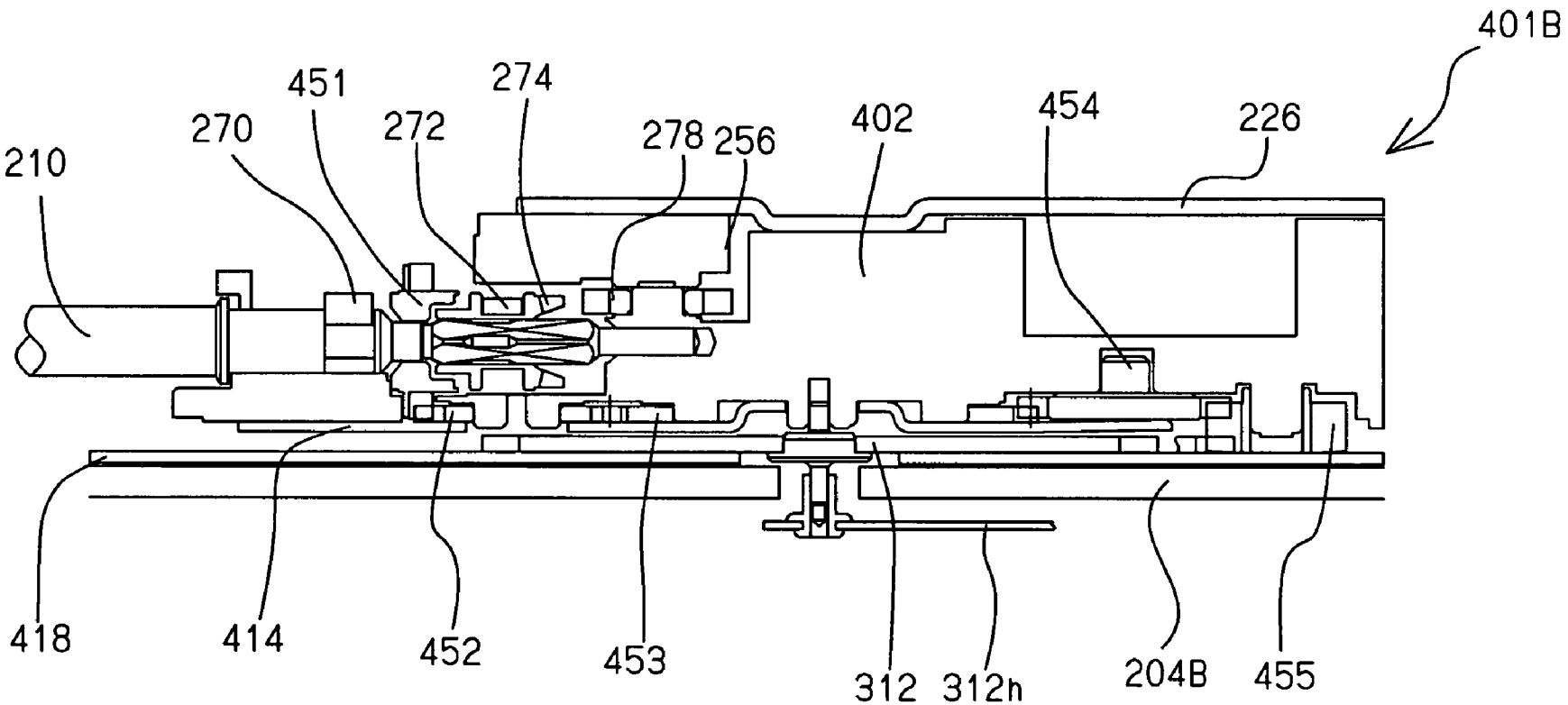
FIG. 34 is a partial cross sectional view showing a part of a hand setting stem and a front train wheel according to the fourth embodiment of the multifunctional watch of the present invention.

With reference to FIG. 32 to FIG. 34, in the fourth embodiment of the multifunctional watch according to the present invention, the movement is formed by an analog electronic watch. More in detail, the fourth embodiment of the multifunctional watch according to the present invention is formed by an analog watch (an electric watch, an electronic watch, and a mechanical watch) having a small hand in at least one place among "a two o'clock direction", "a six o'clock direction", and "a ten o'clock direction". The fourth embodiment of the multifunctional watch according to the present invention can be constituted so that the hour hand, of which rotational center is the center of the main plate, displays the time information related to "hour" of 12-hours; the minute hand, of which rotational center is the center of the main plate, displays the time information related to "minute"; the small second hand, which is aligned in "the six o'clock direction", displays the time information related to "second"; the date hand, which is aligned in "a two o'clock direction", displays the calendar information related to "date"; and the day hand, which is aligned in "a ten o'clock direction", displays the calendar information related to "day"

(4.2) Constitution of Date Display Mechanism

Next, the constitution of a date display mechanism will be described. With reference to FIG. 32 to FIG. 34, the day display mechanism is constituted so as to be operated on the basis of the rotation of the hour wheel 262 in a movement 401B. The day display mechanism includes the date indicator driving wheel 310 and the date star 312. The date indicator driving wheel 310 is constituted so as to be rotated due to the rotation of the hour wheel 262. The lower shaft portion of the date star 312 is supported rotatably for the day star guide hole which is formed on the main plate 402. The date indicator driving wheel 310 is supported so as to be capable of being rotated for a second date star guide hole which is disposed on the main plate 402. The rotational center of the date indicator driving wheel 310 is preferably aligned in the range between "the four o'clock direction" and "the five o'clock direction" (namely, "the four to five o'clock range").

The position in the rotational direction of the date star 312 is set by a date jumper 418*b* which is disposed in a setting wheel plate 418. The shape of the setting plate 418 according to the forth embodiment is different from the shape of the setting wheel plate 416 according to the above-described third embodiment. It is preferable that the setting portion disposed on the front end of the spring portion of the date jumper 418*b* is aligned in the range between "the twelve o'clock direction" and "the one o'clock direction" (namely, "the twelve to one o'clock range"). The rotational center of the date star 312 is aligned in "the two o'clock direction". The lower shaft portion of the date star 312 is supported rotatably for the main plate 402.

With reference to FIG. 34, the center hole of the second date corrector setting operating wheel 452 is supported rotatably for the second date corrector setting operating wheel guide shaft portion disposed on the main plate 402. In the interior part of the second date corrector setting operating wheel guide shaft portion, a date star guide hole for the date star 312 used for the third embodiment of the multifunctional clock according to the present invention is provided. It is possible to form the center axial line of the date star guide hole and the center axial line of the second date corrector setting operating wheel guide shaft portion so as to coincide with each other. The third date corrector setting operating wheel 353 is supported rotatably for the third date corrector setting operating wheel guide shaft portion, which is formed in a ring-shape provided on the main plate 202. In the interior part of the third date corrector setting operating wheel guide shaft portion, a date corrector setting operating wheel cover guide shaft portion is provided. In the interior part of the date corrector setting operating wheel cover guide shaft portion, the date star guide hole of the for the date star 312 used for the fourth embodiment of the multifunctional clock according to the present invention is provided. A part of the date corrector setting operating wheel cover 414 located on the lower part of the date star 312 is narrowed down to a circle toward the back surface of the main plate 402. It is preferable that a hole provided on the center of the circle narrowed-down portion of the date corrector setting operating wheel cover 414 is fitted in the date corrector setting operating wheel cover guide shaft portion which is disposed around the date star guide hole.

(4.3) Constitution of Day Display Mechanism

Next, the constitution of a day display mechanism will be described. With reference to FIG. 32 to FIG. 34, the day display mechanism is constituted so as to be operated on the basis of the rotation of the hour wheel 262 in the movement 401B. The day display mechanism includes the day indicator driving wheel 320 and the small day wheel 322. Due to the rotation of the hour wheel 262, the day display mechanism is constituted so that the day indicator driving wheel 320 is rotated. The day indicator driving wheel 320 is rotatably supported for a second day indicator driving wheel pin which is disposed on the main plate 402. It is preferable that the rotational center of the day indicator driving wheel 320 is aligned in the range between "the eight o'clock direction" and "the nine o'clock direction" (namely, "the eight to nine o'clock range").

The position in the rotational direction of the small day wheel 322 is set by a day jumper 418*c* which is disposed in the setting wheel plate 418. It is preferable that the setting portion disposed on the front end of the spring portion of the day jumper 418*c* is aligned in the range between "the nine o'clock direction" and "the ten o'clock direction" (namely, "the nine to ten o'clock range"). The rotational center of the small day wheel 322 is aligned in "the ten o'clock direction". The lower shaft portion of the small day wheel 322 is supported rotatably for the main plate 402. The day finger 322*h* is attached to the upper shaft portion of the small day wheel 322.

(4.4) Constitution of Date Corrector Setting Mechanism

Next, the constitution of a date corrector setting mechanism will be described. With reference to FIG. 32 to FIG. 34, on the back side of the movement 401B, the date corrector setting mechanism for correcting the display of the date due to the date star 312 is disposed. The date corrector setting mechanism is formed by the first date corrector setting operating wheel 451, the second date corrector setting operating wheel 452, the third date corrector setting operating wheel 453, the fourth date corrector setting operating wheel 454, and the date corrector setting wheel 455. The rotational center of the second date corrector setting operating wheel 352 is aligned in "the three o'clock direction". The rotational center of the second date corrector setting operating wheel 452 according to the fourth embodiment of the multifunctional watch of the present invention can be aligned on the same position as the rotational center of the second date corrector setting operating wheel 352 according to the first embodiment of the multifunctional watch of the present invention.

The third date corrector setting operating wheel 453 is rotatably supported for the main plate 202. It is preferable that the rotational center of the third date corrector setting operating wheel 453 is aligned in "the two o'clock direction" or in the range between "the two o'clock direction" and "the three o'clock direction" (namely, "the two to three o'clock range"). It is preferable that the rotational center of the third date corrector setting operating wheel 453 is aligned on the same position as the rotational center of the date star 312. The center hole of the third date corrector setting operating wheel 453 is aligned rotatably for the outer circumferential part of the third date corrector setting operating wheel guide shaft portion which is disposed on the main plate 402. The lower shaft of the fourth date corrector setting operating wheel 454 is moveably and rotatably supported for the second fourth date corrector setting operating wheel guide long hole which is formed on the main plate 402. It is preferable that the second fourth date corrector setting operating wheel guide long hole for guiding the lower shaft of the fourth date corrector setting operating wheel 454 is aligned in the range between "the one o'clock direction" and "the two o'clock direction" (namely, "the one to two o'clock range"). The second setting spring portion 414*b*2 for applying a pressure on the fourth date corrector setting operating wheel 454 toward the main plate 402 is disposed in the second date corrector setting operating wheel cover 414. It is preferable that the rotational center of the date corrector setting wheel 455 is aligned in "the twelve o'clock direction" or in the range between "the one o'clock direction" and "the four o'clock direction" (namely, "the twelve to one o'clock range").

(4.5) Constitution of Main Plate

Next, with respect to the constitution of the main plate 402, the explanation will be added to the above explanation given to the third embodiment of the multifunctional watch of the present invention. With reference to FIG. 29, the main plate 402 is further provided with rotational centers of rotational members including a rotational center 402 DW2 of the date indicator driving wheel 310 according to the fourth embodiment, a rotational center 402 DS2 of the date star 312 according to the fourth embodiment, a rotational center 402 WT2 of the day indicator driving wheel 320 according to the second embodiment, a rotational center 402 SW2 of the small day wheel 322 according to the second embodiment, and a rotational center 402 SB2 of the date corrector setting wheel 455 according to the second embodiment. It is preferable that the rotational center of the third date corrector setting operating wheel 453 is aligned on the same position as the rotational center 402 DS2 of the date star 312.

Further, the main plate 402 is provided with a second fourth date corrector setting operating wheel guide long hole 402 SL2 for guiding the lower shaft of the fourth date corrector setting operating wheel 454 according to the fourth embodiment so as to be capable of being moved. On each of the above-described rotational centers, a guide shaft portion for guiding a center hole of the rotational member is formed in order to support the rotational member to be rotated centering around the rotational center so as to be capable of being rotated. Alternatively, a guide hole for guiding the shaft portion of the rotational member is formed. In other words, the train wheel guide portion can be formed by a guide hole, a guide bearing, a guide shaft, and a guide pin or the like for guiding the rotational member so as to be capable of being rotated.

The movement 401 is provided with a first train wheel rotational center for a train wheel to be used when manufacturing a first type of a multifunctional watch having the arrangement of a first type of a small hand and a second train wheel rotational center for a train wheel to be used when manufacturing a second type of a multifunctional watch having the arrangement of a second type of a small hand using the movement 401B. On the first train wheel rotational center and the second train wheel rotational center, a train wheel guide portion (a guide hole, a guide bearing, a guide shaft, and a guide pin or the like) is disposed for rotatably guiding the train wheel member to be rotated centering around that position. The first train wheel rotational center and the second train wheel rotational center are aligned on the position between the main plate center 402*c* of the main plate 402 and the main plate outline portion of the main plate 402. As described above, according to the third embodiment and the fourth embodiment of the present invention, the main plate 402 can be used for the movement 401 and also can be used for the movement 401B.

(4.6) Constitution of Date Corrector Setting Transmitting Wheel Cover

Next, with respect to the constitution of the date corrector setting operating wheel cover 414, the explanation will be added to the above explanation given to the third embodiment of the multifunctional watch of the present invention. With reference to FIG. 30, the second setting spring portion 414*b*2 according to the fourth embodiment for applying a pressure on the fourth date corrector setting operating wheel 454 toward the main plate 402 is disposed in the date corrector setting operating wheel cover 414. The setting spring portion 414*b*2 is preferably aligned in the range between "the one o'clock direction" and "the two o'clock direction" (namely, "the one to two o'clock range"). It is preferable that the front end portion bringing the second setting spring portion 414*b*2 into contact with the fourth date corrector setting operating wheel 454 is aligned in the range between "the one o'clock direction" and "the two o'clock direction" (namely, "the one to two o'clock range").

With reference to FIG. 34, a part of the date corrector setting operating wheel cover 414 located on the lower part of the date star 312 is narrowed down to a circle toward the back surface of the main plate 402, and it is preferable that a hole provided on the center of this circle narrowed-down portion is fitted in the date corrector setting operating wheel cover guide shaft portion which is disposed around the date star guide hole. As described above, according to the first embodiment and the second embodiment of the present invention, the date corrector setting operating wheel cover 414 can be used for the movement 401 and also can be used for the movement 401B.

(4.7) Constitution of Setting Wheel Plate

Figure 35:
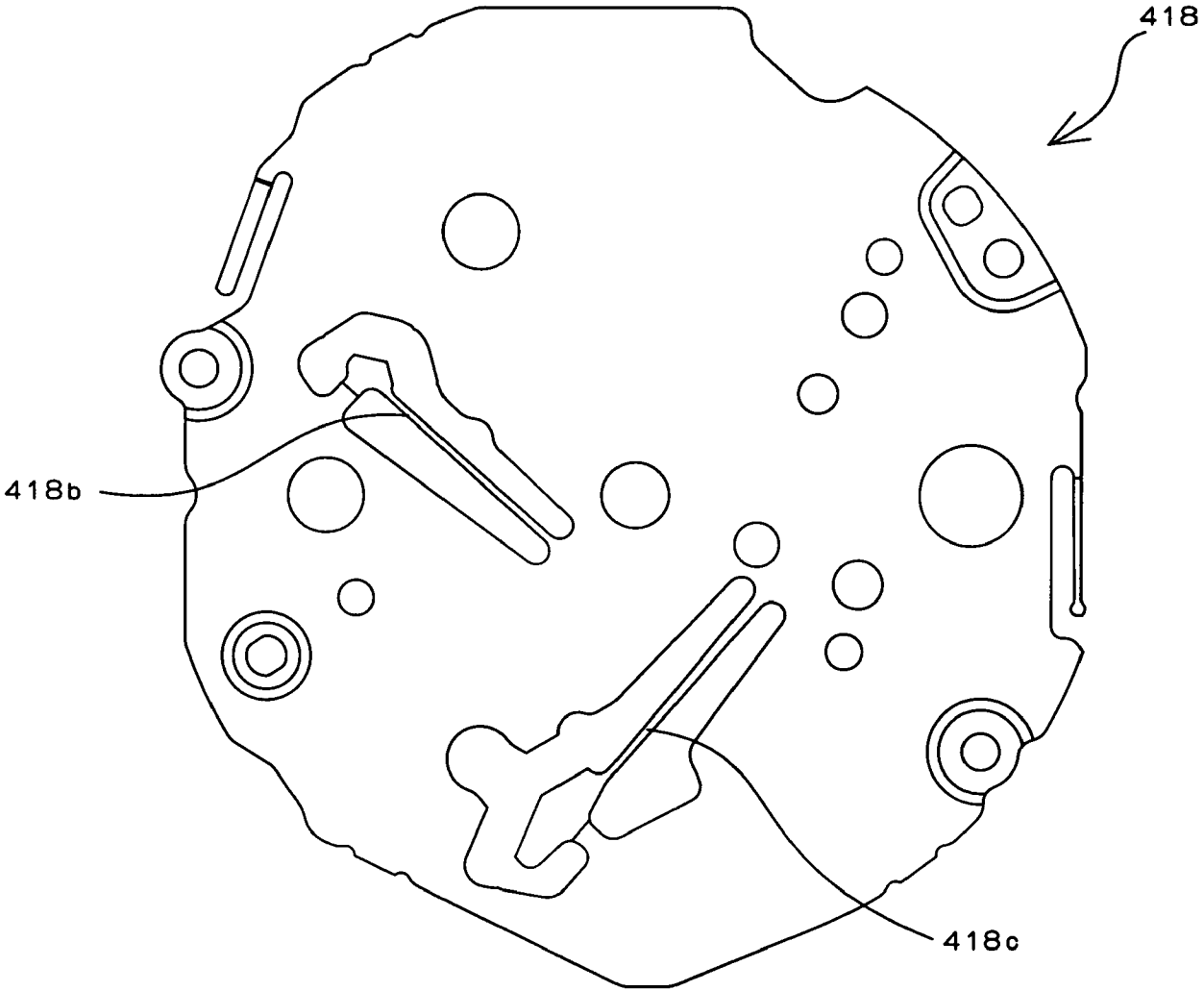
FIG. 35 is a plan view showing a form seen from the upper side of a setting wheel plate according to the fourth embodiment of the multifunctional watch of the present invention.

Next, the constitution of the setting wheel plate 418 will be described. The setting wheel plate 418 to be used for the fourth embodiment of the multifunctional watch according to the present invention is different from the setting wheel plate 316 used for the above-described third embodiment in the date jumper and the day jumper. With reference to FIG. 35, the date jumper 418*b* for setting the position of the rotational direction of the date star 312 according to the fourth embodiment is disposed in the setting wheel plate 418. It is preferable that the spring portion of the date jumper 418*b* is aligned in the range between "the eleven o'clock direction" and "the one o'clock direction" (namely, "the eleven to one o'clock range"). It is preferable that the setting portion disposed on the front end of the spring portion of the date jumper 418*b* is aligned in the range between "the twelve o'clock direction" and "the one o'clock direction" (namely, "the twelve to one o'clock range").

The day jumper 418*c* for setting the position in the rotational direction of the small day wheel 322 according to the fourth embodiment is disposed in the setting wheel plate 418. It is preferable that the spring portion of the day jumper 418*c* is aligned in the range between "the seven o'clock direction" and "the ten o'clock direction" (namely, "the seven to ten o'clock range"). It is preferable that the setting portion disposed on the front end of the spring portion of the day jumper 418*c* is aligned in the range between "the nine o'clock direction" and "the ten o'clock direction" (namely, "the nine to ten o'clock range").

(4.8) Description of Position of Hand and Specification of Hand

The position of the hand and the specification of the hand according to the fourth embodiment of the present invention are the same as the position of the hand and the specification of the hand according to the above-described second embodiment of the present invention. In other words, with reference to FIG. 10, the position of the hand and the specification of the hand according to the fourth embodiment of the present invention can constitute the sixth kind of the embodiment according to the present invention. Accordingly, the detailed description related to the position of the hand and the specification of the hand according to the fourth embodiment of the present invention may be understood with reference to the description related to the position of the hand and the specification of the hand according to the second embodiment of the present invention. Therefore, the descriptions thereof are not repeated here and they are omitted here.

(5) Fifth Embodiment

Next, the fifth embodiment of the multifunctional watch according to the present invention will be described. In the following explanation, a different point between the fifth embodiment of the multifunctional watch according to the present invention and the first embodiment of the multifunctional watch according to the present invention will be mainly described. Accordingly, the above-description with respect to the first embodiment of the multifunctional watch according to the present invention will be applied to the parts not described below. The fifth embodiment of the multifunctional watch according to the present invention is different from the first embodiment of the multifunctional watch according to the present invention in the day display mechanism. In other words, the fifth embodiment of the multifunctional watch according to the present invention is characterized by being provided with a day hand of a so-called "retrograde type", which can be moved in a fan-like form.

(5.1) Entire Constitution of Movement

Figure 36:
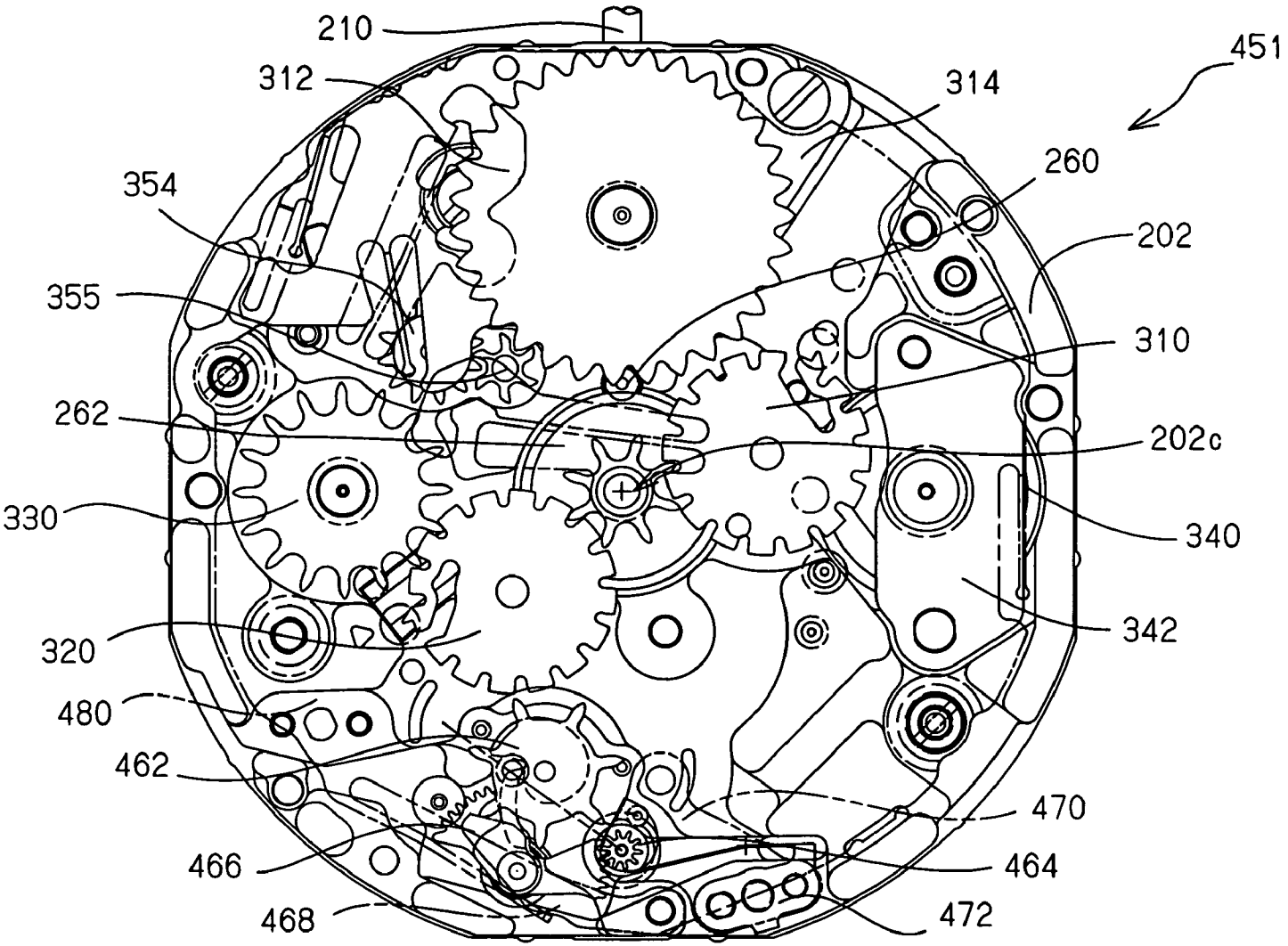
FIG. 36 is a plan view showing a schematic constitution seen from a back side of a movement according to a fifth embodiment of a multifunctional watch of the present invention.
Figure 37:
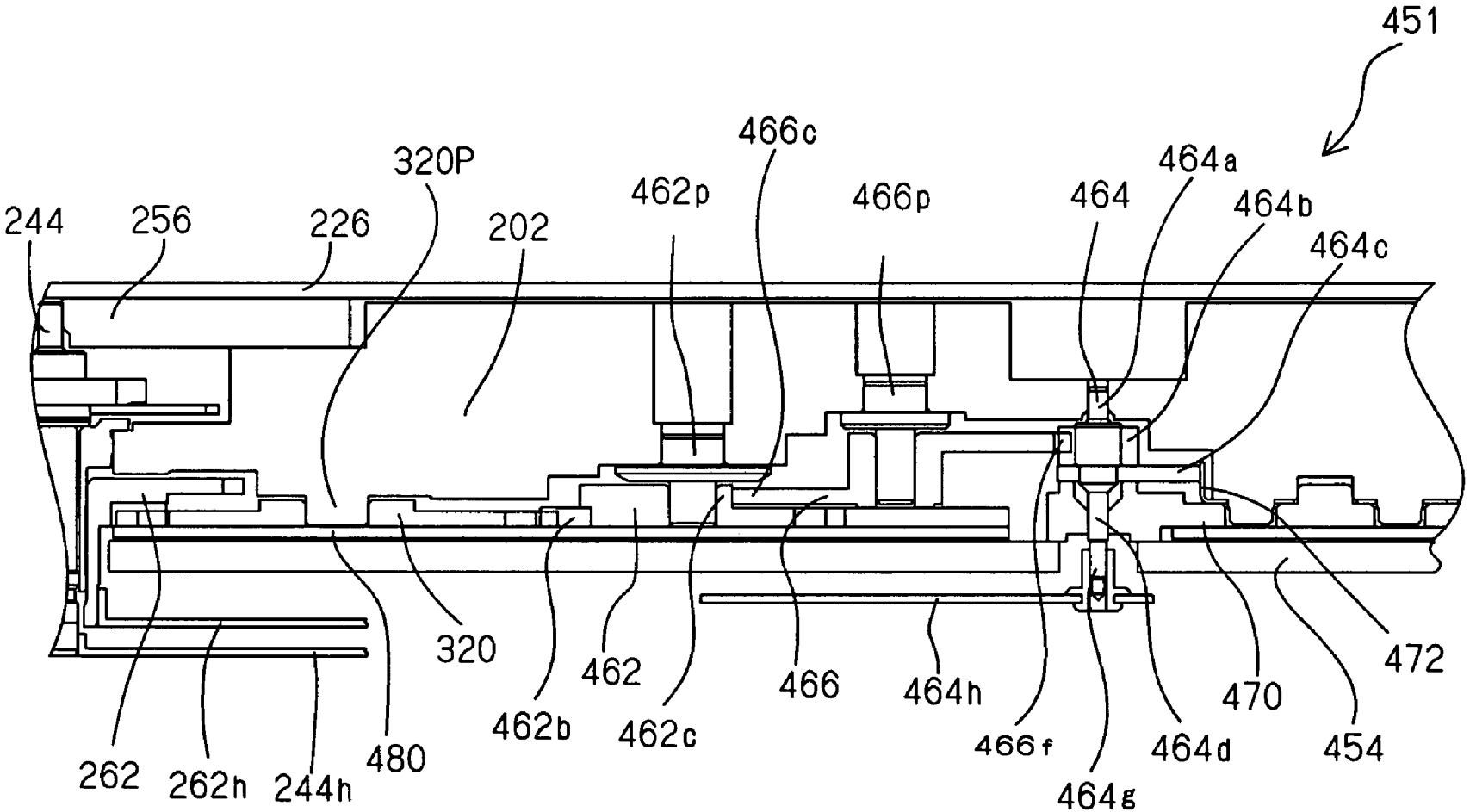
FIG. 37 is a partial sectional view showing a constitution of a day mechanism according to the fifth embodiment of a multifunctional watch of the present invention.
Figure 38:
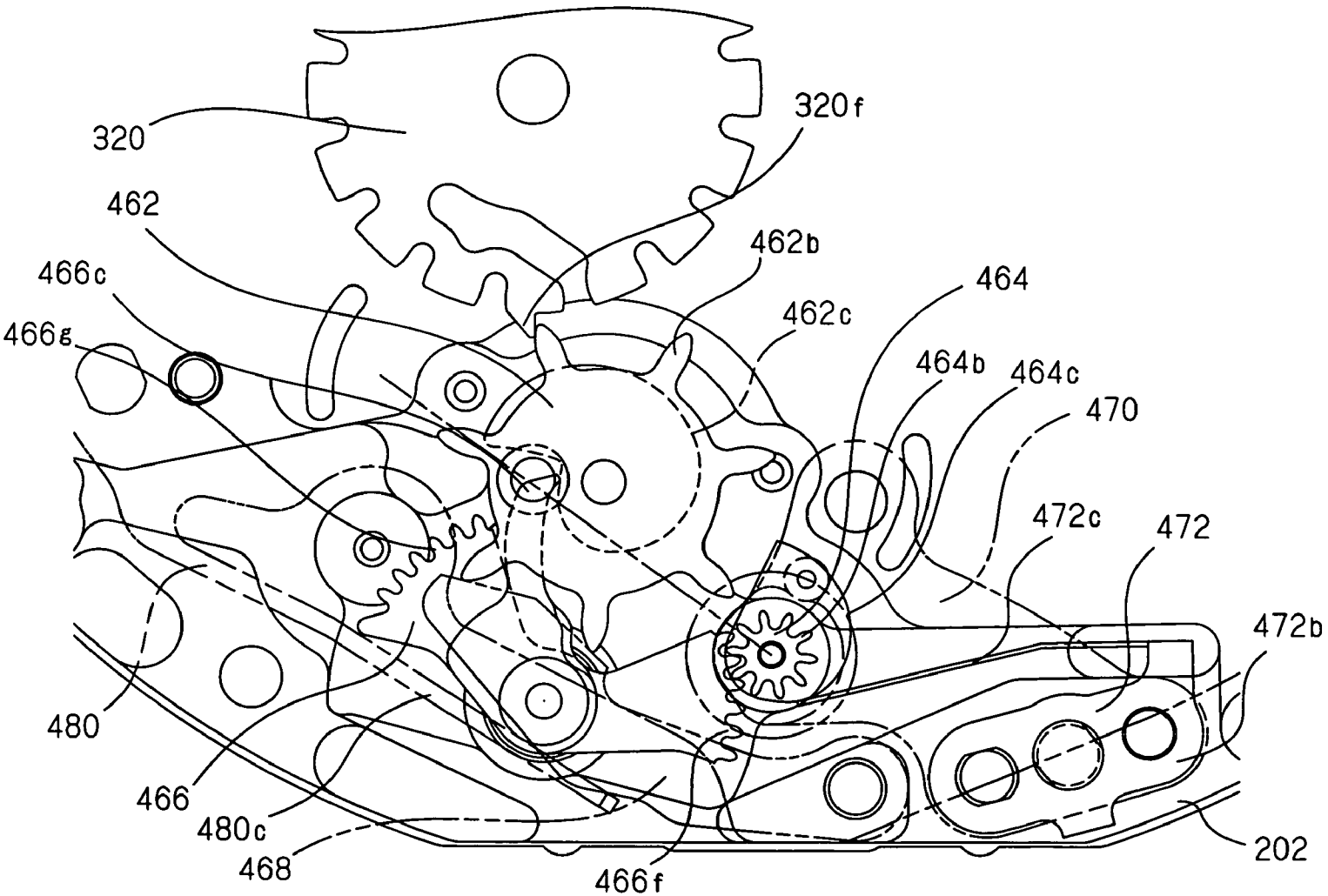
FIG. 38 is an enlarged partial plan view showing the constitution of the day mechanism in the state of displaying Sunday according to the fifth embodiment of a multifunctional watch of the present invention.

With reference to FIG. 36 to FIG. 38, in the fifth embodiment of the multifunctional watch according to the present invention, the movement is formed by an analog electronic watch. More in detail, the fifth embodiment of the multifunctional watch according to the present invention is formed by an analog watch (an electric watch, an electronic watch, and a mechanical watch) having a small hand in at least one place among "the three o'clock direction", "the six o'clock direction", and "the twelve o'clock direction" and further having a small hand which can be moved in "the nine o'clock direction" in a fan-like form. In other words, the fifth embodiment of the multifunctional watch according to the present invention can be constituted so that the hour hand, of which rotational center is the center of the main plate, displays the time information related to "hour" of 12-hours; the minute hand, of which rotational center is the center of the main plate, displays the time information related to "minute"; the 24 hour hand, of which rotational center is located in "the twelve o'clock direction", displays the time information related to "hour" of 24-hours; the date hand, which is aligned in "a three o'clock direction", displays the calendar information related to "date"; the small second hand, which is aligned in "the six o'clock direction", displays the time information related to "second"; and the day hand, of which rotational center is aligned in "a nine o'clock direction" and can be moved in a fan-like form, namely, a so-called "retrograde type", displays the calendar information related to "day".

(5.2) Constitution of Day Display Mechanism

Next, the constitution of a day display mechanism will be described. With reference to FIG. 36 to FIG. 38, the day display mechanism is constituted so as to be operated on the basis of the rotation of the hour wheel 262. The day display mechanism includes the day indicator driving wheel 320, a day operating wheel 462, a small day wheel 464, a hammer lever 466, a day jumper 468, and a day return spring 472. Due to the rotation of the hour wheel 262, the day display mechanism is constituted so that the day indicator driving wheel 320 is rotated. The day indicator driving wheel 320 is rotatably supported for a day indicator driving wheel pin 320*p* which is disposed on the main plate 202. It is preferable that the rotational center of the day indicator driving wheel 320 is aligned in the range between "the ten o'clock direction" and "the eleven o'clock direction" (namely, "the ten to eleven o'clock range").

The day indicator driving wheel 320 includes a day tooth 320*b* and a day finger 320*f*. The date pinion 262*c* of the hour wheel 262 is constituted so as to be engaged with the day tooth 320*b* of the day indicator driving wheel 320. The day operating wheel 462 is supported rotatably for a day operating wheel pin 462*p* disposed on the main plate 202. The day operating wheel 462 is provided with a day operating gear portion 462*b* and an operating cam portion 462*c*. The operating cam portion 462*c* includes an operating outline portion which is formed so that a distance from the center axial line of the day operating wheel 462 (namely, a cam radius) is gradually increased. The radius of the outputting cam outline portion is formed so as to be smoothly increased from its minimum value RMIN to its maximum value RMAX along the circumferential direction of the operating cam outer circumferential portion. Then, a step portion where the radius of the operating cam outer circumferential portion is rapidly changed is aligned between the place where the radius of the outputting cam outer circumferential portion takes the maximum value RMAX and the place where the radius of the cam outline portion takes the minimum value RMIN. In other words, the outputting cam outer circumferential portion has the outline form stretching out evenly in a spiral form from the minimum radial portion nearest from the rotational center of the operating outline portion to the maximum radial portion of the operating cam outline portion where the place where the radius of the outputting cam outer circumferential portion takes the maximum value RMAX is connected to the place where the radius of the cam outline portion takes the minimum value RMIN. As a result, the outputting cam outer circumferential portion takes a form similar to a cam face of a so-called "oscillation cam". In other words, such a form of the outputting cam outer circumferential portion can be formed by, for example, "Archimedean ($R=r+a\theta$)". By forming the outputting cam outer circumferential portion in this way, the member brought into contact with the outputting cam outer circumferential portion is allowed to be smoothly operated.

The day operating gear portion 462*b* is aligned on the side near the dial 454 rather the operating cam portion 462*c*. The day operating gear portion 462*b* of the day operating wheel 462 is provided with seven teeth. When the day finger 320*f*, which is disposed on the day indicator driving wheel 320, rotates the day operating gear portion 462*b* of the day operating wheel 462, the day operating wheel 462 is constituted so as to be rotated once for a day (1/7). Accordingly, the day operating wheel 462 is constituted so as to be rotated 360 degrees for seven days. It is preferable that the rotational center of the day operating wheel 462 is aligned on the range between "the nine o'clock direction" and "the ten o'clock direction" (namely, "the nine to ten o'clock range"). The small day wheel 464 includes a lower shaft portion 464*a*, a day gear portion 464*b*, a return cam portion 464*c*, an upper shaft portion 464*d*, and a hand attaching portion 464*g*. The return cam portion 464*c* includes a return cam outline portion which is formed so that a distance from the center axial line of the small day wheel 464 (namely, the cam radius) is gradually increased. The return cam outline portion is formed so as to make a well-known heart cam curved line. The lower shaft portion of the small day wheel 464 is supported rotatably for the main plate 202. The upper shaft portion 464*d* of the small day wheel 464 is supported rotatably for a small date bearing 470. A date hand 464*h* is attached to the hand attaching portion 464*g* of the small day wheel 464.

The day return spring 472 includes a base portion 472*b* which is fixed to the main plate 202 and a return spring portion 472*c* which is formed so as to suppress the return cam portion 464*c* of the small day wheel 464. The day return spring 472 is a platy member which is formed by an elastic material such as a stainless steel and a phosphor bronze. The front end portion of the day return spring 472*c* is formed so as to be brought into contact with the cam outline portion of the return cam portion 464*c*. The force to suppress the cam outline portion of the return cam portion 464*c* by the front end portion of the return spring portion 472*c* is directed to the place which is decentered from the rotational center of the small day wheel 464. Accordingly, the day return spring 472 is constituted so as to generate a rotational moment for rotating the small day wheel 464 by a rotation torque determined as a value where the decentered distance from the rotational center of the small day wheel 464 to the decentered place is multiplied with the suppressing force. It is preferable that the return spring portion 472*c* of the day return spring 472 is aligned on the range between "the eight o'clock" and "the nine o'clock" (namely, "the eight to nine o'clock range").

The position in the rotational direction of the day operating wheel 462 is constituted so as to be set by the day jumper 468 which is disposed rotatably for the main plate 202. A day jumper pressure spring portion 480*c* disposed in a setting wheel plate 480 is constituted so as to suppress the setting portion disposed on the front end of the day jumper 468 toward the day operating gear portion 462*b* of the day operating wheel 462. It is preferable that the position of the setting portion disposed on the front end of the day jumper 468 is aligned in the range between "the nine o'clock direction" and "the ten o'clock direction" (namely, "the nine to ten o'clock range"). It is preferable that the position of the day jumper pressure spring portion 480*c* is aligned in the range between "the nine o'clock direction" and "the eleven o'clock direction" (namely, "the nine to eleven o'clock range").

The hammer lever 466 is supported rotatably for a hammer lever pin 466*p* which is disposed on the main plate 202. It is preferable that the position of the hammer lever 466 is aligned in the range between "the nine o'clock direction" and "the ten o'clock direction" (namely, "the nine to ten o'clock range"). The hammer lever 466 is provided with a cam contact portion 466*c* which is constituted so as to be brought into contact with the operating cam portion 462*c*, a first operational gear portion 466*f* and a second operational gear portion 466*g* which are constituted so as to be engaged with the day gear portion 464*b*. The second operational gear portion 466*g* is disposed so that it can be engaged with the day gear portion 464*b* of the small day wheel 464. Particularly, with reference to FIG. 38, the small day wheel 464 is constituted so as to always receive the force whereby it is rotated in a counterclockwise direction due to the spring force of the return spring portion 472*c*. As a result, the hammer lever 466 is constituted so as to receive the force whereby it is always rotated in a clockwise direction. Accordingly, the front end portion of the cam contact portion 466*c* of the hammer lever 466 is constituted so as to always receive the force whereby it is suppressed against the operating cam portion 462*c* of the day operating wheel 462.

The rotational center of the small day wheel 464 is aligned in "the nine o'clock direction". The day gear portion 464*b* and the return cam portion 464*c* of the small day wheel 464 are aligned between the main plate 202 and the small date bearing 470. The day character, the numeral, and abbreviation or the like for displaying the day are provided on a dial 454. Particularly, with reference to FIG. 44, the dial 454 is constituted so as to be able to display the information related to "day" which is one of the calendar information by the day hand 464*h* which can be moved in a fan-like form and the character, the numeral, and the abbreviation or the like of the dial 454.

(5.3) Constitution of Main Plate

Next, with respect to the constitution of the main plate 202, the explanation will be added to the above explanation given to the first and second embodiments of the multifunctional watch of the present invention. With reference to FIG. 7, the main plate 202 is further provided with a rotational center 202 WD of the day operating wheel 462 according to the fifth embodiment, a rotational center 202 WF of the hammer lever 466 according to the fifth embodiment, a rotational center 202 WT2 of the day indicator driving wheel 320 according to the fifth embodiment, and a rotational center 202 WG of the small day wheel 464 according to the fifth embodiment. It is possible to align the rotational center of the day indicator driving wheel 320 according to the fifth embodiment on the same position as the rotational center 202 WT2 of the day indicator driving wheel 320 according to the first embodiment. On each of the above-described rotational centers, in order to support the rotational member to be rotated centering around this rotational member so as to be capable of being rotated, a guide shaft portion for guiding the center hole of this rotational member or a guide hole for guiding the shaft portion of this rotational member is formed. In other words, a train wheel guide portion can be formed by a guide hole, a guide bearing, a guide shaft, and a guide pin or the like for rotatably guiding the rotational member.

In other words, the main plate 202 is provided with the center pipe 202*b* aligned on the main plate center 202*c*, the lower bearing of the rotor 236, the lower bearing of the fifth wheel and pinion 238, the lower bearing of the fourth wheel and pinion 240, the lower bearing of the third wheel and pinion 242, the lower bearing of the minute wheel 260, the guide pin of the setting wheel 278, the guide pin of the date indicator driving wheel 310, the guide pin of the date star 312, the guide pin of the day indicator driving wheel 320, the lower bearing of the small day wheel 322, the lower bearing of the hour wheel 330, the lower bearing of the second wheel 340, the guide pin of the third date corrector setting operating wheel 353, the guide pin of the date corrector setting wheel 355, the guide pin of the day operating wheel 462, the guide pin of the hammer lever 466, and the guide pin of the small day wheel 464. For example, the above-described bearing can be formed by a hole jewel, a tenon frame, a through hole, and a blind hole or the like. For example, the guide pin may be formed integrally with the main plate 202 or the guide pin which is separately formed from the main plate 202 can be fixed to the main plate 202. Alternatively, in place of the above-described bearing, the guide member such as a pin can be also used. Alternatively, in place of the above-described guide pin, the guide member such as the hole jewel, the tenon frame, the through hole, and the blind hole or the like can be also used.

The movement 201, the movement 201B, and the movement 451 are provided with a first train wheel rotational center for a train wheel to be used when manufacturing a first type of a multifunctional watch having the arrangement of a first type of a small hand, a second train wheel rotational center for a train wheel to be used when manufacturing a second type of a multifunctional watch having the arrangement of a second type of a small hand, and a third train wheel rotational center for a train wheel to be used when manufacturing a third type of a multifunctional watch having the arrangement of a third type of a small hand. On the first train wheel rotational center, the second train wheel rotational center, and the third train wheel rotational center, the train wheel guide portion (a guide hole, a guide bearing, a guide shaft, and a guide pin or the like) is disposed for rotatably guiding the train wheel member to be rotated centering around that position. The first train wheel rotational center, the second train wheel rotational center, and the third train wheel rotational center are aligned on the position between the main plate center 202*c* of the main plate 202 and the main plate outline portion of the main plate 202. As described above, according to the first embodiment, the second embodiment, and the fifth embodiment of the present invention, the main plate 202 can be used for the movement 201, also for the movement 201B, and further for the movement 451.

(5.4) Constitution of Setting Wheel Plate

Figure 41:
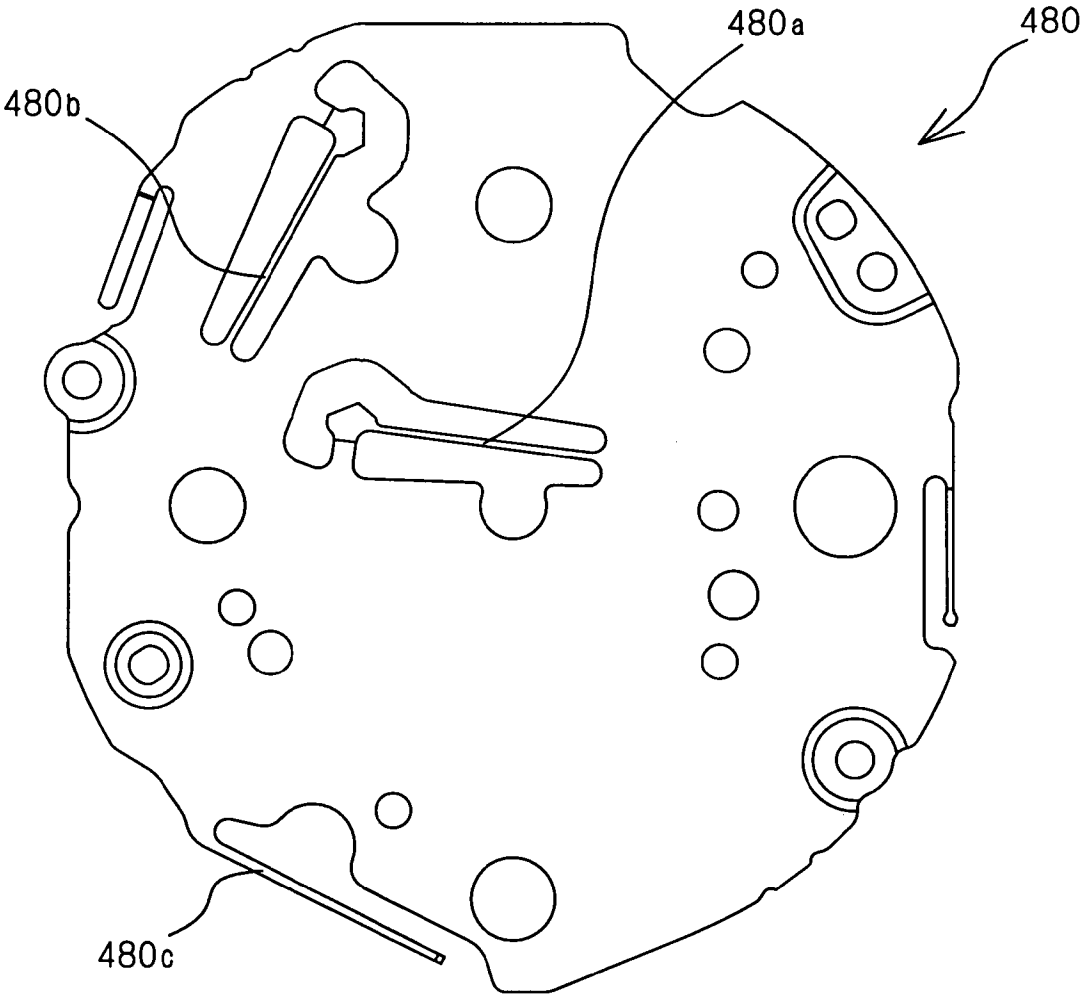
FIG. 41 is a plan view showing a form seen from the upper side of a setting wheel plate according to the fifth embodiment of the multifunctional watch of the present invention.

Next, the constitution of the setting wheel plate 480 will be described. The setting wheel plate 480 to be used for the fifth embodiment of the multifunctional watch according to the present invention is different from the setting wheel plate 316 used for the above-described first embodiment in the date jumper and the day jumper. With reference to FIG. 41, the setting wheel plate 480 includes a first date jumper 480*a* for setting the position of the rotational direction of the date star 312 according to the first embodiment, a second date jumper 480*b* for setting the position of the rotational direction of the date star 312 according to the second embodiment, and the day jumper pressure spring portion 480*c* for suppressing the setting portion disposed on the front end of the day jumper 316*c* according to the fifth embodiment toward the day operating gear portion 462*b* of the day operating wheel 462.

It is preferable that the spring portion of the first date jumper 480*a* is aligned in the range between "the two o'clock direction" and "the six o'clock direction" (namely, "the two to six o'clock range"). It is preferable that the setting portion disposed on the front end of the spring portion of the first date jumper 480*a* is aligned in the range between "the one o'clock direction" and "the three o'clock direction" (namely, "the one to three o'clock range"). It is preferable that the front end of the spring portion of the second date jumper 480*b* is aligned in the range between "the eleven o'clock direction" and "the one o'clock direction" (namely, "the eleven to one o'clock range"). It is preferable that the setting portion disposed on the front end of the second date jumper 480*b* is aligned in the range between "the twelve o'clock direction" and "the one o'clock direction" (namely, "the twelve to one o'clock range"). It is preferable that the position of the day jumper pressure spring portion 480*c* is aligned in the range between "the nine o'clock direction" and "the eleven o'clock direction" (namely, "the nine to eleven o'clock range").

Figure 42:
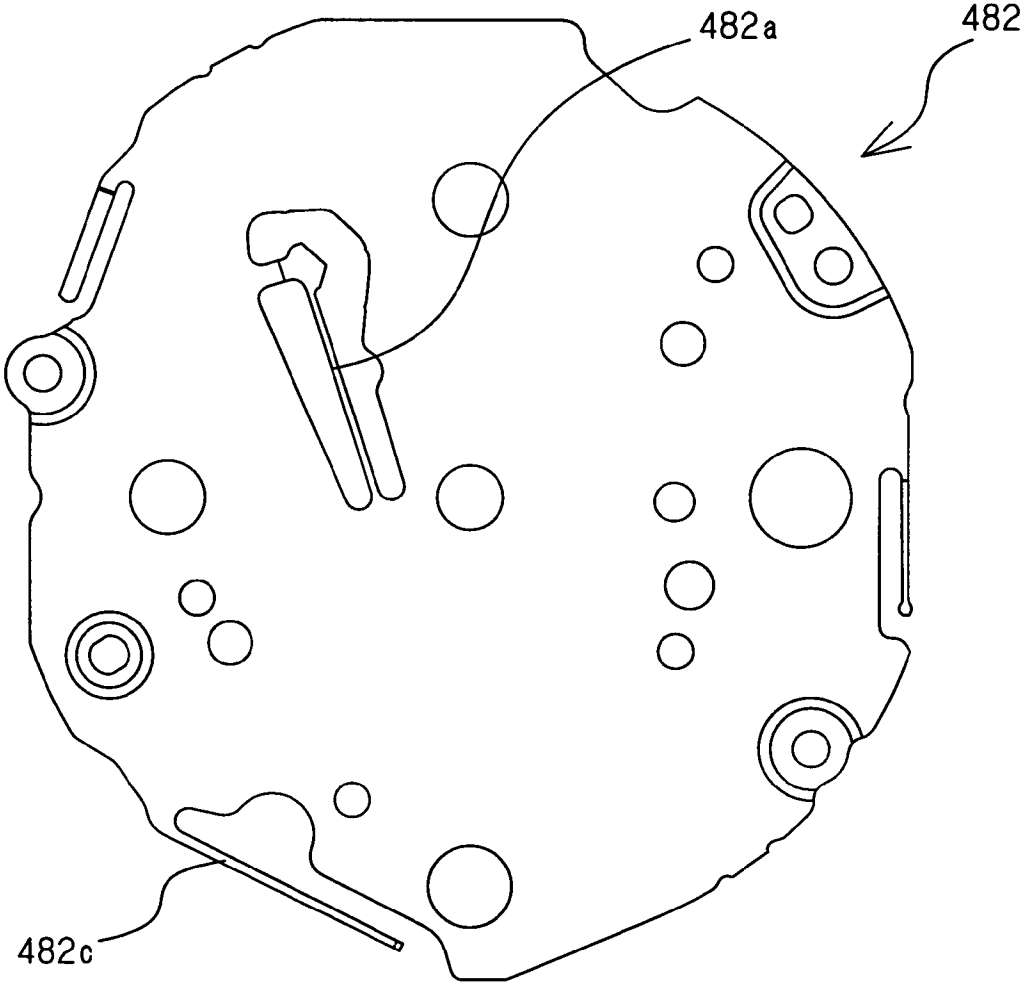
FIG. 42 is a plan view showing a form seen from the upper side of a setting wheel plate according to a modified example of the fifth embodiment of the multifunctional watch of the present invention.

With reference to FIG. 42 as a modified example, a setting wheel plate 482 includes a date jumper 482*a* for setting the position in the rotational direction of the date star 312 according to the first embodiment and a day jumper pressure spring portion 482*c* for suppressing the setting portion disposed on the front end of the day jumper 316*c* according to the fifth embodiment toward the day operating gear portion 462*b* of the day operating wheel 462. The setting wheel plate 482 which is constituted as described above cannot be used for the above-described second embodiment. It is preferable that the spring portion of the date jumper 482*a* is aligned in the range between "the twelve o'clock direction" and "the two o'clock direction" (namely, "the twelve to two o'clock range"). It is preferable that the spring portion disposed on the front end of the spring portion of the date jumper 482*a* is aligned in the range between "the one o'clock direction" and "the two o'clock direction" (namely, "the one to two o'clock range").

(5.5) Operation of Day Mechanism or the Like

The operation of a day mechanism according to the fifth embodiment of the multifunctional watch of the present invention will be described below. With reference to FIG. 36 to FIG. 38, under the state that "Sun" representing "Sunday" is indicated by means of the date hand 464*h* and the character, the numeral, and the abbreviation of the dial 454 or the like, the day indicator driving wheel 320 is rotated due to the rotation of the hour wheel 262. When the day finger 320*f* which is disposed in the day indicator driving wheel 320 rotates the day operating gear portion 462*b* of the day operating wheel 462, the day operating wheel 462 is rotated once for a day (1/7). The front end portion of the return spring portion 472*c* is brought into contact, with the part near the minimum radius of the cam outline portion of the return cam portion 464*c* by rotating the return cam portion 464*c* of the small day wheel 464. The position in the rotational direction of the day operating wheel 462 is set by the day jumper 316*c* which is disposed rotatably for the main plate 202. The day jumper pressure spring portion 480*c* which is disposed in the setting wheel plate 316 suppresses the setting portion disposed on the front end of the day jumper 316*c* toward the day operating gear portion 462*b* of the day operating wheel 462. The cam contact portion 466*c* of the hammer lever 466 is brought into contact with the operating cam portion 462*c* of day operating wheel 462. The first operational gear portion 466*f* of the hammer lever 466 is engaged with the day gear portion 464*b* of the small day wheel 464. The return spring portion 472*c* of the day return spring 472 causes the return cam portion 464*c* of the small day wheel 464 to be brought into contact with the part nearest from the minimum radius of the cam outline portion of the small day wheel 464. The small day wheel 464 always receives whereby it is rotated in a counterclockwise direction due to the spring force of the return spring portion 472*c*. The hammer lever 466 always receives a force whereby it is rotated in a clockwise direction. The front end of the cam contact portion 466*c* of the hammer lever 466 always receives the force whereby it is suppressed against the operating cam portion 462*c* of the day operating wheel 462.

Figure 39:
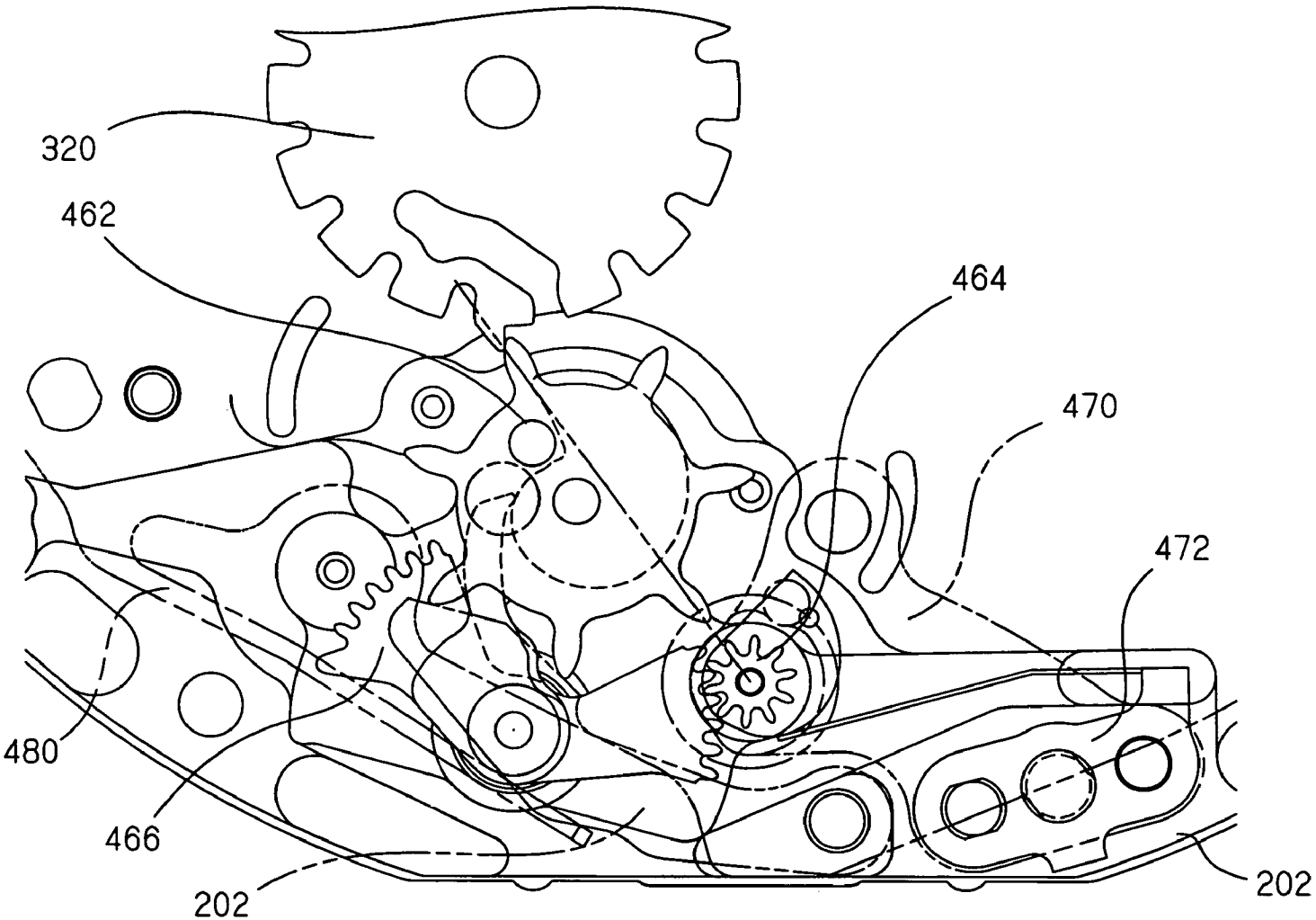
FIG. 39 is an enlarged partial plan view showing the constitution of the day mechanism in the state of displaying Monday according to the fifth embodiment of a multifunctional watch of the present invention.

Next, with reference to FIG. 39, under the state that "Sun" representing "Sunday" is indicated by means of the small day wheel 464, the front end portion of the cam contact portion 466*c* of the hammer lever 466 is suppressed against the part near from the minimum radial portion in the operating cam portion 462*c* of day operating wheel 462. When the day finger 320*f* rotates the day operating gear portion 462*b* of the day operating wheel 462 for one day, namely, (1/7) due to the rotation of the rotation of the hour wheel 262 from the state of indicating "Sun" representing "Sunday" shown in FIG. 38, the front end portion of the return spring portion 472*c* is brought into contact with the position where the radius is increased as being rotated from the minimum radius of the cam outline portion of the return cam portion 464*c*. The position in the rotational direction of the day operating wheel 462 is set by the day jumper 316*c* which is disposed rotatably for the main plate 202. The first operational gear portion 466*f* of the hammer lever 466 rotates the small day wheel 464 for one day so as to indicate "Mon" representing "Monday". The return spring portion 472*c* of the day return spring 472 is brought into contact with the position where the radius is increased by rotating the return cam portion 464*c* of the small day wheel 464 from the minimum radius of the cam outline portion of the return cam portion 464*c* of the small day wheel 464. The small day wheel 464 always receives whereby it is rotated in a counterclockwise direction due to the spring force of the return spring portion 472*c*. The hammer lever 466 always receives a force whereby it is rotated in a clockwise direction. The front end of the cam contact portion 466*c* of the hammer lever 466 always receives the force whereby it is suppressed against the operating cam portion 462*c* of the day operating wheel 462. In the same way, the small day wheel 464 is rotated for one day every day so as to be capable of being changed to indicate "Tue" representing "Tuesday" from the state of indicating "Mon" representing "Monday", and then, indicate "Wed" representing "Wednesday", "Thu" representing "Thursday", "Fri" representing "Friday", "Sat" representing "Saturday", and "Sun" representing "Sunday".

Figure 40:
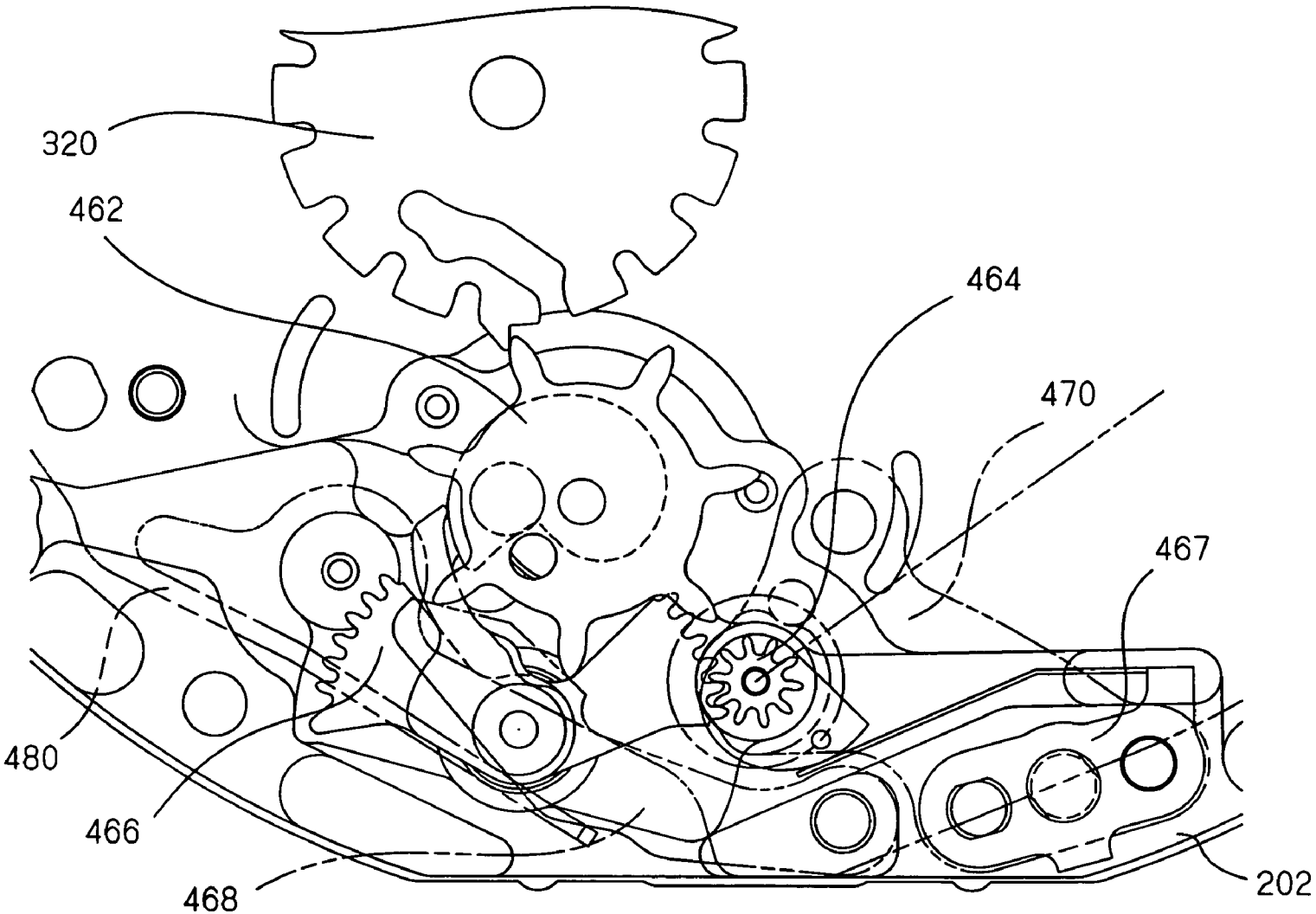
FIG. 40 is an enlarged partial plan view showing the constitution of the day mechanism in the state of displaying Saturday according to the fifth embodiment of a multifunctional watch of the present invention.

With reference to FIG. 40, in the state of indicating "Sat" representing "Saturday", the front end portion of the return spring portion 472*c* is brought into contact with the position nearest from the maximum radius of the cam outline portion of the of the return cam portion 464*c*. The return spring portion 472*c* of the day return spring 472 is brought into contact with the position nearest from the maximum radius of the cam outline portion of the of the small day wheel 464 by rotating the return cam portion 464*c* of the small day wheel 464. When the day finger 320*f* rotates the day operating gear portion 462*b* of the day operating wheel 462 for one day, namely, (1/7) due to the rotation of the rotation of the hour wheel 262 from the state of indicating "Sat" representing "Saturday", the front end of the cam contact portion 466*c* of the hammer lever 466 is moved from the portion nearest from the maximum radius portion in the operating cam portion 462*c* of the day operating wheel 462 to be suppressed against the portion near from the minimum radius portion in the operating cam portion 462*c* of the day operating wheel 462. In addition, the front end portion of the return spring portion 472*c* of the day return spring 472 is brought into contact with from the position nearest from the maximum radius of the cam outline portion of the small day wheel 464 to the position nearest from the minimum radius of the cam outline portion of the small day wheel 464 by rotating the return cam portion 464*c* of the small day wheel 464.

(5.6) Description of Position of Hand and Specification of Hand

Figure 43:
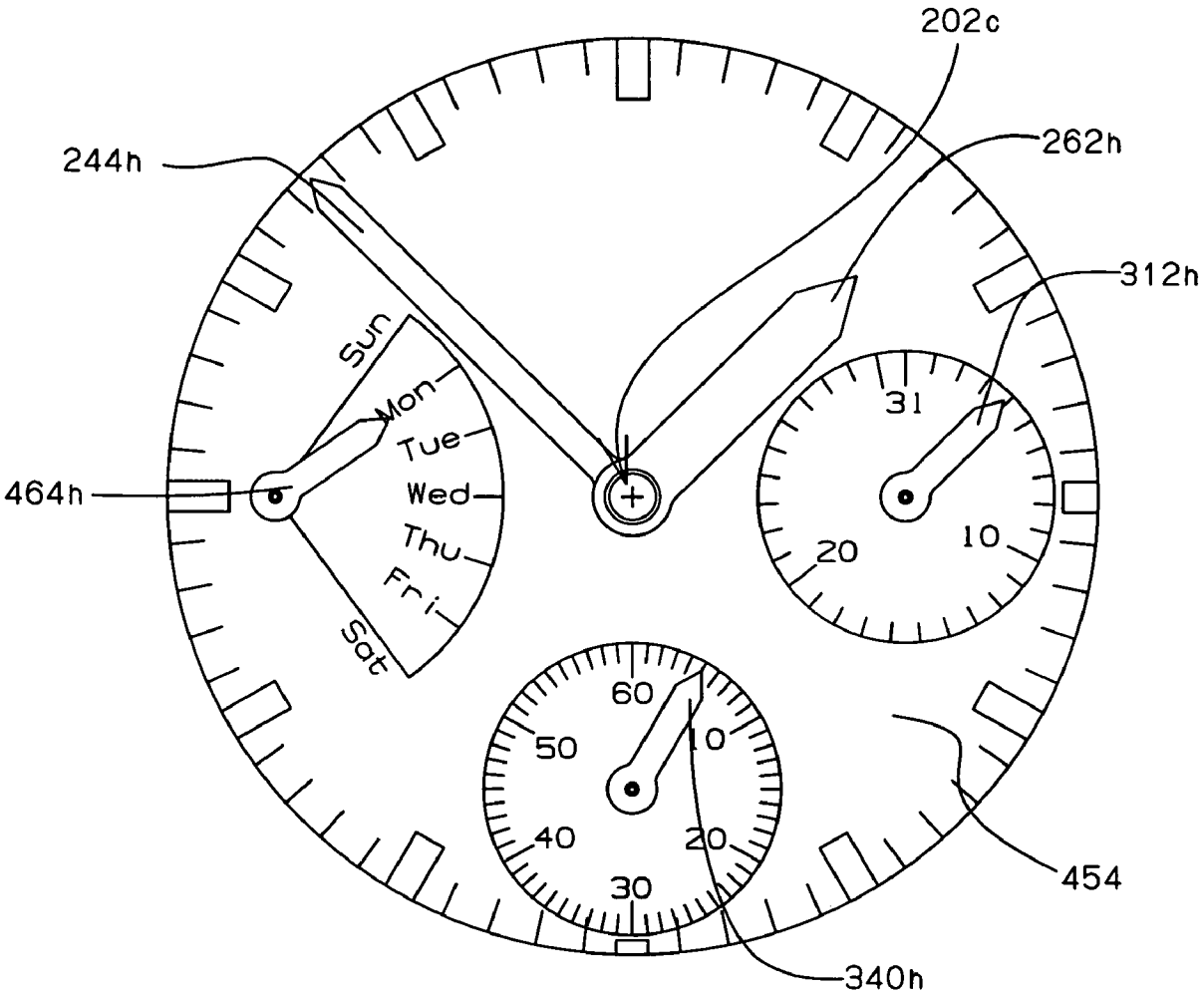
FIG. 43 is a plan view showing a part of a dial of a complete provided with three small hands and a hand according to the fifth embodiment of the multifunctional watch of the present invention.

With reference to FIG. 10 and FIG. 43, according to the seventh kind of the embodiment according to the present invention, it is possible to display the time information related to "hour" of 12-hours by the hour hand 262*h* attached to the hour wheel 262, of which rotational center is the main plate center 202*c*, display the time information related to "minute" by the minute hand 244*h* attached to the second wheel and pinion 244, of which rotational center is the main plate center 202*c*, display the time information related to "second" by a small second hand 340*h* attached to the second wheel 340, of which rotational center is aligned in "the six o'clock direction", display the calendar information related to "date" by the date hand 312*h* attached to the date star 312, of which rotational center is aligned in "the three o'clock direction", and display the calendar information related to "day" by the day hand 464*h*, which is attached to the small day wheel 464 capable of being moved in a fan-like form, of which rotational center is aligned in "the nine o'clock direction", namely, a so-called "retrograde type". For example, the day hand 464*h* can display the calendar information related to "day" within the range of 90 degrees to 160 degrees. In view of allowance of the design of the component and a design property of the day display, it is preferable that the day hand 464*h* displays the calendar information related to "day" within the range of 100 degrees to 120 degrees.

It is preferable that a distance from the main plate center 202*c* to the rotational center of the date hand 312*h*, a distance from the main plate center 202*c* to the rotational center of the small second hand 340*h*, and a distance from the main plate center 202*c* to the 24 hour hand 330*h* are constituted so as to be equal each other. However, the above-described inter-center distances may be also constituted so as not to be equal each other. It is preferable that a distance from the main plate center 202*c* to the rotational center of the date hand 464*h* is constituted so as to be longer than a distance from the main plate center 202*c* to the rotational center of the date hand 312*h*. It is preferable that a distance from the main plate center 202*c* to the rotational center of the date hand 464*h* is constituted so as to be longer than a distance from the main plate center 202*c* to the 24 hour hand 330*h*. It is preferable that a distance from the main plate center 202*c* to the rotational center of the date hand 464*h* is constituted so as to be longer than a distance from the main plate center 202*c* to the small second hand 340*h*.

The character, the numeral, and the abbreviation or the like for displaying each time information and each calendar information are provided on the dial 454. For example, in order to display the time information related to "date", the numerals such as "10", "20", and "31" are provided on a position corresponding to the date hand 312*h* of the dial 454 along the circumference. For example, in order to display the time information related to "second", the numerals such as "10", "20", "30", "40", "50" and "60" are provided on a position corresponding to the small second hand 340*h* of the dial 454 along the circumference. For example, in order to display the time information related to "day", English letters such as "Sun", "Mon", "Tue", "Wed", "Thu", "Fri", and "Sat" are provided on the position corresponding to the day finger 464*h* of the dial 454 along the circumference. Alternatively, in order to display the calendar information related to "day", the numeral, Japanese letters, foreign language letters, Roman numerals, and marks or the like may be used.

Figure 44:
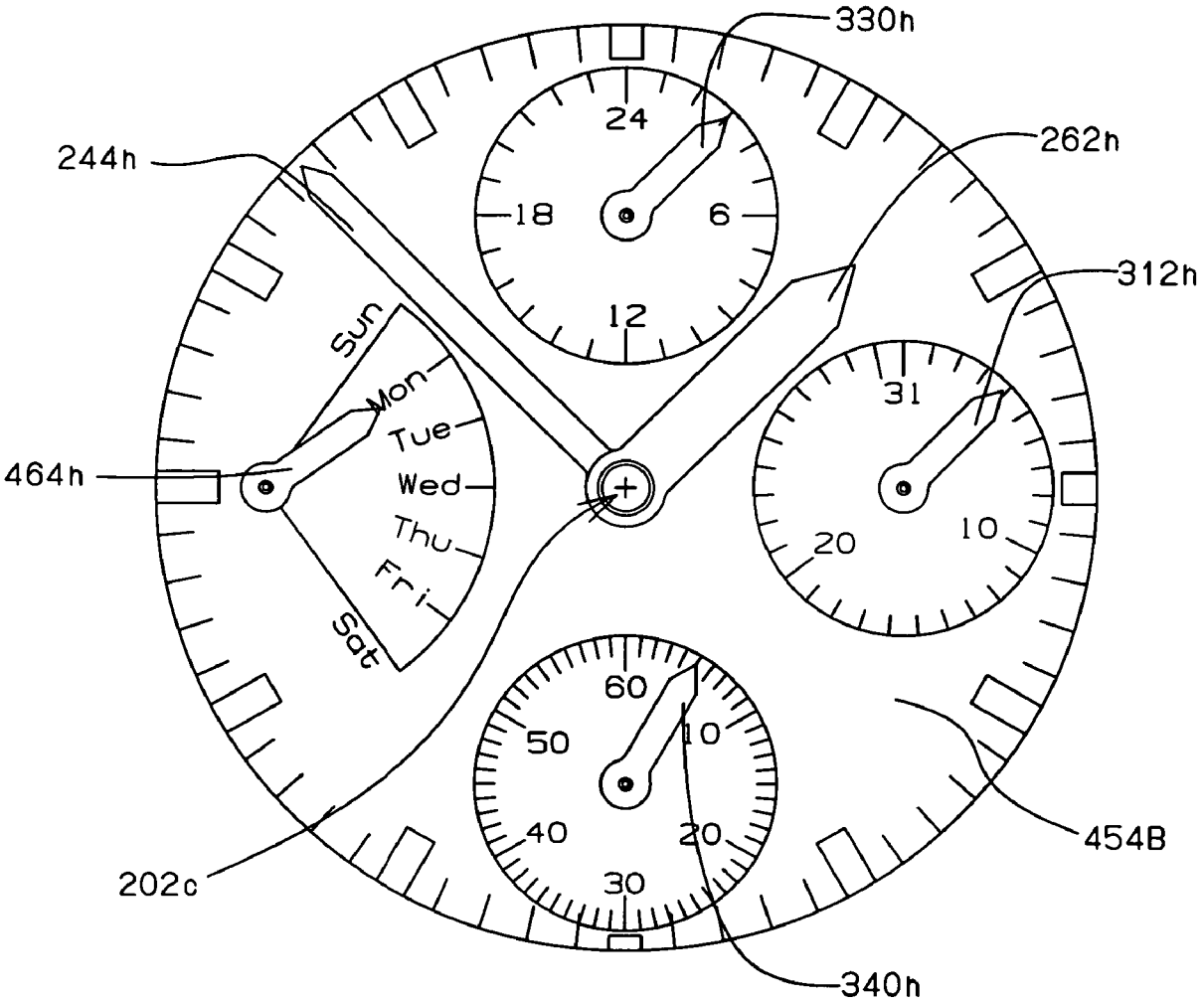
FIG. 44 is a plan view showing a part of a dial of a complete provided with four small hands and a hand according to the fifth embodiment of the multifunctional watch of the present invention.

With reference to FIG. 10 and FIG. 44, according to the eighth kind of the embodiment according to the present invention, it is possible to display the time information related to "hour" of 12-hours by the hour hand 262*h* attached to the hour wheel 262, of which rotational center is the main plate center 202*c*, display the time information related to "minute" by the minute hand 244*h* attached to the second wheel and pinion 244, of which rotational center is the main plate center 202*c*, display the time information related to "second" by a small second hand 340*h* attached to the second wheel 340, of which rotational center is aligned in "the six o'clock direction", display the time information related to "hour" of 24-hours by the 24 hour hand 330*h* attached to the hour wheel 330, of which rotational center is aligned in "the twelve o'clock direction", display the calendar information related to "date" by the date hand 312*h* attached to the date star 312, of which rotational center is aligned in "the three o'clock direction", and display the calendar information related to "day" by the day hand 464*h*, which is attached to the small day wheel 464 capable of being moved in a fan-like form, of which rotational center is aligned in "the nine o'clock direction", namely, a so-called "retrograde type". For example, in order to display the time information related to "hour" of 24-hours, the numerals such as "6", "12", "18", and "24" are provided on the position corresponding to the 24 hour hand 330*h* of the dial 454 along a circumference.

For example, in order to display the calendar information related to "day", the English letters such as "Sun", "Mon", "Tue", "Wed", "Thu", "Fri", and "Sat" are aligned in nearly a fan-like form on the position corresponding to the day finger 464*h* of the dial 454 along a circumference. Alternatively, in order to display the calendar information related to "day", it is also possible to use the numeral, the Japanese letters, the foreign language letters, the Roman numerals, and the marks or the like.

INDUSTRIAL APPLICABILITY

According to the analog multifunctional watch of the present invention, it is possible to form a movement layout provided with a plurality of small hands only by changing positions where the components are incorporated, without changing sizes and shapes of components for the movement. Also, the analog multifunctional watch of the present invention does not require much time to switch the component processing operation and requires a small number of steps for manufacture of the component, whereby a movement layout provided with a plurality of small hands can be formed at a good production efficiency.

The invention claimed is:

1. A multifunctional watch comprising:

a main plate constituting a base plate of a movement;

a hand setting stem for correcting a display;

a switching mechanism for switching a position of the hand setting stem;

a dial for displaying time information; and a small hand for indicating the time information or calendar information;

wherein the movement comprises a first train wheel rotational center for a train wheel used in fabricating a first type of the multifunctional watch having a first type of the small hand, and a second train wheel rotational center for a train wheel used in fabricating a second type of the multifunctional watch having a second type of the small hand;

wherein the first train wheel rotational center is arranged at a position between a main plate center of the main plate and an outline portion of the main plate;

wherein the second train wheel rotational center is arranged at a position between the main plate center of the main plate and the outline portion of the main plate;

wherein the first train wheel rotational center is provided with a first train wheel guide portion for rotatably guiding a first train wheel member during rotational thereof about the first train wheel rotational center;

wherein the second train wheel rotational center is provided with a second train wheel guide portion for rotatably guiding a second train wheel member during rotation thereof about the first train wheel rotational center;

wherein a first train wheel for displaying the calendar information and having the first train wheel member is arranged rotatably relative to the first train wheel rotational center for rotating the first type of the small hand only in a single direction of rotation to display the calendar information; and wherein a second train wheel for displaying the calendar information and having the second train wheel member is arranged rotatably relative to the second train wheel rotational center for rotating the second type of the small hand only in a single direction of rotation to display the calendar information.

2. A multifunctional watch according to claim 1; wherein the first train wheel rotational center is arranged in a three o'clock direction of the movement or in a two o'clock direction of the movement.

3. A multifunctional watch according to claim 1; wherein the second train wheel rotational center is arranged in a nine o'clock direction of the movement or in a ten o'clock direction of the movement.

4. A multifunctional watch according to claim 1; wherein:

the movement comprises a third train wheel rotational center for a train wheel used in fabricating a third type of the multifunctional watch having a third type of the small hand;

the third train wheel rotational center is arranged at a position between the main plate center of the main plate and the outline portion of the main plate;

the third train wheel rotational center is provided with a guide portion for rotatably guiding a third train wheel member during rotation thereof about the third train wheel rotational center; and a third train wheel for displaying the time information, and having the third train wheel member is arranged rotatably relative to the third train wheel rotational center for rotating the third type of the small hand to display the time information.

5. A multifunctional watch according to claim 4; wherein the third train wheel rotational center is arranged in a six o'clock direction of the movement.

6. A multifunctional watch according to claim 4; wherein the third train wheel rotational center is arranged in a twelve o'clock direction of the movement.

7. A multifunctional watch according to claim 1; wherein the first train wheel rotational center is arranged in a three o'clock direction of the movement; and wherein the first train wheel member comprises a date star for displaying a date and mounted to undergo rotation about the first train wheel rotational center, and a corrector setting wheel for correcting the display of the date star and mounted to undergo rotation about a rotational center of the date star.

8. A multifunctional watch according to claim 2; further comprising a first date star for displaying a date and a first corrector setting wheel for correcting the display of the first date star; and wherein the first train wheel guide portion incorporates the first corrector setting wheel when the first date star is arranged on the first train wheel rotational center.

9. A multifunctional watch according to claim 2; further comprising a first date star for displaying a date and a first corrector setting wheel for correcting the display of the first date star; and wherein the movement comprises a first setting spring portion for applying pressure on the first corrector setting wheel when the first date star is arranged on the first train wheel rotational center.

10. A multifunctional watch according to claim 2; further comprising a first date star for displaying a date and a first corrector setting wheel for correcting the display of the first date star; and wherein the movement comprises a first date jumper for setting a rotation of the first date star when the first date star is arranged on the first train wheel rotational center.

11. A multifunctional watch according to claim 2; further comprising a second small day wheel for displaying a day; and wherein the movement comprises a second day jumper for setting a rotation of the second small day wheel when the second small day wheel is arranged on the second train wheel rotational center.

12. A multifunctional watch according to claim 3; further comprising a second small day wheel for displaying a day; and wherein the movement comprises a day indicator driving wheel that undergoes rotation in accordance with rotation at an hour wheel, the day indicator driving wheel rotating the second small day wheel when the second small day wheel is arranged on the second train wheel rotational center.

13. A multifunctional watch according to claim 12; wherein the day indicator driving wheel is mounted for undergoing rotation to rotate an hour wheel that displays an hour.

* * * * *